US006701643B2

(12) United States Patent
Geer et al.

(10) Patent No.: US 6,701,643 B2
(45) Date of Patent: Mar. 9, 2004

(54) FOOTWEAR STRUCTURE AND METHOD OF FORMING THE SAME

(75) Inventors: Kenton D. Geer, Ogunquit, ME (US); Gary J. Troy, Nottingham, NH (US)

(73) Assignee: Kenton Geer Design Associates, Inc., Ogunquit, ME (US)

( * ) Notice: Subject to any disclaimer, the term of this patent is extended or adjusted under 35 U.S.C. 154(b) by 0 days.

(21) Appl. No.: 10/308,320

(22) Filed: Dec. 3, 2002

(65) Prior Publication Data

US 2003/0079373 A1 May 1, 2003

Related U.S. Application Data

(60) Division of application No. 09/609,620, filed on Jul. 5, 2000, now Pat. No. 6,519,876, which is a continuation-in-part of application No. 09/073,292, filed on May 6, 1998, now Pat. No. 6,092,305.

(51) Int. Cl.[7] ..... A43B 3/26

(52) U.S. Cl. ..... 36/97; 36/102; 36/45; 36/30 R

(58) Field of Search ..... 36/97, 76 R, 25 R, 36/102, 103, 45, 30 R

(56) References Cited

U.S. PATENT DOCUMENTS

| | | | | |
|---|---|---|---|---|
| 4,497 A | * | 5/1846 | Vetter | 36/7.1 R |
| 597,524 A | | 1/1898 | Molloy et al. | |
| 641,642 A | | 1/1900 | Gunn | |
| 797,966 A | * | 8/1905 | Lange et al. | 36/97 |
| 1,148,604 A | | 8/1915 | McBrearty | |
| 1,974,543 A | | 9/1934 | Reymond | |

(List continued on next page.)

FOREIGN PATENT DOCUMENTS

| | | | |
|---|---|---|---|
| DE | 3429284 | * | 2/1986 |
| FR | 1218101 | | 5/1960 |
| FR | 2501480 | | 9/1982 |
| WO | WO96/18317 | | 6/1996 |
| WO | WO01/82733 A1 | | 11/2001 |

OTHER PUBLICATIONS

Dakkak Brothers Company, Our Products: Microcellular Rubber Sheets, T.P.R.—Granules, EVA Compound, Rubber Compound [online], http://www.dakkakco.com/products1.html [retrieved on Jun. 7, 2001], pp. 1/3–3/3.

Acor Orthopaedic, Inc., Poron [online], http://www.acor.com/srp.htm, [retrieved on Jun. 5, 2001], pp. 1/3–3/3.

Bontex, Our Products [online], http://bontex.com/products.html, [retrieved Jun. 4, 2001], pp. 1/2–2/2.

Acor Orthopaedic, Inc., SRP [online], http://www.acor.com/srp.htm, [retrieved on Jun. 5, 2001], pp. 1/2–2/2.

*Primary Examiner*—Ted Kavanaugh
(74) *Attorney, Agent, or Firm*—Grossman, Tucker, Perreault & Pfleger, PLLC

(57) ABSTRACT

A footwear structure including an upper and a separate midsole having interlocking shank portions. The upper has an upward extending arc in the shank area which defines a shank interlock portion therein. The midsole has a corresponding arc which defines a shank interlock portion on a bottom surface thereof which mates with the arc in the upper for resisting motion of the midsole relative to the outsole in the case where the midsole is unsecured within the structure to allow for removal of the midsole. The structure may include an outsole having a shank interlock area that mates with the shank interlock of the midsole, with or without an upper disposed between the midsole and the outsole. The shank interlock areas may include a continuous arc or an abruptly changing arc, and the midsole may be removable or non-removable from the structure. A rigid shank insert may be provided between the midsole and outsole, and the midsole may include a variety of layers. The upper may include stretch zones and non-stretch zones to allow a single upper to be used with differently sized midsoles.

20 Claims, 33 Drawing Sheets

U.S. PATENT DOCUMENTS 2,016,070 A * 10/1935 Brokman ..... 36/25 R
2,317,880 A 4/1943 Bingham, Jr. ..... 12/142
2,317,918 A 4/1943 Knipe ..... 36/22
2,371,322 A 3/1945 Toothaker ..... 36/76
2,437,065 A 3/1948 Austin ..... 36/3
2,456,102 A 12/1948 Agostinelli ..... 36/68
2,719,367 A 10/1955 Bergmans ..... 36/12
2,887,793 A 5/1959 Starr ..... 36/3
3,026,635 A 3/1962 Slade
3,389,481 A 6/1968 England
3,404,468 A 10/1968 Rosen ..... 36/11
3,624,930 A 12/1971 Johnson et al. ..... 36/43
3,629,961 A 12/1971 Seif ..... 36/2.5
3,705,463 A 12/1972 Lown ..... 36/25
3,724,105 A 4/1973 Weight ..... 36/44
3,916,539 A 11/1975 Pankin et al. ..... 36/51
3,952,430 A 4/1976 Pankin et al. ..... 36/51
4,084,333 A 4/1978 Del Vecchio ..... 36/43
4,215,493 A 8/1980 Antonious ..... 36/51
4,262,435 A 4/1981 Block et al. ..... 36/129
4,270,285 A 6/1981 Antonious ..... 36/50
4,354,319 A 10/1982 Block et al. ..... 36/114
4,366,629 A 1/1983 Scherz
4,451,995 A 6/1984 Antonious ..... 36/51
4,489,509 A 12/1984 Libit
4,506,460 A 3/1985 Rudy ..... 36/28
4,516,336 A 5/1985 Nissenbaum
4,541,184 A 9/1985 Leighton ..... 36/44
4,551,930 A 11/1985 Graham et al. ..... 36/30
4,554,749 A 11/1985 Ostrander ..... 36/102
4,559,723 A 12/1985 Hamy et al. ..... 36/102
4,562,652 A 1/1986 Hensler
4,590,123 A 5/1986 Hashimoto et al. ..... 428/316
4,627,178 A 12/1986 Sullivan et al. ..... 36/44
4,654,983 A 4/1987 Graham et al. ..... 36/30
4,658,516 A 4/1987 Beck ..... 36/59
4,724,624 A 2/1988 Duclos ..... 36/116
4,733,483 A * 3/1988 Lin ..... 36/28
4,739,765 A 4/1988 Sydor et al. ..... 128/615
4,742,625 A 5/1988 Sydor et al. ..... 36/3
4,835,884 A 6/1989 Bianchini et al. ..... 36/24.5
4,843,741 A 7/1989 Yung-Mao ..... 36/114
4,845,863 A 7/1989 Yung-Mao ..... 36/114
4,881,328 A 11/1989 Yung-Mao ..... 36/28
4,897,938 A 2/1990 Otsuka ..... 36/88
4,905,382 A 3/1990 Yung-Mao ..... 36/107
4,908,962 A 3/1990 Yung-Mao ..... 36/28
4,910,887 A 3/1990 Turner et al. ..... 326/114
4,967,492 A 11/1990 Rosen ..... 36/97
5,025,573 A 6/1991 Giese et al. ..... 36/30
5,060,402 A 10/1991 Rosen ..... 36/97
5,086,572 A 2/1992 Lee ..... 36/3
5,123,181 A 6/1992 Rosen ..... 36/97
5,203,097 A 4/1993 Blair ..... 36/59
5,337,492 A 8/1994 Anderie et al. ..... 36/28
5,367,791 A 11/1994 Gross et al. ..... 36/31
5,367,792 A 11/1994 Richard et al. ..... 36/114
5,384,973 A 1/1995 Lyden ..... 36/25
5,400,526 A 3/1995 Sessa ..... 36/3
5,408,761 A 4/1995 Gazzano ..... 36/88
5,423,135 A 6/1995 Poole et al. ..... 36/25
5,425,186 A 6/1995 Hoyt
5,469,639 A 11/1995 Sessa ..... 36/28
5,529,830 A 6/1996 Dutta et al. ..... 428/176
5,555,650 A 9/1996 Longbottom et al. ..... 36/114
5,675,914 A 10/1997 Cintron ..... 36/3
5,727,271 A 3/1998 Romanato et al. ..... 12/142
5,729,912 A * 3/1998 Gutkowski et al. ..... 36/97
5,765,296 A 6/1998 Ludemann et al. ..... 36/51
5,804,011 A 9/1998 Dutta et al. ..... 156/160
5,809,665 A 9/1998 Suenaga ..... 36/43
5,813,146 A 9/1998 Gutkowski et al. ..... 36/97
5,829,171 A 11/1998 Weber et al. ..... 36/93
5,879,725 A 3/1999 Potter ..... 425/403
5,893,219 A 4/1999 Smith et al. ..... 36/3
5,915,820 A 6/1999 Kraeuter et al. ..... 36/114
5,940,990 A 8/1999 Barret ..... 36/55
5,946,825 A 9/1999 Koh et al. ..... 36/44
5,948,707 A 9/1999 Crawley et al. ..... 422/101
5,996,253 A 12/1999 Spector ..... 36/27
6,014,824 A 1/2000 Gumbert ..... 36/103
6,023,857 A 2/2000 Vizy et al. ..... 36/30
6,029,376 A 2/2000 Cass ..... 36/50
6,050,001 A 4/2000 Ditrtrich ..... 36/35
6,065,230 A 5/2000 James ..... 36/25
6,092,305 A 7/2000 Troy et al. ..... 36/3
6,105,279 A 8/2000 Bouchoms ..... 36/25
6,115,945 A 9/2000 Ellis, III ..... 36/102
6,119,373 A 9/2000 Gebhard et al. ..... 36/114
6,122,844 A 9/2000 Nunez ..... 36/29
6,138,385 A 10/2000 Jungkind et al. ..... 36/97
D433,560 S 11/2000 Pawlus ..... D2/969
6,205,683 B1 3/2001 Clark et al. ..... 36/30
6,519,876 B1 2/2003 Geer et al. ..... 36/76
2002/0088145 A1 7/2002 Clark et al. ..... 36/97

* cited by examiner

FOOTWEAR STRUCTURE AND METHOD OF FORMING THE SAME

CROSS-REFERENCE TO RELATED APPLICATION

The present application is a divisional of U.S. application Ser. No. 09/609,620, filed Jul. 5, 2000, now U.S. Pat. No. 6,519,876, which is a continuation-in-part of U.S. application Ser. No. 09/073,292, filed May 6, 1998, now U.S. Pat. No. 6,092,305, the teachings of which are incorporated herein by reference.

FIELD OF THE INVENTION

The present invention relates in general to footwear structures and, more particularly, it relates to footwear structures having an interlock between an outsole and a midsole and improvements to footwear structure components.

BACKGROUND OF THE INVENTION

The ideal footwear design would incorporate the following essential features and characteristics: comfort, cushioning, shock absorption, stability, flexibility, support, good fit, and would also be lightweight. These features are achieved in, and are dependent upon, the structural and functional design elements of the footwear, which enhance the wearer's ability to perform various activities without pain or inconvenience.

To date, prior art footwear constructions have failed to successfully combine the essential features of an ideal design. Prior attempts to create the ideal footwear design have been unsuccessful largely because prior structures have emphasized one of the above-noted features to the detriment of others. Furthermore, prior attempts to construct an ideal footwear design have failed to consider the importance of other key features such as industrialized construction, style and fashion.

Prior art footwear constructions that provide cushioning generally have three or four separate parts. First, such conventional footwear designs are provided with an outsole. The outsole is made of a durable material that extends across the lower surface of the shoe and contacts the ground during use to provide traction. The outsole may also have integrally molded full or partial sidewalls extending upwardly around its periphery. Second, a midsole is permanently joined to the outsole on its interior upper surface and any abutting outsole interior sidewall surfaces to provide a cushioning layer within the footwear structure. In some cases the midsole and outsole material are formed as one component of similar or dissimilar materials. Third, an upper, usually formed of leather, synthetics or other materials, is joined to the top surface of the midsole and any abutting interior sidewall surfaces of the outsole and midsole which extend upwardly around the periphery of the upper. Fourth, in many prior art constructions, a thin cushioning insole is further provided for disposal between the top surface of the midsole and the wearer's foot.

The conventional footwear cushioning components and their positioning within the footwear structures of prior art constructions have several undesirable characteristics. For example, it is well known in the art that the cushioning properties of the materials used in footwear midsole and insole designs are substantially reduced after the footwear has been used for a period of time. In some instances, a substantial reduction in cushioning can occur in a relatively short period of time. The footwear midsole and insole components are typically made of various foam and rubber materials which are subjected to repeated application of impact forces and stress which cause compression set, degradation, and fatigue resulting in reduced resiliency and failed cushioning properties. The typical foam midsole and insole cushioning materials are various formulations of sheet stock or molded eva, polyethylene, and polyurethane. The typical rubber materials are latex and neoprene.

The midsoles in prior art footwear constructions have several undesirable characteristics. For example, the consumer at the point of purchase is unable to make an alternative choice in the cushioning characteristics of the midsole without selecting separate footwear designs. Also, the wearer is unable to replace the midsole component after it has degraded and lost its ability to provide adequate cushioning and support. In addition, the attachment of the midsole to other components in the footwear structure such as the top surface of the outsole, abutting outsole side wall interior surfaces, and to the formed upper negate the ability of the midsole component to adequately compress, deform, and rebound while providing maximum cushioning.

Another undesirable feature of prior art designs is that the ability of the footwear structure to provide maximum cushioning of the foot structures at the appropriate instant in the gait cycle is negated in prior footwear constructions by the positioning of semi-rigid and rigid structural elements in close proximity to the wearer's foot. The semi-rigid and rigid structural elements are typically positioned below the wearer's foot on the top surface of the midsole or slightly recessed into the top surface of the midsole. The typical semi-rigid and rigid structural elements are: shanks, shank stiffeners, lasting insoles, stabilizers, and fasteners. The shanks, shank stiffeners, lasting insoles, stabilizers, and fasteners are usually made of metals, fiber composites, thermoplastics, and fibrous paperboard. All of these semi-rigid and rigid structural elements negate the performance and cushioning ability of the midsole, and therefore negatively impact user comfort.

In some footwear constructions a lasting margin structure is formed by the combination of gathered upper materials and the adhesives used to attach the upper to the lasting insole or top surface of the midsole. This lasting margin structure extends around and projects inward from the periphery of the lasting insole or midsole to a distance of approximately 15.0 mm to 25.0 mm creating a semi-rigid border within the footwear structure. This formed structure also negates the performance and cushioning ability of the midsole, to the detriment of user comfort.

Furthermore, prior art midsoles have external surfaces, especially along the side portions thereof, which are exposed to environmental conditions such as heat, cold, water, ultraviolet rays, abrasion from rocks, sand, soil, punctures from sharp pointed objects, and cuts from sharp edged objects. The environmental conditions contribute to the failure of midsole component cushioning in two main ways: degradation of the midsole cushioning materials, and destruction of the means by which the midsole cushioning component is attached to the footwear structure. Another undesirable feature of prior art designs is that the thin cushioning insole which is positioned between the top surface of the lasting insole or midsole and the wearer's foot is typically too thin to provide optimal cushioning.

In an attempt to overcome some of the above-described deficiencies of prior art designs, some prior art constructions have incorporated custom or removable midsole inserts.

These structures, however, remain encumbered by undesirable characteristics. One such structure is described in U.S. Pat. No. 4,881,328 (hereinafter "the '328 patent") to Lin Yung-Mao. The '328 patent describes a structure with an outsole and a peripheral midsole. A midsole insert is disposed over the peripheral midsole with cushioning elements extending downward adjacent the outsole. Unfortunately, the midsole insert and cushion elements must conform to a matching lift height of the peripheral midsole member. The peripheral midsole member also provides the only method of retaining midsole insert and structural support for the peripheral area of the shoe. The upper must be attached to the top surface of the peripheral midsole member, and the bottom surface of the peripheral member is attached to the upper surface of the outsole. The midsole insert must have an outwardly projecting lip to cover the upper that is attached at the peripheral member. Thus, the method of construction is complex and inefficient, and does not provide for maximum full perimeter cushioning since the rigid peripheral member is in close proximity to the user's foot. The structure also has no means of providing for a midsole insert for a raised heel design typically found in dress, casual shoe, and boot constructions, and fails to provide air circulation within the structure.

Thus, a need exists in the art for an improved footwear structure that provides full perimeter maximum cushioning of the foot structures, support and stability for the foot structures, allows the positioning of semi-rigid and rigid structural elements away from the wearer's foot, and can provide maximum cushioning without the restrictions caused by attachment of the midsole to other components in the footwear structure. Further, a need exists for a removable or non-removable midsole that: can be selected according to the wearer's cushioning preference, can be selected according to the wearer's weight, can be selected according to various performance feature options, can provide air circulation within the footwear's interior environment, can be replaced after a substantial reduction and degradation of midsole cushioning occurs and can protect the midsole cushioning element from damage due to environmental conditions. A need also exists for a structure that allows for manufacturing efficiencies by facilitating use of differently sized midsoles with a single upper construction.

SUMMARY OF THE INVENTION

The footwear structure of the present invention is organized about the concept of providing an outsole and/or an upper having a shank interlock portion which mates with a corresponding shank interlock portion in a separate midsole. In one embodiment, the outsole and/or upper has an upward extending arc (either a continuous arc or an abruptly changing arc) in the shank area which defines the shank interlock portion therein. The midsole has a corresponding arc that defines the shank interlock portion on a bottom surface thereof which mates with the shank interlock in the outsole and/or upper.

Advantageously, the midsole may be permanently secured in the structure, or it may be left unsecured within the structure to allow for removal and replacement. In the case where the cushionability of the midsole degrades over time, the midsole may be removed and replaced to restore the overall comfort of the shoe. In addition, a semi-rigid or rigid shank insert, or a stabilizing material, may be provided between the midsole and the outsole, thereby removing rigid structural components from close proximity to a user's foot. Other advantageous features for providing air flow within the shoe, heel and forefoot cushioning, and manufacturability are also provided. For example, a stretch upper may be provided to allow use of a single upper with a variety of midsole configurations. Moreover, the midsole may be provided in multiple layers in embodiments that are useful with or without mating shank interlock areas.

In particular, a footwear structure according to one embodiment of the present invention includes a midsole, and an upper having a bottom portion positioned below the midsole. The bottom portion of the upper has a shank interlock portion interlocking with a corresponding shank interlock portion in the midsole. Interlocking of the shank interlock portions of the upper and the midsole resists motion of the midsole relative to the upper. The structure may also include an outsole with a shank interlock portion that mates with the shank interlock portions in the midsole and the upper, the bottom portion of the upper being disposed between the midsole and the outsole. The shank interlock portions may include a continuous arc or an abruptly changing arc.

The upper may be provided in a number of embodiments. The upper may be a molded upper integrally formed with the outsole, or may include a plurality of closure straps. The upper may also include a stretch zone that stretches to allow interlocking of the shank interlock portion of the upper with corresponding shank interlock portions of a plurality of differently sized ones of the midsoles. The upper may also include a removable bootie portion that is removable from a second portion, and the midsole may be disposed within the bootie. The upper may also include a molded receptacle, and a portion of the midsole may be disposed within the molded receptacle.

The midsole may be permanently affixed in the structure, or may be removable therefrom. The top surface of the midsole may be contoured to define a footbed generally conforming to the bottom of a person's foot, and may include an upwardly extending perimeter wall. The midsole may include a plurality of layers, with at least a first one of the layers being less firm than a second one of the layers. In one embodiment, the firmness of the midsole layers may decrease from a top layer of the midsole to a bottom layer of the midsole. A shank component and/or reinforcing layer may be disposed between the midsole and the outsole, and may include a shank interlock portion that mates with the shank interlock portions of the midsole, the upper, and the outsole. In another embodiment, the upper may not be disposed between the midsole and the outsole, e.g. the upper may be disposed on top of the midsole. In this embodiment a shank component and/or reinforcing layer may be disposed between the upper and the midsole with shank interlock portions of the shank, midsole, and outsole, in mating relationship. The shank component may extend along the full length of the midsole or any portion thereof, and may include perimeter, cupping walls for stabilizing the midsole.

One method of forming a footwear structure consistent with the invention includes: providing a last including a foot volume portion and a midsole volume portion, and having a shank interlock area; placing an upper on the last; securing an outsole to the upper, the outsole having a shank interlock portion mating with a shank interlock portion in the upper; removing the last from the upper to thereby leave a cavity in the upper, the cavity including a foot volume portion and a midsole volume portion in the upper; and inserting a midsole in the midsole volume portion of the cavity, the midsole having a shank interlock portion mating with the shank interlock portion in the upper.

BRIEF DESCRIPTION OF THE DRAWING

For a better understanding of the present invention, together with other objects, features and advantages, reference should be made to the following description of exemplary embodiments which should be read in conjunction with the following figures wherein like numerals represent like parts.

DETAILED DESCRIPTION

Figure 1:
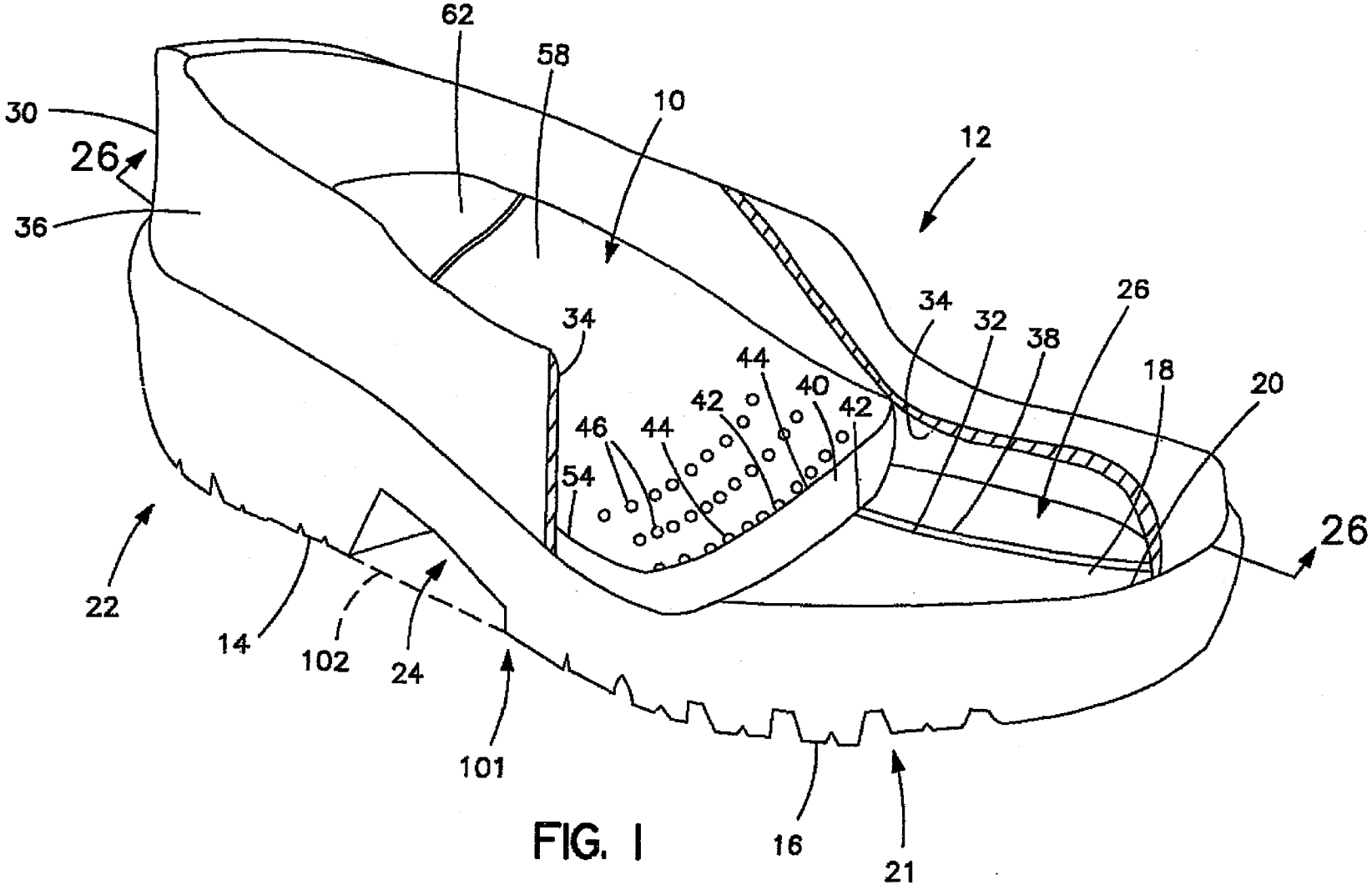
FIG. 1 is an isometric partial sectional view of a footwear structure according to the invention as fitted with a midsole therefor, with portions broken away to show interior structure.

Referring first to FIG. 1, an isometric view of an exemplary shoe construction according to the invention is shown. An exemplary midsole consistent with the invention is indicated generally at 10. Midsole 10 is shown as combined with an outsole 14 and an upper 30 to form a footwear structure 12 according to the invention. While the upper 30 of the illustrated footwear structure 12 is shown in only outline form, it is to be understood that the invention can be employed in many types of athletic and non-athletic footwear structures such as walking shoes, running shoes, aerobic shoes, casual shoes, boots, ice skates, in-line skates, ski boots, specialty footwear, orthopedic or prescription footwear, etc. Those skilled in the art will recognize that any upper construction could be used with corresponding changes in the outsole design depending on the desired application. Also, a separate upper may not be provided in the case of a molded construction wherein the outsole and the exterior surface of the structure are formed as a unitary member. In such a molded construction, the upper would be integral with the outsole. The invention thus has application in any circumstance where a removable or non-removable midsole with varying cushioning characteristics is desired or useful. Several advantages are also achieved relative to the adaptation of biomechanically and anatomically designed and engineered performance and comfort features.

Outsole 14 generally forms the wearing surface of the shoe or footwear structure. Outsole 14 may be constructed of a relatively durable, resilient material such as rubber, and may have an exterior surface that is provided with a suitable tread surface 16. Depending on the intended purpose of the structure, the outsole may be formed of a rigid or semi-rigid material, as used, for example, in ski boots, ice skates or in-line skates. The term "outsole" shall refer generally to the structural component that includes the bottom exterior surface 101 of the footwear structure. The outsole may be a unitary member having upwardly extending walls that define the upper, e.g. as in a rubber boot, molded in-line skate, ski boot, etc., or the outsole may have a separate upper 30 secured thereto for forming a portion of the exterior surface of the structure. Also, the bottom surface 101 may include a tread surface 16, or may have another element attached thereto, e.g. a skate blade, rollers etc. For example, a skate blade or skate chassis may have peripheral walls that would also attach to the outsole or upper.

Advantageously, a shank interlock portion 24 may be formed in the outsole for forming a mating interlock with the midsole, as will be described in detail below. The top interior surface 18 of the outsole in the shank interlock portion arcs upwardly in the shank area from the forefoot area 21 and arcs downwardly from the middle of the shank area to the heel area 22. In the illustrated embodiment, the arc of the top surface 18 in the shank interlock portion is continuous. It is possible, however, to form the arched shank interlock in a discontinuous fashion by providing discrete portions having top surfaces that form an arched plane on the top surface 18. It is also possible to form the shank interlock portion in a non-uniform or abrupt arched shape, and to provide an arch in the top surface that extends laterally across the shank interlock portion. From a manufacturing standpoint, however, it is advantageous that the top interior surface 18 in the arched shank interlock portion of the outsole be in the form of a gradual and continuous arc from the forefoot area toward the heel, as shown. Those skilled in the art will recognize that the length of the shank interlock portion may vary with the particular size, function, style, etc. of the structure.

On the bottom exterior surface 101 of the outsole in the illustrated embodiment, the interlock section separates and defines the forefoot area 21 and the heel area 22. In the case where a flat bottomed structure with no defined heel is desired, the bottom surface 101 of the outsole in the shank interlock area 24 may be flat, i.e. following dashed line 102, or partially flat, e.g. with a "fiddle shank", instead of concave as shown. In an embodiment wherein all or part of the bottom surface is flat, the arched shank interlock 24 would remain in the top surface 18 of the outsole.

In the illustrated embodiment, the peripheral wall or member 20 projects upwardly from the top surface 18 and extends completely around the periphery of outsole 14. While the illustrated peripheral member 20 is endless, this need not necessarily be the case. Member 20 can for example take the form of several sections spaced around the periphery of the shoe, or the member could have varying and undulating heights as it wraps around the periphery of the shoe. It could also be formed as a separate component and secured, e.g. by adhesive, to the upper surface 18 of the outsole. The peripheral wall may also be omitted from the construction. As discussed above, the peripheral wall 20 could extend upwardly to define an integral upper and the entire exterior surface of the structure. The exterior surface of the outsole would thus include a base portion, e.g. including a tread, skate chassis, etc., and a portion defining the upper. This would occur, for example, in molded construction such as a ski boot, molded skate, etc.

In a non-molded construction, however, the structure 12 further comprises a separate upper 30 that is secured to the outsole to form the exterior surface of the structure and at least a portion of the foot cavity in combination with the outsole. While the illustrated upper is shown only in the outline form, those skilled in the art can readily choose an appropriate upper depending on intended use and/or aesthetics. The upper can be fashioned of leather, cloth, synthetic materials or a combination of these. The upper may also include separate molded textile, molded foam, or molded plastic components, which are joined together. In addition, although the illustrated upper 30 is shown as only a single layer of material, those skilled in the art will recognize that multiple materials could be combined in the upper to provide water proofing, moisture management, wicking, quick drying, temperature regulation, warmth, support, physical protection for the foot, etc., as exist, for example, in GORE-TEX expanded polytetrafluoroethylene material or SYMPATEX vapor-permeable membrane waterproof boot-type constructions.

The multiple layers of the upper may be secured to one another or may be configured as removable elements, e.g. in a removable bootie-type construction. Also, various features may be added to the upper and/or outsole for aesthetic appeal. For example, the upper and/or portions thereof, e.g., removable bootie portions, may include windows or holes therethrough, perforations, or could be constructed of mesh or net-like material. A window or windows may be provided in the upper or outsole, for example, to allow viewing of the midsole. In an exemplary embodiment, upper 30 has an exterior surface 36 with a bottom exterior surface 32 and an interior surface 34 with a bottom interior surface 38. The bottom exterior surface 32 may be attached to the outsole top surface 18 by a known adhesive or by molding the outsole directly to the upper by direct injection. Exterior upper surface 36 adjacent the sidewall surface 33 is also attached to interior sidewall surface 33 (FIG. 26) of peripheral member 20. It is possible, however, that the bottom of the upper could be removed or cut out. In this case, the upper may be secured to the outsole by attaching exterior surface 36 to the interior sidewall surface 33, or by attaching the interior surface 34 to the exterior sidewall surface 35. In the illustrated embodiment, however, the interior surface 34, including interior bottom surface 38, at least partially forms the central receptacle or cavity 26 that is dimensioned for receiving midsole 10 and a user's foot of a particular size.

Figure 26:
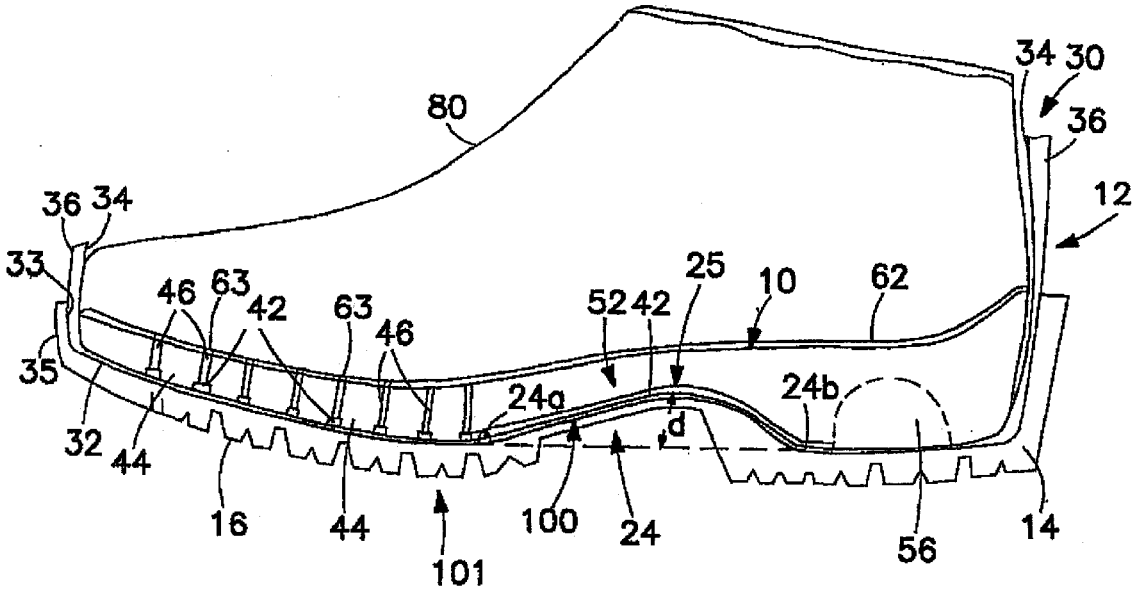
FIG. 26 is a longitudinal section taken substantially along line 26—26 of FIG. 1.

Midsole 10 may include a midsole bottom surface 40 having a plurality of integrally formed channels 42 surrounding a plurality of integrally formed cushion pads 44. A plurality of thru holes 46 may extend upward from the channels 42 to the midsole top surface 58 primarily in the forefoot area 50 of the midsole. The holes 46 could also be formed throughout the entire length of the midsole or any portion thereof. As shown in FIG. 26, midsole 10 may be dimensioned to occupy substantially the entire receptacle 26.

In the illustrated embodiment, when insert 10 is inserted into receptacle 26, the midsole bottom 40 is in contact with upper bottom interior surface 38 and the midsole sidewall 54 is positioned adjacent the interior upper surface 34. The shank area interlock portion 52 (FIG. 2) of the insert 10 contacts the interior upper surface 38 and mates with the corresponding shank interlock portion 24 of the outsole. In the case where the upper is formed without a bottom surface (not shown), the bottom surface of the midsole would directly contact the upper interior surface 18 of the outsole.

In the illustrated embodiment, however, the midsole is disposed above the outsole so that the bottom surface 40 in the shank interlock area 52 of the midsole interlocks with the arched top interior surface 18 in the shank interlock area 24 of the outsole. In the case where another structure, e.g. a shank component, reinforcing layer, or bottom surface of an upper, is disposed between the midsole and the outsole, the midsole remains disposed above the outsole so that the shank interlock portions thereof mate or interlock, even though no direct contact may be made between the midsole and the outsole. Also, where the interior surface 18 in the arched shank interlock portion of the outsole is formed in a discontinuous manner, bottom surface 40 in the arched shank interlock portion of the midsole may have a corresponding portion which interlocks with the discontinuity in the surface 18 in the outsole. This could provide additional interlocking between the outsole and midsole, but would increase the cost of manufacture for the structure.

In an embodiment wherein the outsole is formed with peripheral sidewalls 20 that extend above the height of the midsole e.g., in a molded shoe or boot design, the midsole bottom surface could be directly disposed against the outsole upper surface or some intervening layer could be placed between the outsole and the midsole. Also, the midsole sidewall 54 would be disposed adjacent the outsole peripheral sidewall.

A covering material 62, which may be formed of a polyester/nylon material, leather, or a variety of other materials, or combinations thereof, known to those skilled in the art, may be joined by gluing or molding to the upper midsole surface 58 to provide a buffer between the midsole and a user's foot. For example, the covering material or materials may provide anti-microbial, temperature regulation, and/or moisture management (e.g., including wicking, quick drying, or low water absorption features) features. Advantageously, therefore, the structure does not require any additional insole or sock liner placed on top of the midsole to be suitable for wearing, although such items may be provided. As shown, the covering material 62 may extend in both longitudinal and latitudinal directions to the midsole sidewall 54 without interruption. The covering material may also extend from the top surface to the bottom of the midsole sidewall surface or the material may fully wrap and extend all around the entire midsole component. Those skilled in the art will recognize that additional functional layers, e.g., for shock absorption or shock diffusion, may also be provided at the midsole top surface in close proximity to the foot.

Figure 2:
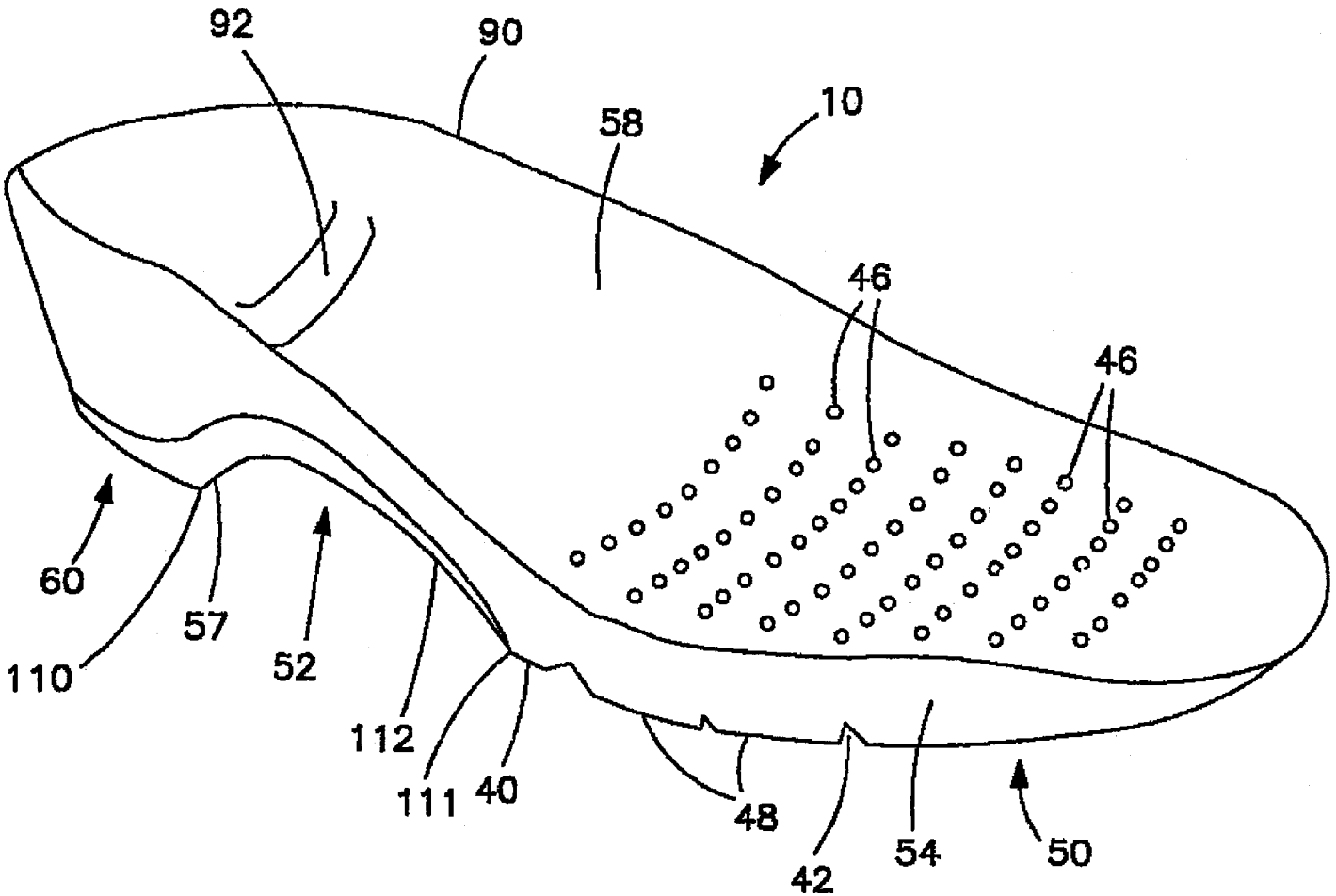
FIG. 2 is a top isometric view of an exemplary embodiment of a midsole according to the invention.
Figure 3:
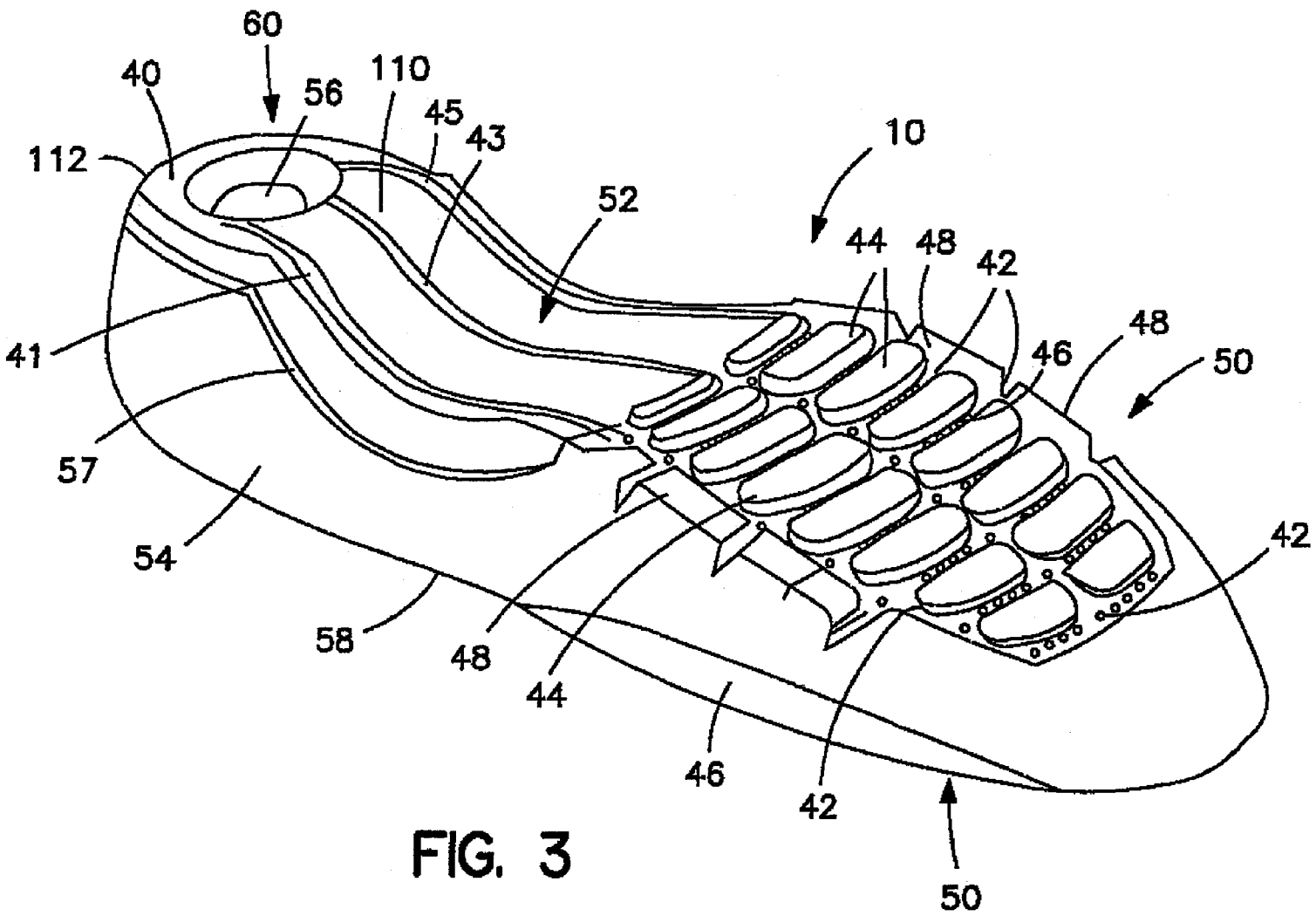
FIG. 3 is a bottom isometric view of the midsole shown in FIG. 2.

Referring now to FIGS. 2 & 3, midsole 10 may have a bottom surface 40 and an anatomically contoured or custom contoured top surface 58. The bottom surface 40 may be provided with a plurality of integrally formed channels 42 surrounding a plurality of integrally formed cushion pads 44. In the illustrated embodiment, a plurality of thru holes 46 may extend from the channels 42 to the midsole top surface 58 primarily in the forefoot area 50. Corresponding holes 63 may pass through the covering material 62.

In the illustrated embodiment, cushioning pads 44 take the form of geometric raised shapes surrounded by the channels 42. The combination of cushioning pads 44, channels 42, and thru holes 46 provides independent multi-point cushioning and ambient airflow circulation. This is because cushioning pads 44 will compress independently of each other, and at the same time force the ambient air that is located in the air channels 42 that surround the cushioning pads 44 to move within and around the channels 42 and up through the thru holes 46. The plurality of cushioning pads 44 are generally of the same depth.

An outwardly projecting bead may be advantageously located at the bottom of a removable midsole of this invention as an additional means of removably securing the midsole within the upper structure. The bead may extend partially or fully around the perimeter of the midsole. The bead interlocks with a corresponding inwardly projecting mating surface in the interior sidewall portion of an upper, outer midsole, or an outsole to form an interlocking which helps to keep the midsole in its proper position. The midsole may be readily engaged and disengaged within the footwear structure with this bead interlock feature. It may be advantageous for example to provide this interlocking feature in the toe area of an open toed sandal structure which has a removable midsole. This feature could also be included in any application where an additional means of removably securing the removable midsole to an upper, outer midsole, or outsole structure is desired. The bead interlock is advantageously formed with a radius on each mating surface although a variety of shapes suitable for interlocking may be used.

A plurality of flex notches 48 are located on both the lateral and medial sides of insert 10 in the forefoot area 50 intersecting the midsole bottom 40 and the peripheral wall 54. Flex grooves of varying depths and/or shapes may also be placed in locations on the bottom of the midsole. Deep flex grooves may be positioned behind outside of the range where a wearer's metatarsal heads are likely to fall to provide flexibility while supporting the metatarsal heads. Channels 42 separate the flex notches and extend in the peripheral wall 54. Channels 42 could also continue through the peripheral wall and extend into and through the top surface of the midsole. Thus, the channels 42 could pass fully or partially around the midsole to provide up to 360 degrees of air circulation.

In the shank interlock area 52, portions 41, 43, 45, of the formed air channels 42 continue running in a longitudinal direction toward and may intersect a domed cylindrical heel cavity 56 formed in the bottom surface 40 of the midsole. The heel cavity 56 allows the molded midsole to compress and move the ambient air within the cavity to flow thru the channels 42 and thru holes 46 when the foot structure bears weight upon the heel area 60. Thus, improved airflow through the midsole is achieved. Further, the heel cavity provides additional cushioning ability because the geometry provides a collapsing/rebounding dome type structure.

Since the midsole bottom surface 40 is, in the illustrated exemplary embodiment, in direct contact with the bottom interior surface 38 of the upper, the midsole bottom surface 40 is provided with a radiused edge 110 at the transition between the heel 60 and the shank interlock portion 52 and a radiused edge 111 at the transition between the forefoot area 50 and the shank interlock portion 52. A radiused or beveled edge 112 may be formed at the transition between the bottom surface 40 and the peripheral wall 54. The radiused edges on the bottom surface 40 prolong the life of the structure by minimizing the possibility that the midsole will tear the upper during use.

Figure 4A:
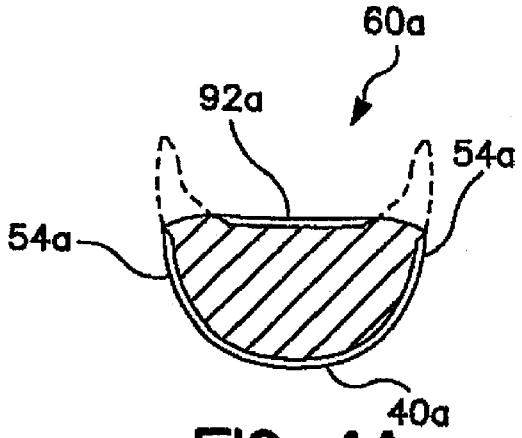
FIGS. 4A–4C are transverse sectional views of the heel area, shank area and forefoot area of an exemplary midsole consistent with the invention.
Figure 4C:
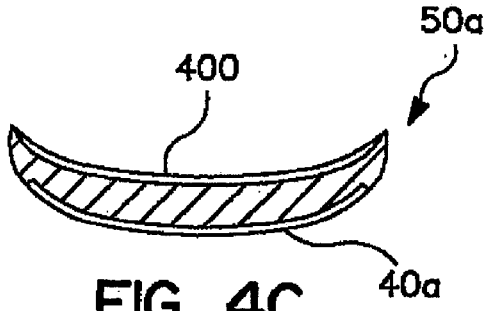
Figure 4B:
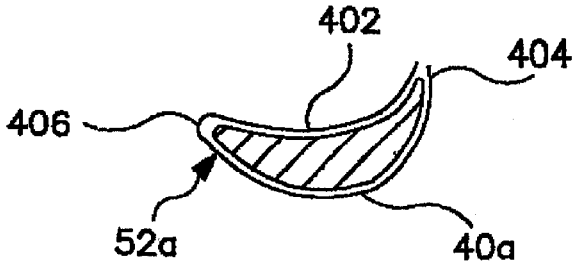
Figure 5A:
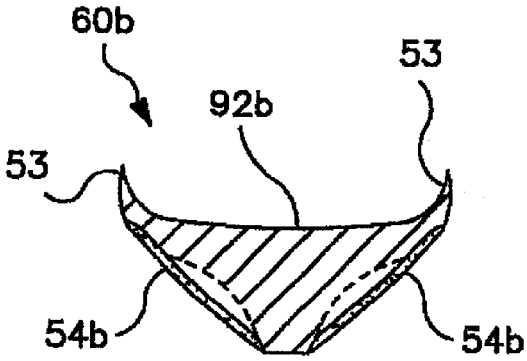
FIGS. 5A–5B are transverse sectional views of a heel area and shank area of another exemplary midsole consistent with the invention.
Figure 5B:
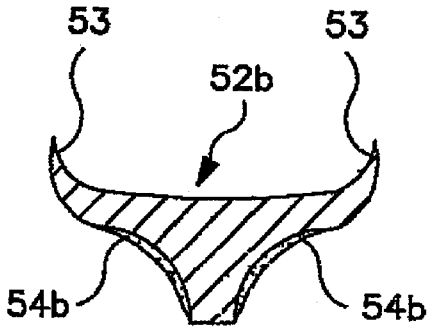

FIGS. 4A–4C illustrate cross-sectional views of an exemplary midsole consistent with the invention. As shown in FIG. 4A, the heel area 60*a* may include a flat or contoured top portion 92*a* and radiused sidewall portions 54*a*. The forefoot area 50*a* may include radiused flat or contoured top 400 and bottom 40*a* surfaces, as illustrated in FIG. 4C, and the shank area 52*a* may include a radiused bottom surface 40*a* and a top surface 402 including a medial sidewall 404 that extends upwardly higher than a lateral sidewall 406 to provide arch support. Exemplary alternative embodiments of a heel 60*b* and shank 52*b* areas are illustrated in FIGS. 5A and 5B, wherein the midsole perimeter walls 53 of the heel in FIG. 5A and the shank in FIG. 5B provide cupping of the wearer's foot, and the bottom side surfaces of the walls 54*b* are inwardly radiused.

Those skilled in the art will recognize that the thickness and shape of the midsole may vary greatly and be modified to accommodate desired function and style. For example, the heel may have a bevel or may be radiused to lessen the impact of the ground reaction forces on the footwear structure during heel strike. The degree of bevel or size of the radius may vary greatly depending on the desired function and style. For example, the heel may include a variety of regular or irregular geometric shapes on the bottom thereof, which may mate with a similar shape in an adjacent element, e.g. an upper, midsole, shank component, reinforcing layer, etc. Also, it is to be understood that the relative thickness of the midsole in the forefoot and heel areas may vary depending on the intended application of the structure. For example, the forefoot area may have greater thickness than the heel area where increased cushioning is desired at the forefoot. Also, the forefoot and heel areas may be of similar thickness.

As shown particularly in FIG. 2, the top or upper surface 58 of the midsole may have a smooth contour which generally matches the bottom contours of a human foot, thereby providing comfort and stability for a user. Thus, the top surface of the midsole may have a slight concavity in the forefoot area 50. From the forefoot area to the heel area 60, the perimeter 90 of the midsole gradually increases relative to the center 92 in order to provide support and stability to a wearer's foot. The perimeter 90 may, however, extend above the center 92 of the midsole around all or part of periphery of the midsole in a continuous or discontinuous fashion. For example, in the exemplary embodiment illustrated in FIG. 6, the perimeter wall 602 of the midsole 600 extends around the entire periphery to provide full cupping of a wearer's foot. The height of the perimeter wall may vary. The perimeter wall cups the foot and provides a better fit thereby reducing foot movement in the footwear which reduces heat in the footwear as movement creates friction which creates heat. The perimeter wall may extend upward and form an integral heel counter in the heel area of the midsole and/or an integral toe cap in the toe area of the midsole. A separate heel counter component and toe cap component may also be removably or non-removably secured to the midsole. The midsole perimeter cupping walls may be formed of a distinctly different material than the rest of the midsole. For example, the perimeter cupping walls could be formed of a relatively soft cushioning material or a conformable material that adapts to the contours of the wearers foot or a firmer material that provides stability and support to the foot.

Figure 6:
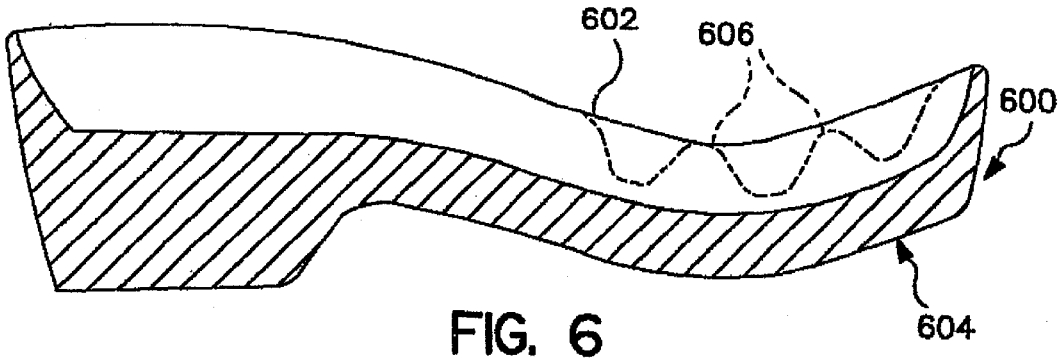
FIG. 6 is a longitudinal sectional view of an exemplary midsole consistent with the invention.
Figure 7:
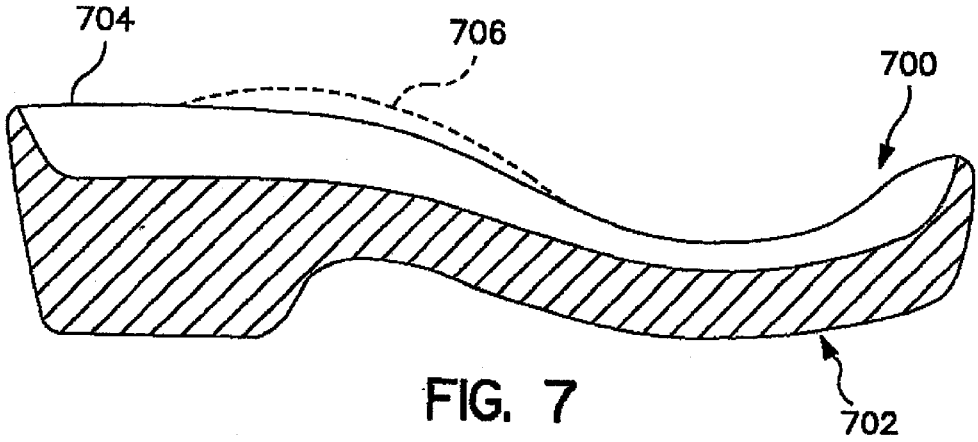
FIG. 7 is a longitudinal sectional view of another exemplary midsole consistent with the invention.

To provide flexibility in the forefoot area 604 of an embodiment such as that illustrated in FIG. 6, flex notches 606 may be provided in the forefoot area as shown. Another alternative is illustrated in FIG. 7, wherein the perimeter wall 704 extends fully around the midsole 700, but is lower in the forefoot area 702 to provide flex. In one embodiment, the wall 704 may be higher on the medial side of the midsole, as indicated by dashed line 706, to provide arch support. A wide variety of additional perimeter wall variations are possible.

Advantageously, the midsole top surface can be designed to generally follow standard foot contours, or custom designed or contoured for a specific user. The midsole according to the present invention can, therefore, eliminate the need for a separate orthotic insert since contours that would be provided by an orthotic may be formed into the midsole.

In one embodiment, the midsole tapers in thickness from about 0.375" at the toe to about 0.75" at the ball to provide toe spring. The midsole is about 1.25" in thickness at the center of the heel area to provide heel lift. The perimeter 90 extends about 0.75" above the center 92 of the heel area, and the cushioning pads 44 and channels 42 are about 0.125" in depth relative to the bottom surface. The thru holes are about 0.0625" in diameter. Obviously, however, the dimensions set forth above are for but one embodiment of a structure consistent with the invention and may be changed based on desired comfort level, intended use, cost concerns, etc.

Figure 8:
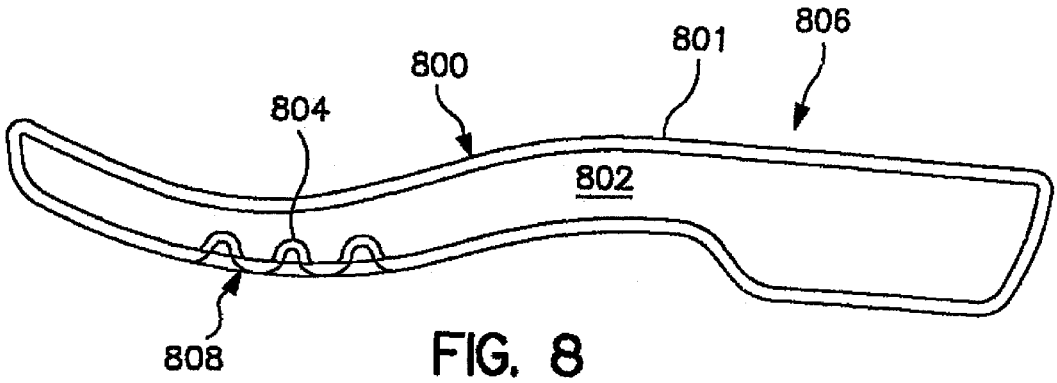
FIG. 8 is a longitudinal sectional view of an exemplary midsole consistent with the invention with an outer wall defining an inner cavity.

A midsole consistent with the invention may thus be provided in a variety of configurations. For example, in FIG. 8, there is illustrated an exemplary embodiment wherein the midsole 806 includes an exterior wall 800 that defines an internal cavity 802. The external wall 800 may be formed in one piece by blow molding or rotational molding. The external wall may also be formed by joining multiple separate parts. The multiple separate parts may be thermoformed, injection molded, etc. The external wall may also be formed by securing two or more wall pieces together, e.g. by RF heat sealing or welding of urethane or other films. The footbed surface 801 may be provided with anatomical contours and/or cupping walls. Flex grooves 804 may be molded into the forefoot area 808 at the bottom of the midsole, as shown, to allow flexing of the forefoot. Air channels may be molded into the bottom and around the sidewall. Advantageously, the interior cavity 802 defined by the walls may be inflated with a fluid such as a gel, or a gas. Multiple chambers may be provided within the internal cavity, and each of the chambers may be separately inflated. The resulting structure would be lightweight and could be inflated to provide a wide range of cushioning characteristics.

Figure 9:
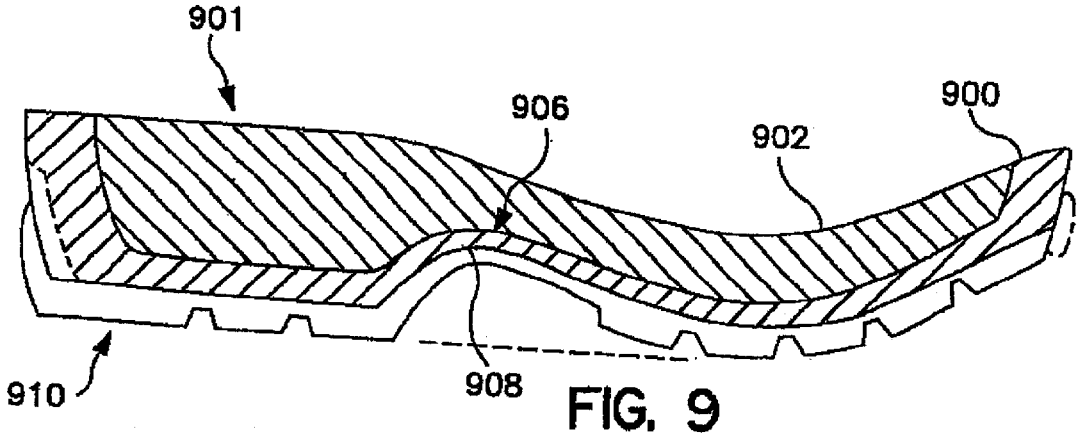
FIG. 9 is a longitudinal sectional view of a portion of a structure consistent with the invention wherein the midsole includes upper and lower portions.

The midsole may also be formed in multiple separate parts. In FIG. 9 for example, there is shown an exemplary embodiment wherein the midsole 904 includes an outer shell portion 900 and an inner portion 902. The outer shell and/or inner portion may be removable from each other or the structure, or either may be fixed in the structure. Both the outer shell and inner portion include shank interlock areas 908, 906, respectively, to allow interlocking of the inner portion and outer portion and to allow interlocking of the outer shell with other elements in a footwear structure, e.g.

the outsole 910, upper, shank component, etc. The inner portion may be received entirely within the outer portion or may extend upwardly from the sidewalls of the outer portion and have portions that rest on the top surface of the outer portion. The inner portion may also extend beyond the bottom of the outer portion through an opening or openings in the bottom portion. Anatomical contours may be provided on the footbed surface of the inner portion and/or on the footbed surface of the outer portion.

Advantageously, the outer shell portion 900 may be formed of a relatively firm material compared to the inner portion. The inner portion 902 may be homogenously formed from a cushioning material, or may configured as a fluid, gas, or gel filled bladder or series of bladders. The inner portion 902 may also be configured to include conventional orthopedic or prescription components, or a conventional cooling or warming pack, e.g. for therapeutic applications or cold or warm weather applications. The inner portion may include other components such as electronic components, survival information or components, keys, etc. Areas of differing firmness may also be provided in the inner portion for particular functions such as anti-pronation, anti-supination, etc. Conventional orthopedic or prescription components, or a conventional cooling or warming pack, e.g. for therapeutic applications or cold or warm weather applications, electronic components, survival information or components, keys, etc. may be included within any midsole of this invention. Some of the ways that these items may be incorporated into the midsoles may be in the form of separate or molded-in compartments or inserts, or integrated within midsole layers.

Figure 10:
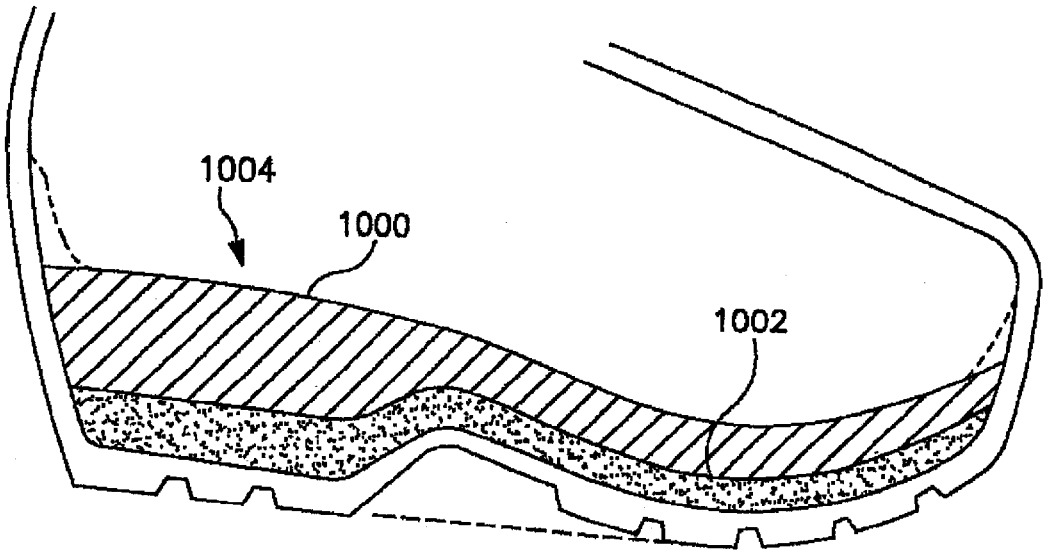
FIG. 10 is a longitudinal sectional view of a portion of a structure consistent with the invention wherein the midsole includes top and bottom portions.
Figure 11:
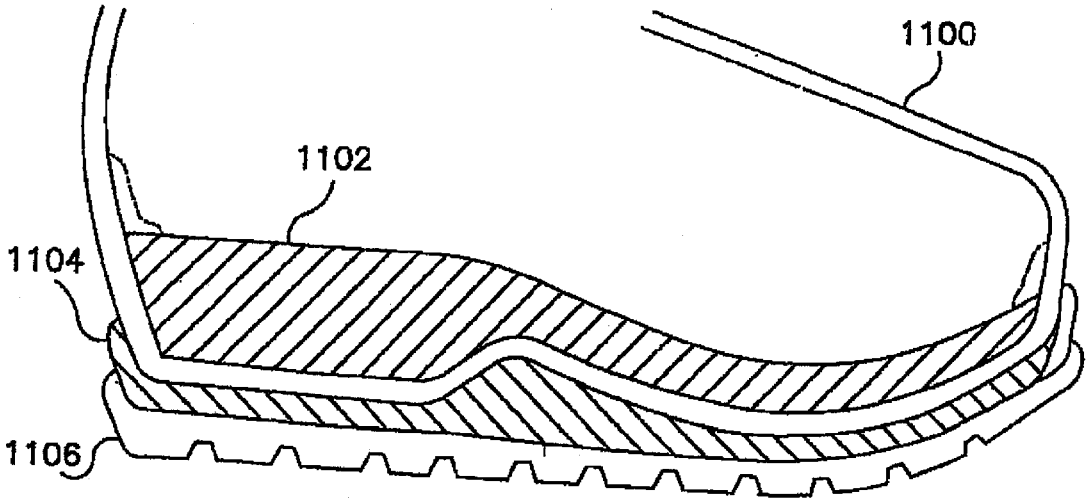
FIG. 11 is a longitudinal sectional view of a portion of another exemplary structure consistent with the invention wherein an upper is disposed between top and bottom portions of a midsole consistent with the invention.

Another exemplary configuration is illustrated in FIG. 10, wherein the midsole 1004 includes separate upper 1000 and lower 1002 portions. As shown, the upper portion may be disposed on top of the lower portion with mating shank interlock areas. The upper and/or lower portions may be removable from the structure, or either may be permanently secured thereto. Elements of the footwear structure may be disposed between the upper and lower portions. In FIG. 11, for example, an upper 1100 (molded or non-molded) may extend between upper 1102 and lower 1104 midsole portions, with shank interlock areas of the upper midsole portion, the upper, and the lower midsole portion in mating/interlocking orientation. In the illustrated embodiment, no shank interlock is provided in the outsole 1106, although it could be provided if a defined heel was desired in the outsole. As with the embodiment illustrated in FIG. 10, the upper and lower portions may be formed of different materials to provide cushioning or support as desired.

Figure 12:
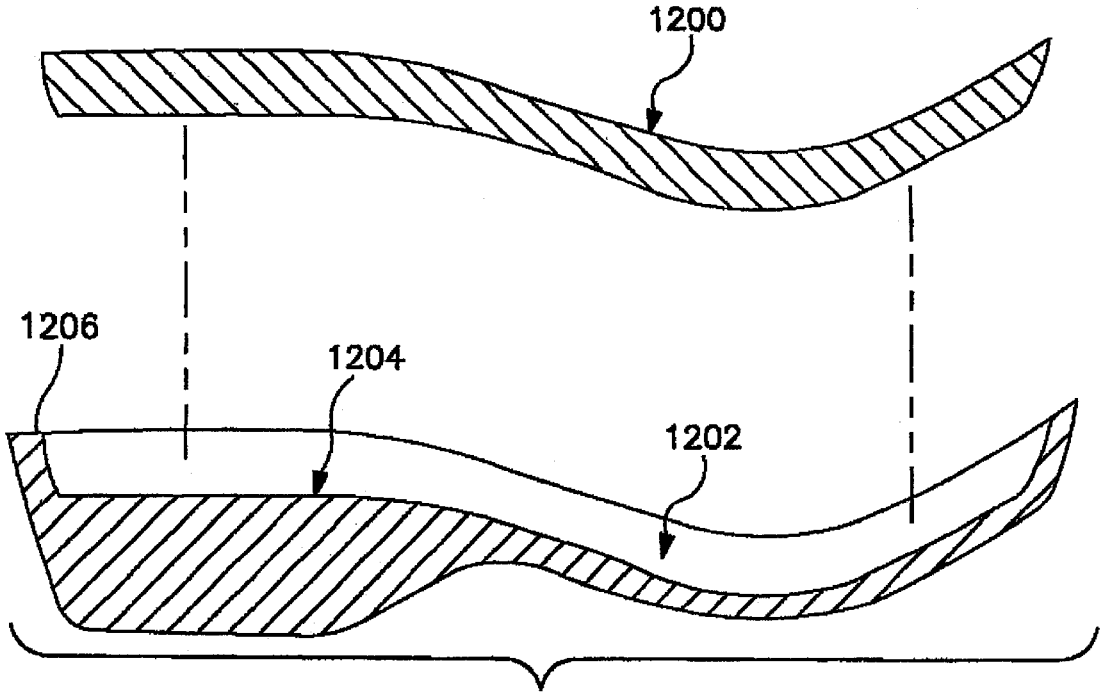
FIG. 12 is a longitudinal sectional view of an exemplary midsole consistent with the invention wherein the midsole includes a bottom portion and an insert.
Figure 13:
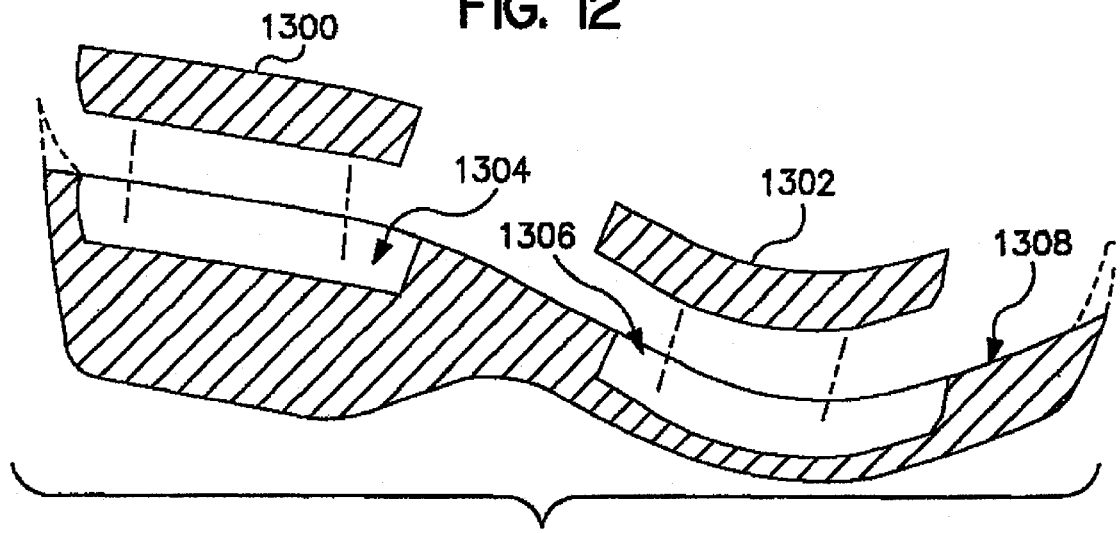
FIG. 13 is a longitudinal sectional view of a midsole consistent with the invention wherein the midsole includes a bottom portion and heel and forefoot inserts.

As illustrated in FIGS. 12–13, a midsole consistent with the invention may also include a base portion that defines the bottom of the midsole and at least a portion of the top surface of the midsole and a non-interlocking insert portion that does not include a shank interlock that mates with the shank interlock in the base portion. In FIG. 12, for example, the non-interlocking insert 1200 may be removably or non-removably disposed in an associated receptacle 1202 in the base portion 1204 defined by the upwardly extending side walls 1206 of the base portion. The insert may be removably secured to the receptacle by for example VELCRO brand hook and loop fasteners. Other midsole layers consistent with the invention may also be secured to adjacent layers in this manner.

In FIG. 13, multiple non-interlocking inserts, e.g., a forefoot insert 1300 and a heel insert 1302, are received in separate associated receptacles 1304, 1306 in the base portion 1308. Differences in the materials between the base portion and the inserts can provide desired cushioning and/or support features. Also, those skilled in the art will recognize, that any number of non-interlocking inserts may be provided in the midsole, and the inserts may be positioned at any location, e.g., heel, shank, and forefoot areas, or combination of locations.

Figure 14:
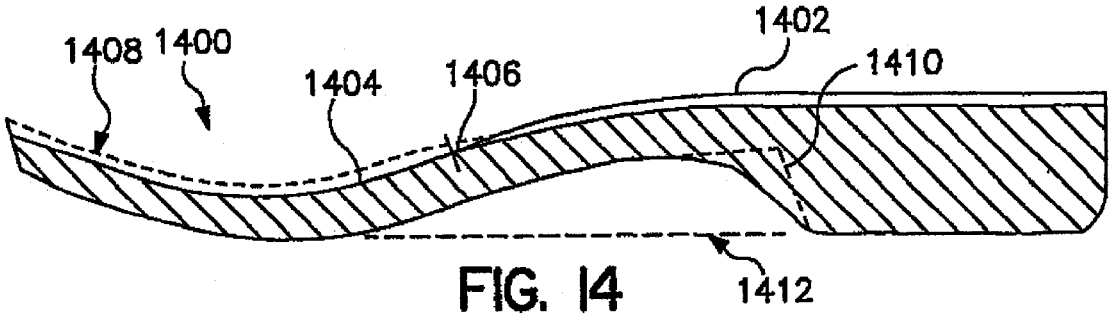
FIG. 14 is a longitudinal sectional view of a midsole consistent with the invention wherein the midsole comprises multiple layers.

Yet another advantageous feature of a midsole consistent with the present invention is that it may be constructed with layers of varying rigidity/cushioning characteristics. Each layer may be formed homogeneously from a rigid, semi-rigid, or cushioning material or may be constructed from fluid, such as a gel, or gas-filled bladders. The layers may also include insulating materials. In FIG. 14, for example, there is illustrated an exemplary embodiment 1400 wherein a rigid or semi-rigid layer 1402 is disposed on a top surface 1404 of a relatively softer or cushioning layer to define at least a portion of the midsole footbed. As shown, the rigid layer 1402 may extend along a portion of the top surface, e.g., about three-quarters of the length of the midsole from the heel to a point 1406 at approximately the ball of the foot, or along the entire length of the top surface as indicated by dashed line 1408.

As with all the exemplary illustrated embodiments provided herein, the shape and dimension of the midsole 1400 illustrated in FIG. 14 is provided only by way of illustration, and not of limitation. For example, the illustrated midsole can be provided with a variety of contours, with non-interlocking inserts, flex notches, flex grooves, air channels, etc. with an abrupt heel as indicated by dashed line 1410 and described in more detail below. In addition, it will be recognized by those skilled in the art that various features of a midsole consistent with the invention have utility outside of removable or interlocking embodiments, and may be incorporated into midsoles having conventional bottom surfaces, as indicated, for example, by dashed line 1412.

Figure 15:
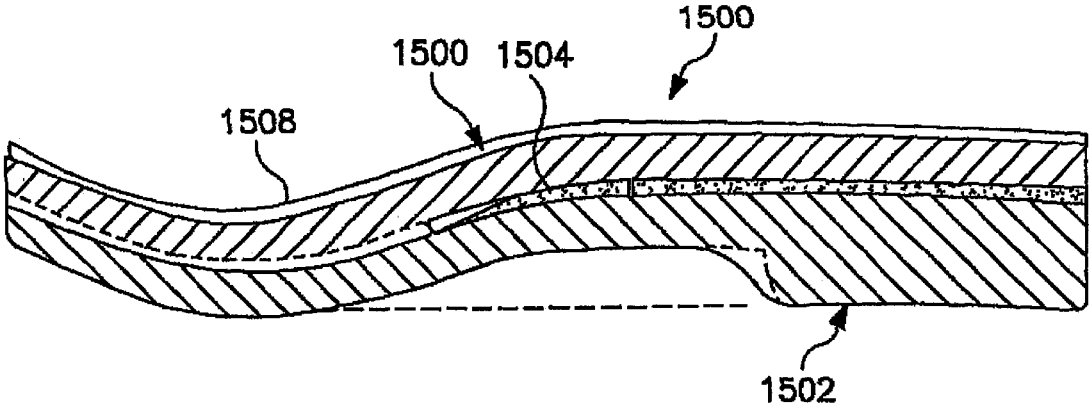
FIG. 15 is a longitudinal sectional view of another midsole consistent with the invention wherein the midsole includes multiple layers.

In FIG. 15, there is illustrated another exemplary midsole embodiment 1500 wherein the midsole includes a bottom cushioning layer 1502, a middle semi-rigid or rigid shock diffusion layer 1504 disposed on the top of the bottom layer, and a cushioning layer 1506 disposed on top of the semi-rigid shock diffusion layer. Anatomical footbed contours, perimeter cupping walls, and/or one or more top covering layers 1508 may be provided on top of the top layer, as is the case with any midsole embodiment consistent with the invention. The semi-rigid layer 1504 may extend along a portion of the length of the midsole, or along the entire length of the midsole, as indicated by dashed line 1510. The individual layers may be permanently secured to one another, or may be removable from one another to allow tuning of the midsole cushioning/support characteristics through selection of the properties and/or dimensions of the individual layers.

Advantageously, layering of the midsole also allows for selection of the features of the individual layers to achieve desired functional or stylistic characteristics. Also, midsole layering may be used to vary the midsole size. For example, a midsole for a "D" width structure may be converted to a midsole for an "E" width structure by removing a ⅛" thick layer or ⅛" of material from a layer. The removal of thickness from the midsole increases the foot volume portion of the cavity in the upper. Alternatively, adding material thickness to a layer or adding a layer of thickness decreases the foot volume portion of the cavity in the upper that creates a smaller size. For example, adding a ⅛" layer may convert a midsole with a "D" width structure to a midsole for a "C" width structure. Length and width adjustments may also be achieved by removing layers of material to change the perimeter wall height and thickness. Removing material from the inside foot interfacing portion of the perimeter wall increases the foot volume cavity in the upper and adding material to the foot interfacing portion of the perimeter wall decreases the foot volume cavity in the upper. This feature is advantageous in the construction of footwear structures wherein midsoles of varying size are desired, e.g., in connection with a stretch upper configuration described herein below, or in a shoe or boot of a particular size.

Figure 16:
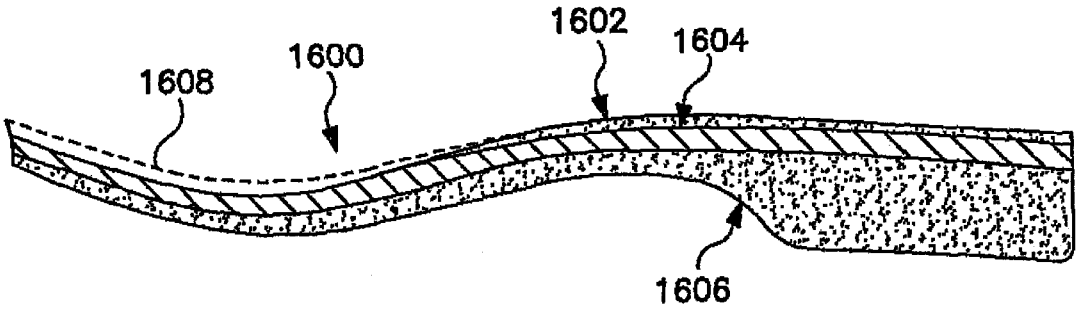
FIG. 16 is a longitudinal sectional view of yet another multi-layered midsole consistent with the invention.
Figure 17:
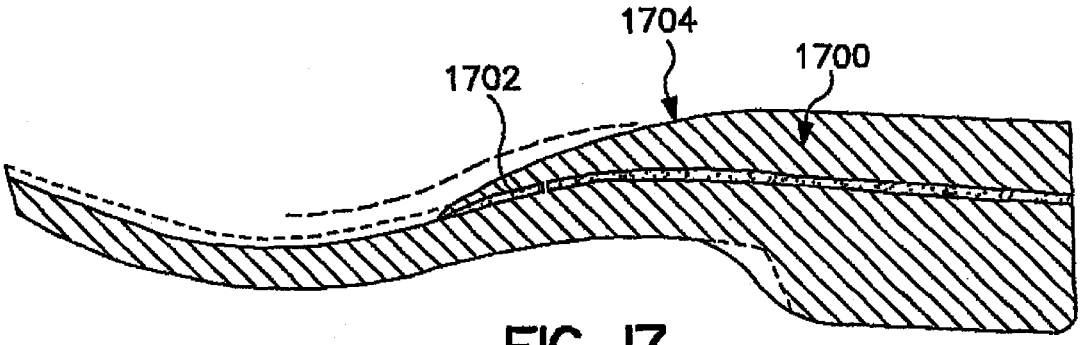
FIG. 17 is a longitudinal sectional view of a midsole consistent with the invention wherein a top layer includes an orthotic.
Figure 19:
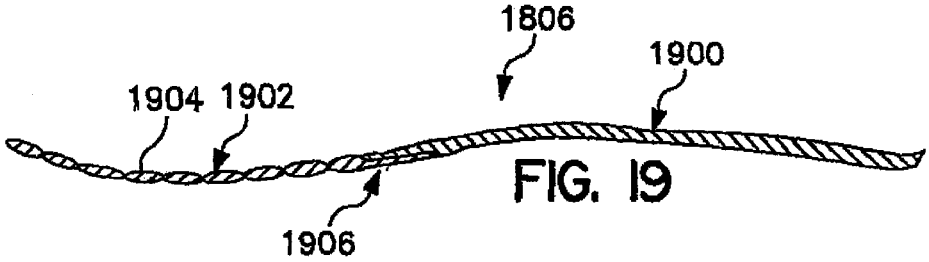
FIG. 19 is a longitudinal sectional view of the shock diffusion layer illustrated in FIG. 18.
Figure 18:
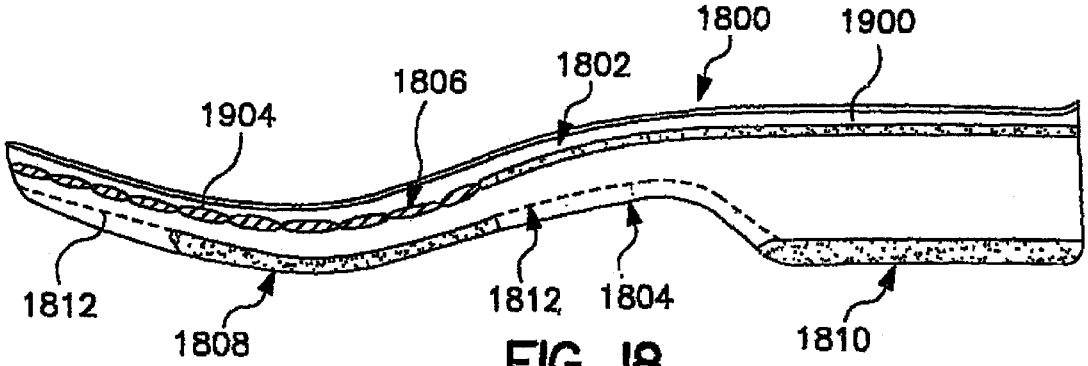
FIG. 18 is a longitudinal sectional view of yet another multi-layered midsole configuration consistent with the invention wherein an inner layer is a shock diffusion layer.

Another exemplary layered embodiment is illustrated in FIG. 16, wherein a midsole 1600 is provided with a top semi-rigid or rigid layer 1602, a middle layer 1604 that is less rigid than the top layer, and a bottom cushioning layer 1606 that is less rigid than the middle layer. The top rigid layer 1602 may extend only partially along the midsole or could extend along the entire length as indicated by dashed line 1608. By providing the layers as removable separate layers, the cushioning features of the layers may be modified or interchanged as desired. For example, the top layer could be provided as a cushioning layer, and the bottom layer could be provided as a rigid layer. Alternatively, the top layer 1700 may be provided in the form of an orthotic and the middle layer 1702 may include a cupping wall 1704 in which the orthotic is received and stabilized, as illustrated for example in FIG. 17. The middle layer 1702 may be provided in the form of relatively soft cushioning materials or semi-rigid or rigid materials. In the illustrated embodiment, the orthotic extends along only a portion of the midsole, but it could be configured in a full-length embodiment. Of course, the individual layers may also be secured together, e.g. using an adhesive, to prevent removal and/or replacement FIG. 18 illustrates another exemplary embodiment 1800 of a layered midsole wherein the middle layer includes a shock diffusion plate. In this embodiment, the top 1802 and bottom 1804 layers may be relatively soft cushioning layers, whereas the middle layer 1806 is a relatively rigid/semi-rigid plate for providing reduced pressure under a foot, i.e., shock diffusion. As shown in FIG. 19, the plate 1806 may include a first planar portion 1900 extending about three-quarters of the length of the midsole 1800 from the heel to the forefoot and a forefoot portion 1902 including a plurality of pressure distribution bars 1904. The forefoot portion 1902 may be constructed as a separate portion that is joined to the planar portion at a lap joint 1906. The pressure distribution bars 1904 are joined together, and may extend laterally across the entire forefoot area. Advantageously, the pressure distribution bars allow the flexing of the forefoot while providing a rigid/semi-rigid layer for shock diffusion. Full or partial perimeter side cupping walls and stabilizing fins (not shown) may also be provided on the plate for stabilizing the layers thereabove.

As shown, separate relatively soft shock absorption plates 1808, 1810 may also be provided on the bottom of the bottom portion in the forefoot and heel areas. The plates may be constructed from a variety of materials including foam, or fluid (e.g. gel) or gas filled chambers. In one embodiment, the heel plate 1810 may be configured to provide increased shock absorption at the lateral heel strike area while allowing full support and anti-pronation characteristics at the medial heel strike area. In the illustrated embodiment, the plates are shown having consistent thickness throughout their length. It is to be understood, however, that the thickness of the plates may vary depending on the desired shock absorption and support characteristics. The separate heel plates 1808, 1810 may also be replaced by a full-length plate as indicated by the dashed line 1812, and may be contained within the midsole.

Figure 22:
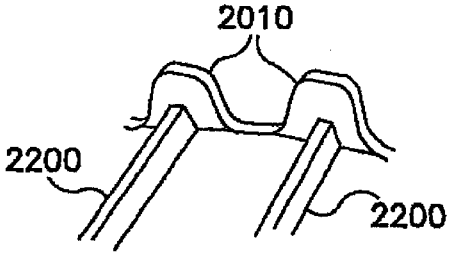
FIG. 22 is a perspective view of a portion of the fins and ribs for a shank-stabilizing component as illustrated, for example, in FIG. 20.
Figure 21:
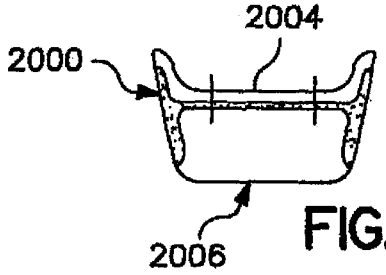
FIG. 21 is a transverse sectional view of the midsole illustrated in FIG. 20 taken at the heel area.
Figure 20:
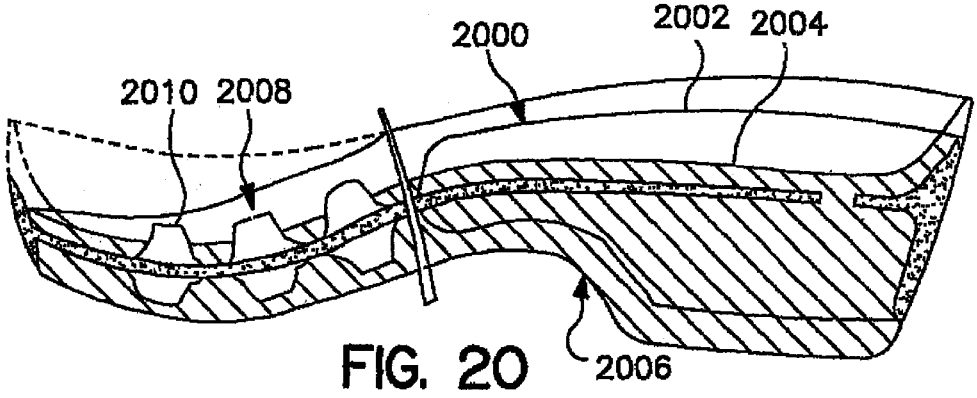
FIG. 20 is a longitudinal sectional view of a midsole consistent with the invention wherein a layer of the midsole is provided in the form of a stabilizing component.

Turning to FIGS. 20–22, a middle midsole layer may also be provided in the form of a rigid/semi-rigid stabilizing component 2000. As shown in FIG. 20 and in cross-sectional view in FIG. 21, the stabilizing component may have a heel and shank portion with perimeter walls 2002 extending upward against the top layer 2004 and downward against the midsole bottom layer 2206. In an alternative embodiment, the fins may extend only upward in one area and only downward in another area. The stabilizing component 2000 may also include a forefoot portion 2008 having stabilizing fins 2010 that extend upward against the top layer 2004 and downward against the bottom layer 2006. Fins 2010 on opposite sides of the midsole may be interconnected by bars 2200 that extend across the forefoot to provide stability between the bars and fins, as illustrated particularly in FIG. 22. The bars could also extend across any portion of the stabilizing component depending on the intended function. The bars may be positioned on the top and/or bottom surface of the stabilizing components. The height and thickness of the bars may vary greatly depending on the application. The thickness and heights of the entire stabilizing component can be adjusted to suit a particular application/function. In another embodiment just the bars extending across the part may be incorporated in the stabilizing component. The area between the fins and bars allows flexibility. The flexibility in this area may be further increased by the addition of flex grooves in the stabilizing component. Advantageously, the stabilizing component allows flexibility of the forefoot area while providing stabilization of the top layer 2004 relative to the bottom layer 2006.

Figure 23:
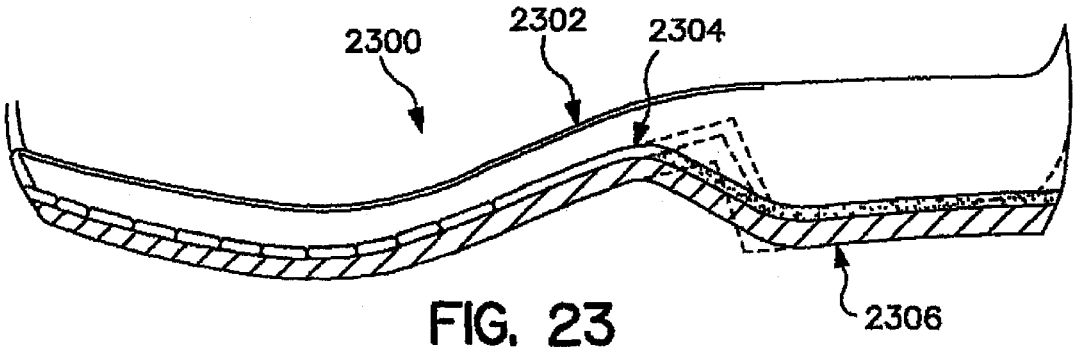
FIG. 23 is a longitudinal sectional view of a midsole consistent with the invention wherein multiple layers include shank interlock portions.

Each midsole layer may be integrally formed as a unitary structure or may include multiple separate components. Also, one or more of the separate midsole layers may also be provided with shank interlock portions to provide interlocking layers relative to other layers. In FIG. 23, for example, there is illustrated a midsole 2300 including a top cushioning layer 2302 having a shank interlock area, a shock diffusion plate 2304, e.g. constructed as illustrated in FIG. 19, including a shank interlock area, and a bottom cushioning layer 2306 that is softer than the top layer. The shank interlock areas of the top, middle, and bottom layers interlock to resist relative motion therebetween.

Figure 24:
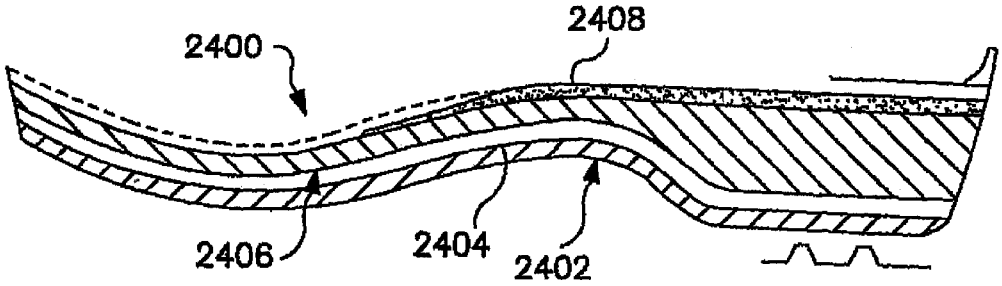
FIG. 24 is a longitudinal sectional view of yet another multi-layered configuration consistent with the invention.

FIG. 24 illustrates another exemplary midsole embodiment 2400 including multiple interlocking layers. As with the other embodiments illustrated herein, the layers of the midsole 2400 may be increasingly rigid from the top or footbed surface of the midsole to the bottom of the midsole. Also, any number of layers may be provided. In the illustrated embodiment, a first full-length soft cushioning layer 2402 may be provided at the bottom of the midsole, a second more rigid layer 2404 including a shank interlock may be disposed on the first layer, a third layer 2406 having a shank interlock area and being more rigid than the second layer is disposed on the second layer, and a fourth full-length or partial length (e.g. ¾ length) rigid/semi-rigid layer 2408 being firmer than the third layer may be provided at the top surface. Top covering or cushioning layers, as described above, may be provided on the top midsole layer. The shank interlock areas of the layers may interlock, as shown, to resist relative movement.

Figure 25:
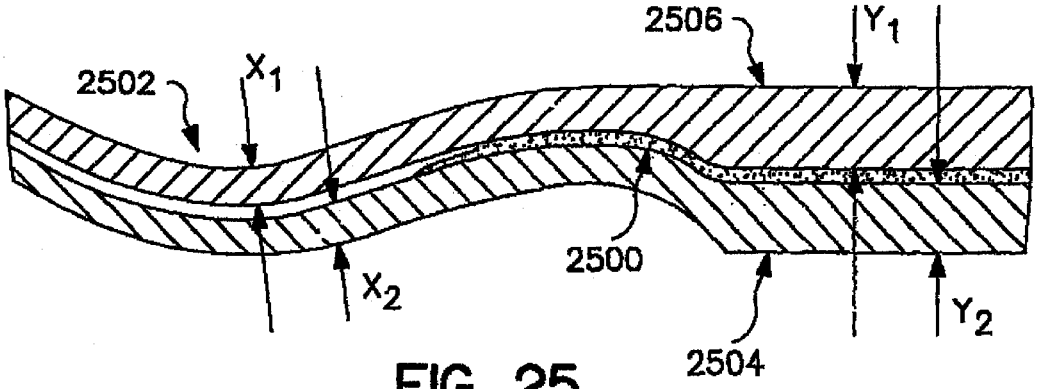
FIG. 25 is a longitudinal sectional view of a midsole consistent with the invention wherein top and bottom layers have substantially equal thickness at the forefoot and heel areas.

In yet another exemplary embodiment 2502 illustrated in FIG. 25, a middle full or partial length semi-rigid or rigid shock diffusion element/layer 2500 may be disposed between top 2506 and bottom 2504 cushioning elements. As shown, all the layers may include interlock portions. Also, the middle layer may separate the top 2506 and bottom 2504 layers so that the thickness X1 of the top layer and the thickness X2 of the bottom layer in the forefoot area are substantially equal, and the thickness Y1 of the top layer and the thickness Y2 of the bottom layer in the heel area are substantially equal.

Those skilled in the art will recognize a variety of advantages to a midsole embodiment consistent with the invention. In a removable midsole configuration, a structure consistent with the invention provides extra depth to accommodate various features used in prescription and orthopedic footwear, e.g. to fit in arch supports or orthotics. Also, the midsole may be molded to provide a custom footbed or orthotic. For example, a posted heel may be provided. Also, a midsole consistent with the invention, particularly a multilayered midsole facilitates canting and shimming to meet desired functionality. Shims can include shank interlock areas for resisting motion of the shims relative to the structure. A midsole consistent with the invention may also be configured to include a receptacle and inserts which may be removed to treat foot disorders and/or relieve pressure.

In addition to the prescription and orthopedic footwear mentioned above midsole canting and shimming features may be used in many different footwear applications such as ski boots, snowboard boots, inline skates, etc. any application where this type of tuning/adjustability is desired for improved fitting, improved function, and/or corrective treatment/positioning of the foot.

Referring now to FIG. 26, an elevational section taken substantially along line 3—3 of FIG. 1 is shown. FIG. 26 particularly illustrates the shank interlock portion 52 of midsole insert 10 and the mating interlock portion 24 of outsole 14. Although the length of the shank interlock area may vary depending on the design application, in the illustrated embodiment, both the bottom surface 40 in the shank interlock portion 52 of the midsole and the top interior surface 18 in the mating shank interlock portion 24 of the outsole project upwardly with an arc-like geometry running longitudinally from the end of the forefoot portion at point 24*a* to the beginning of the heel portion at point 24*b*. Within this area, the upper surface 18 of the outsole and the bottom surface 40 of the midsole extend upward from the forefoot at about point 24*a* to approximately the middle of the shank area at point 25, and then downward to the heel to about point 24*b*. This structural design allows for a positive interlock between shank interlock areas of the midsole insert 10 and the outsole 14 that resists motion of the midsole relative to the outsole 14 when the structure is in use. Advantageously, therefore, the midsole need not be permanently secured within the structure, thereby allowing removal and replacement.

Furthermore, in the case where an upper is secured to the outsole in the structure, the unique arched geometry of the interlock areas allows use of an upper 30 having a corresponding arched shank area 100 in its bottom surface 32. Advantageously, the gradual arch of the upper bottom surface 32 allows for traditional methods of lasting, e.g. slip lasting or cement lasting, for construction of the upper. Preferably, however, slip lasting is used to stitch a bottom portion of the upper to a separate top portion.

Figure 26A:
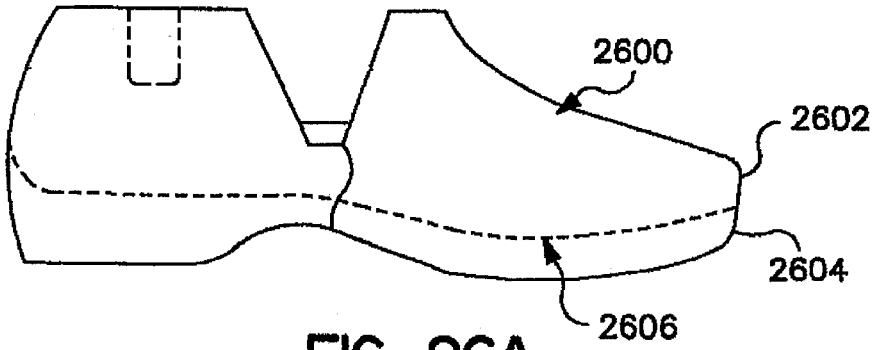
FIG. 26A is a side view of an exemplary last useful in connection with an exemplary method of constructing a footwear structure consistent with the invention.

With reference to FIG. 26A, for example, a last 2600 including a foot volume portion 2602 and a midsole volume portion 2604 having an arched shank interlock area, e.g. separated by dashed line 2606, may be used to form an upper having an arched shank interlock. Of course, where other elements such as a sock liner, bootie, shank component, or reinforcing layer are provided in the construction the last will also include volumes to account for such elements. The upper is disposed on the last 2600, and an outsole having an arched shank interlock is positioned on the upper with the interlock areas of the outsole and last in mating relationship. The last 2600 is then removed to leave a cavity in the upper having a foot volume portion and a midsole volume portion. The midsole may be positioned in the midsole volume portion of the cavity. Those skilled in the art will recognize that a last 2600 consistent with the invention may also be used to build a molded structure consistent with the invention wherein the upper and outsole are integrally formed as a unitary component of the structure. Without the gradual arching of the shank interlock areas of the midsole and outsole, abrupt changes would be required in the bottom surface of the upper. Abruptly changing interlock portions may be constructed in a manner to be described below. Such abrupt changes, however, generally require use of either molded components or inefficient, non-traditional methods of lasting, which complicate the manufacturing process and increase the manufacturing cost. Thus, to maintain a favorable cost of manufacture it may be beneficial for the shape of the interlock areas of the midsole and outsole to change in a gradual manner with radiused transitions at the forefoot and heel. (In an embodiment having an abrupt shank interlock the midsole volume portion of the last has an abrupt shank interlock area used to form an upper having an arched shank interlock.

Figure 27:
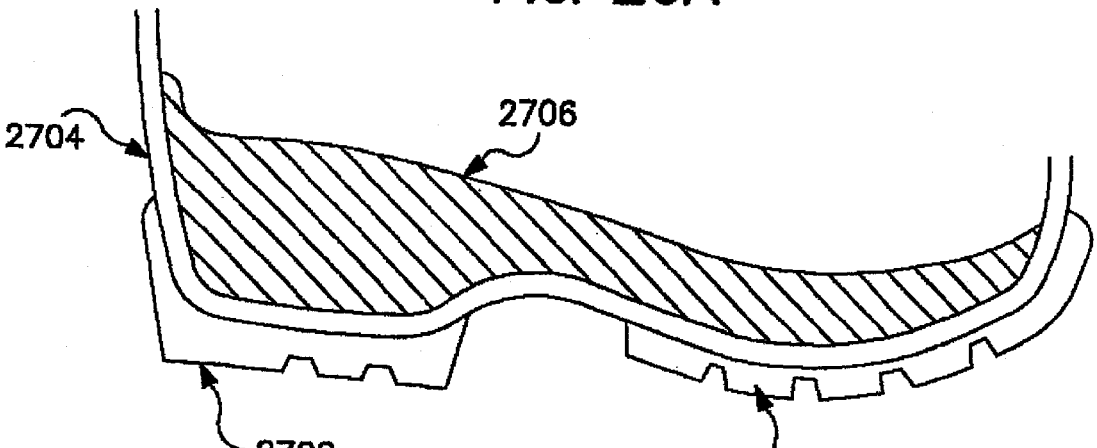
FIG. 27 is a longitudinal sectional view of a portion of a structure consistent with the invention wherein an outsole is provided in first and second distinct parts.

In one embodiment, the distance d between the plane of points 24*a* and 24*b* to point 25 is about 0.625" where the total length of the outsole is about 11.5". It is to be understood, however, that the distance d can vary greatly with the shoe size and the intended application. Thus, any arching shank interlock portions formed in the top surface of the outsole and bottom surface of the midsole will suffice as long as a mating interlock between the midsole and the outsole is achieved which resists motion of the midsole relative to the outsole when the structure is in use. A footwear structure consistent with the invention may also be constructed with an outsole provided in separate or modular sections. For example, the outsole may include separate full or partial width forefoot, heel, and shank area components that are secured to an upper. In the embodiment illustrated in FIG. 27, for example, the outsole includes a heel component 2700 and a forefoot component 2702 secured to the upper 2704. In this embodiment, the upper and the midsole 2706 have shank interlock portions which interlock to resist motion of the midsole relative to the outsole, whereas there is no shank interlock portion in the outsole. In another embodiment the midsole may consist of a heel portion only. The midsole heel portion may be removably or non-removably disposed above an upper or outsole structure having shank interlock portions consist with this invention. The interlock is formed between the heel breast surface of the midsole and the heel breast surface of the upper or outsole shank interlock portion. The separate heel portion may be disposed beneath a separate removable footbed component such as a sockliner or orthotic.

Figure 28:
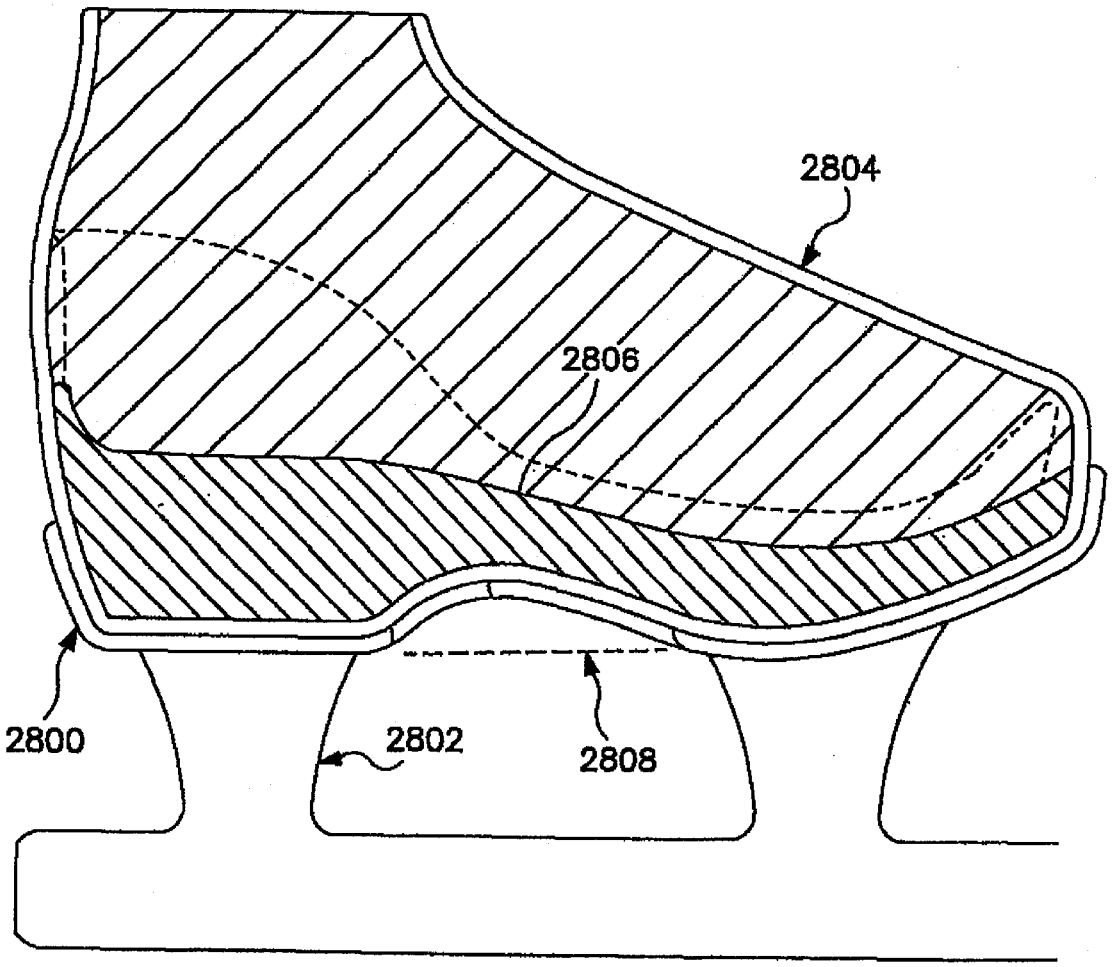
FIG. 28 is a longitudinal sectional view of a structure consistent with the invention with a skate chassis affixed thereto.

Also, in the case of an upper having a shank interlock it is not necessary to provide a shank interlock in the outsole. In an embodiment such as a skate, as shown, for example, in FIG. 28, the outsole may have a base component 2800 and separate or integral skate chassis 2802. In this embodiment, an upper 2804 may be provided, and the upper 2804, the midsole 2806, and the outsole base portion 2800 may have interlocking shank interlock portions. In the illustrated embodiment, it may not be necessary to provide a shank interlock portion in the outsole. Instead the outsole base portion 2800 could be flat, as indicated by dashed line 2808 and interlocking may occur between the molded upper 2804 and the midsole 2806. The outsole base portion may also be separated into multiple parts or have multiple attachment points to the upper 2804.

Figure 29:
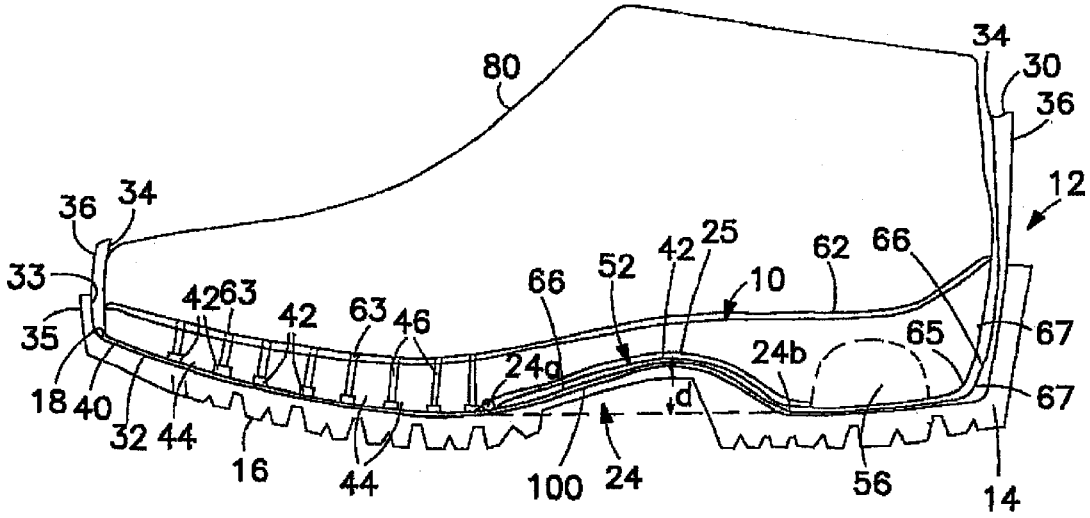
FIG. 29 is a longitudinal section taken substantially along line 26—26 of FIG. 1 and showing a rigid shank insert disposed between a midsole and an outsole according to the present invention.

In order to provide full and comfortable support of the wearer's foot 80, particularly in the midfoot or shank area, a shank component 66 may be provided in any embodiment consistent with the invention, as shown for example in FIG. 29. The shank component may be constructed of traditional rigid or semi-rigid materials, e.g. metal or plastic. The shank component 66 may be formed with a top surface 65 that follows the contour of the bottom surface 40 of the midsole and a bottom surface 67 that follows the contour of the top surface 18 of the outsole. Although in the illustrated embodiment the midsole and outsole are uniformly contoured, it is to be understood that the midsole bottom surface and outsole top surface may be formed with a wide variety of contoured shapes, e.g., radiused, beveled, etc., the shank component, upper, and/or outsole may follow those contours.

Referring back to FIG. 3, shank component 66 may have a projecting perimeter wall in the heel and shank areas to about the point 24*a* that mates with and rests against a recessed lip 57 in the sidewall 54 of the midsole. The thickness of the shank component and any projecting perimeter walls may vary greatly depending on the intended application. The shank component may also include raised ribs, walls, and lattice-like raised wall structural portions that add strength and rigidity to the component. The raised structural details may vary greatly in height and wall thickness depending on the intended application.

Figure 29A:
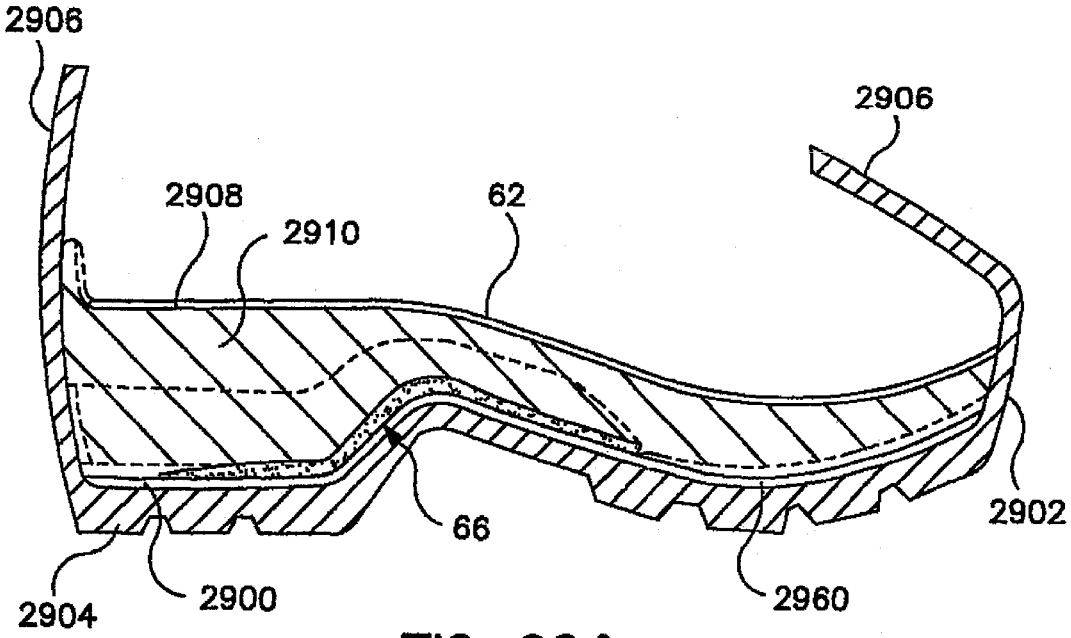
FIG. 29A is a longitudinal sectional view of a portion of a structure consistent with the invention and wherein the structure includes a stabilizing layer and a shank component.

In any construction consistent with the invention, a reinforcing layer 2900 may also be provided, as shown for example in FIG. 29A wherein a molded construction is illustrated. As shown, the outsole 2902 includes a bottom tread portion 2904 and an integral upper portion 2906. The upper portion 2906 may, for example, be defined by the portion of the integral construction extending above the top surface 2908 of the midsole 2910. The reinforcing layer 2900 is a rigid or semi-rigid element that adds structural integrity to the construction, and may be full or partial length. The reinforcing layer may also have full or partial perimeter cupping walls. In an industrial footwear construction, the reinforcing layer or the shank component may be constructed from steel or other puncture resistant material. In the illustrated embodiment, the reinforcing layer 2900 is positioned between the midsole and the outsole, but beneath the shank component 66. In alternative embodiments, the reinforcing layer may be positioned above the shank component, or the reinforcing layer and/or the shank component may be recessed into the midsole or outsole. The shank component may also be embedded within the reinforcing layer.

Figure 31:
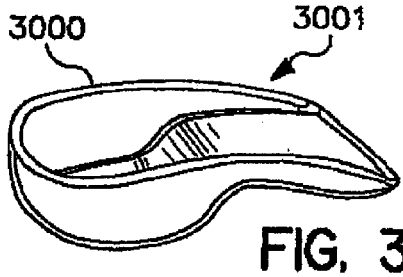
FIG. 31 is a perspective view of the exemplary shank component illustrated in FIG. 30.
Figure 30:
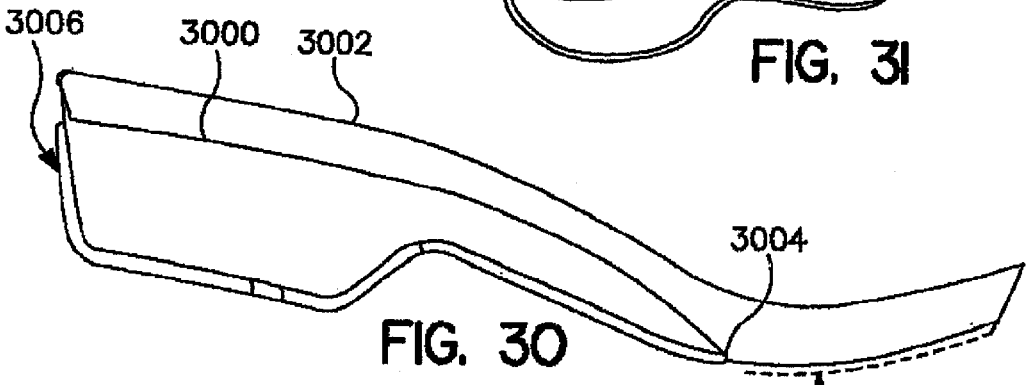
FIG. 30 illustrates a side view of a midsole consistent with the invention with an exemplary shank component consistent with the invention wherein the shank component includes perimeter cupping walls for the midsole.
Figure 32:
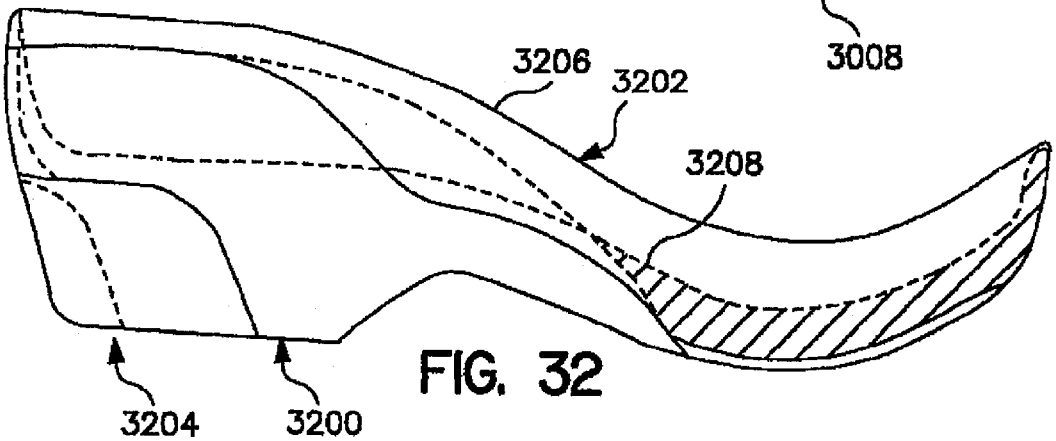
FIG. 32 is a side view of another exemplary shank component consistent with the invention wherein the shank component includes a heel cutout portion.

The shank component perimeter wall provides stability and helps to keep the wearer's foot centered over the footbed. As shown in FIGS. 30 and 31, for example, the perimeter wall 3000 of a shank 3006 may also extend upward in the heel area to provide cupping for the midsole 3002 in the heel and shank interlock areas, while extending to the end of the midsole 3002, as indicated by dashed line 3008, or ending at a point 3004 at approximately the ball of the foot. FIG. 32 illustrates an exemplary shank embodiment 3200, wherein the shank provides cupping for the midsole 3302, but includes an opening 3204 in the heel area to allow for heel cushioning, particularly to allow the midsole to absorb shock during heel strike. As with any shank component described herein, the component may be fixed within the structure, e.g. to the upper, or may have portions which are left unattached. In the embodiment illustrated in FIG. 32, the shank 3200 is combined with a midsole 3202 having perimeter cupping walls 3206 extending upward relative to a midsole top or footbed surface 3208. The perimeter walls of the shank may extend above, below, or be approximately flush with the perimeter wall height of the midsole cupping walls.

Figure 33:
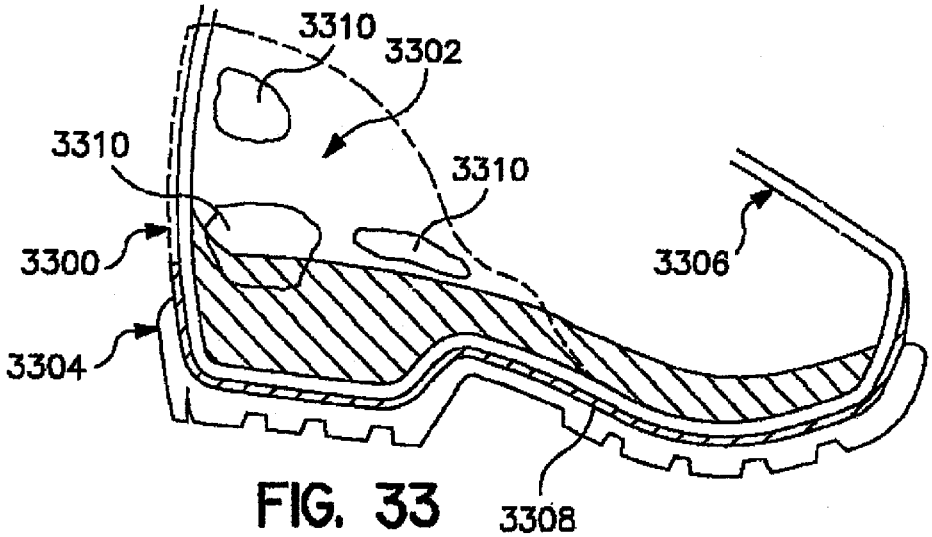
FIG. 33 is a longitudinal sectional view of a portion of a footwear structure consistent with the invention including a shank component having a heel counter portion.

FIG. 33 illustrates an exemplary shank embodiment 3300 including a heel counter portion 3302. As shown, the shank is disposed between the outsole 3304 and an upper 3306 and extends upwardly to at least the heel area relative to a person's foot, and potentially the ankle area or higher, and then downwardly to the beginning of the forefoot area at point 3308. The shank component may be full or partial length. A full-length shank may include an integral heel counter, toe cupping wall, full toe cap, and/or stabilizing fins. The shank component having an integral heel counter and/or integral toe cap may be positioned against a midsole having an integrally formed or removably secured heel counter and/or integrally formed or removably secured toe cap. The heel counter portion 3302 may include windows 3310 formed therein for weight reduction, as shown. Also, a shank with a heel counter portion may be positioned inside a boot construction either fully or partially between a boot lining portion of the boot upper and an outer portion of the boot upper or an outsole. The shank component 3300 may also be used as an external component in any application where significant support is desirable, or as a supportive back piece in a snowboard boot construction. The shank component/supportive back piece may be affixed to the external surface of the upper or it may not be affixed to allow the upper to move independently of the component or it may be removably secured to the upper.

Figure 34:
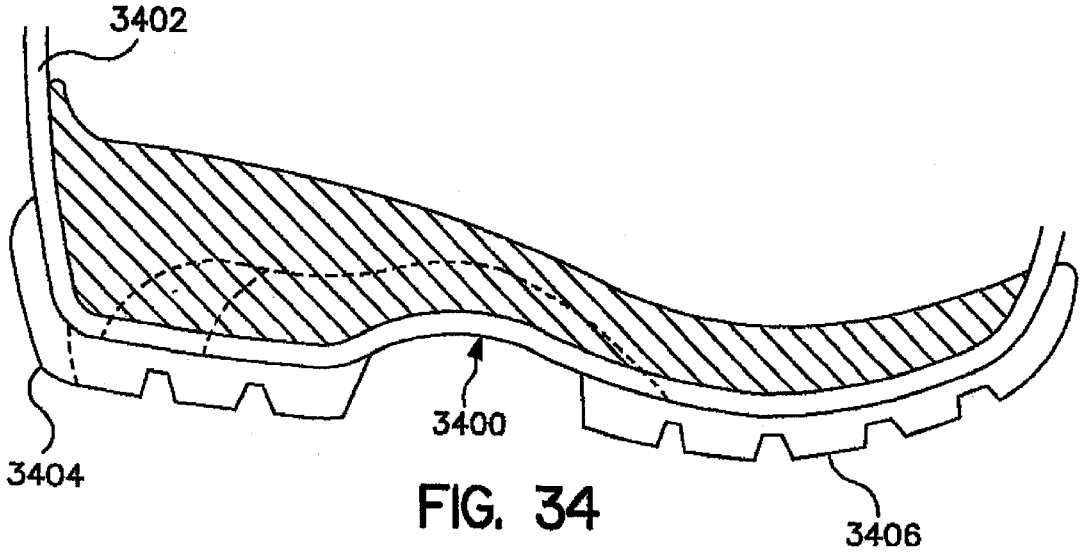
FIG. 34 is a longitudinal sectional view of a portion of a structure consistent with the invention wherein the shank component is disposed at the bottom of the structure between first and second outsole components.

It will be understood by those skilled in the art that the exemplary shank embodiments illustrated herein may be combined with a variety of midsole, outsole, and upper variations, and may be positioned in a variety of locations within the footwear structure, e.g., against the midsole, outsole, or intervening components. A reinforcing layer may also be provided with the shank component in any embodiment, or may be provided in a construction without a shank component. Also, as shown in FIG. 34, the shank component 3400 may be positioned between an upper 3402 and separate sections 3404, 3406 of an outsole, whereby a portion of the shank component is left exposed at the bottom of the structure. The shank component may also have perimeter cupping walls positioned against the exterior surface of the upper that are left exposed.

Figure 35:
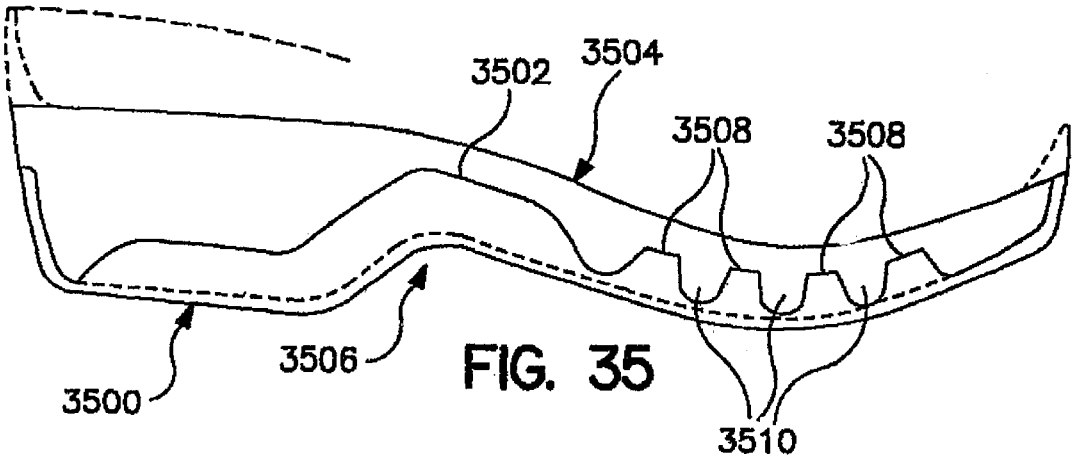
FIG. 35 is a side view of a midsole consistent with the invention combined with a shank component consistent with the invention wherein the shank component is full length and includes flex notches in a forefoot area thereof.
Figure 36A:
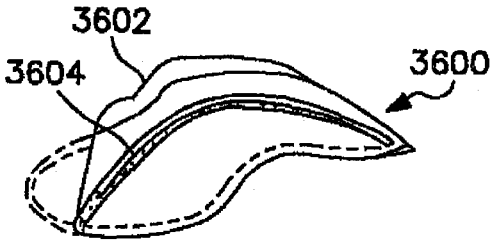
FIG. 36A is a perspective view of the shank component illustrated in FIG. 36.
Figure 36B:
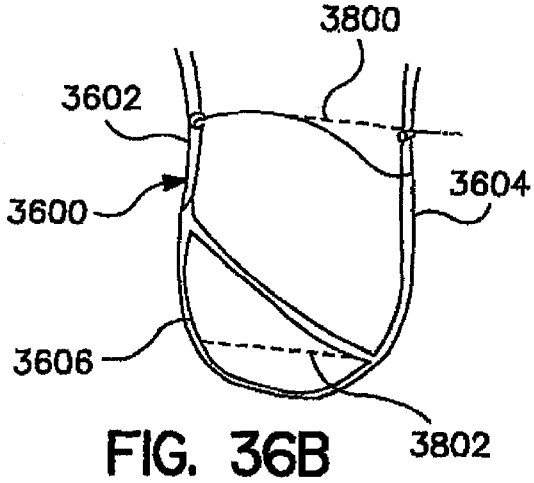
FIG. 36B is a partial bottom view of the midsole and shank component combination illustrated in FIG. 36.
Figure 36:
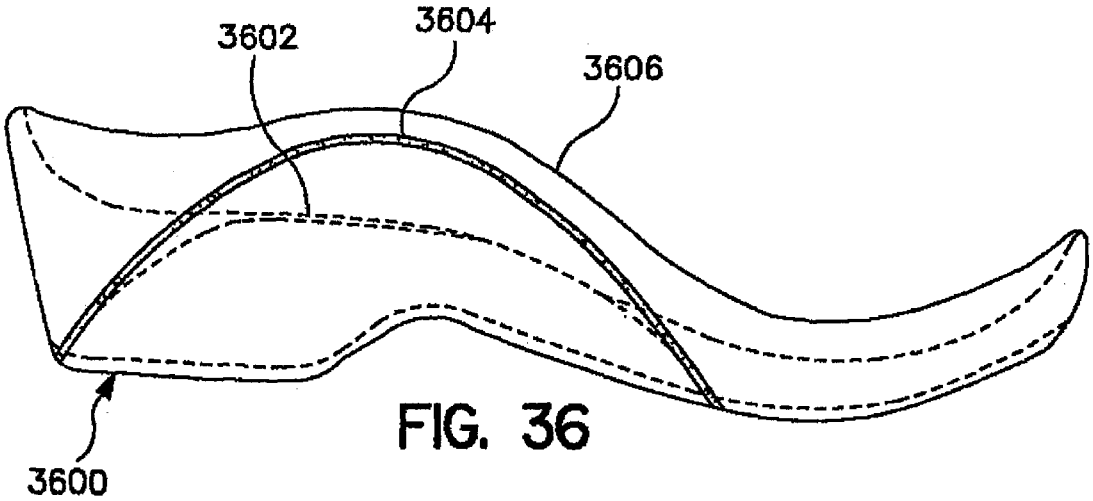
FIG. 36 is a side view of an exemplary midsole and shank component combination consistent with the invention wherein the shank component includes sidewall portions of differing heights at the medial and lateral sides of the midsole.

The dimensions of the shank component and the height and configuration of the perimeter walls may vary depending on desired use and associated support characteristics. In FIG. 35, for example, there is illustrated an exemplary shank 3500 having perimeter cupping walls 3502 for receiving the midsole 3504. In the illustrated embodiment, the walls extend upward from the heel area and over the shank interlock area 3506 of the shank. In the forefoot area, flex notches 3510 are provided between stabilizing fins 3508 to allow flexibility of the shank component at the forefoot. Other exemplary shank configurations are illustrated in FIGS. 36–36B. As shown in FIGS. 36 and 36A, for example, the shank 3600 includes a lateral sidewall 3602 and a medial sidewall 3604 that extends higher than the lateral sidewall and further toward the heel to provide arch support for the midsole 3606 and support against pronation. Alternatively, the lateral sidewall may be higher than the medial sidewall to provide anti-supination support. The lateral sidewall may also extend further toward the heel and forefoot than the medial sidewall to provide anti-supination support. The shank component may be configured with heel and forefoot ends that are angularly positioned relative to the midsole, as shown in FIG. 36B, or with ends that directly transverse the midsole, as indicated by dashed lines 3800,3802. To facilitate heel strike shock absorption of the midsole it is advantageous to angle the heel of the shank component so that the heel strike zone is greater/"favored" towards the lateral side of the heel. The lateral sidewall is advantageously positioned further forward than the medial sidewall as described above. Also, in any embodiment the shank may extend fully or partially along the length and width of the midsole. Again, a shank component consistent with the invention may be positioned in a variety of locations within a footwear structure. The shank may be removable or non-removable from the structure. In one embodiment, for example, the shank component may be attached to the bottom of the midsole by an adhesive or other means to extend from the rear of the midsole to about the ball of the foot. Alternatively, the shank could extend longitudinally and laterally along the entire length and width of the structure, or any portion thereof. Also, the shank component could be secured to, or disposed against, an inner or outer midsole portion, the top surface of the outsole, to the bottom exterior surface of the upper, or a recess in either the outsole or midsole. The shank could also be formed as an integral part of either the outsole or midsole, rather than as a separate component, and could be embedded within the outsole or midsole.

Advantageously, the structure of the shank component allows the shank component to be disposed within the structure without affecting the interlock between structural components, e.g. between the midsole and the outsole. The semi-rigid shank component need not, therefore, be positioned in close proximity to the user's foot as in the prior art where such components would be positioned above a conventional midsole. By providing a shank component that may be positioned beneath the midsole, the present invention provides a structure with significantly improved comfort compared to prior art structures which incorporate shank components, regardless of whether the midsole is removable from the structure.

Figure 37:
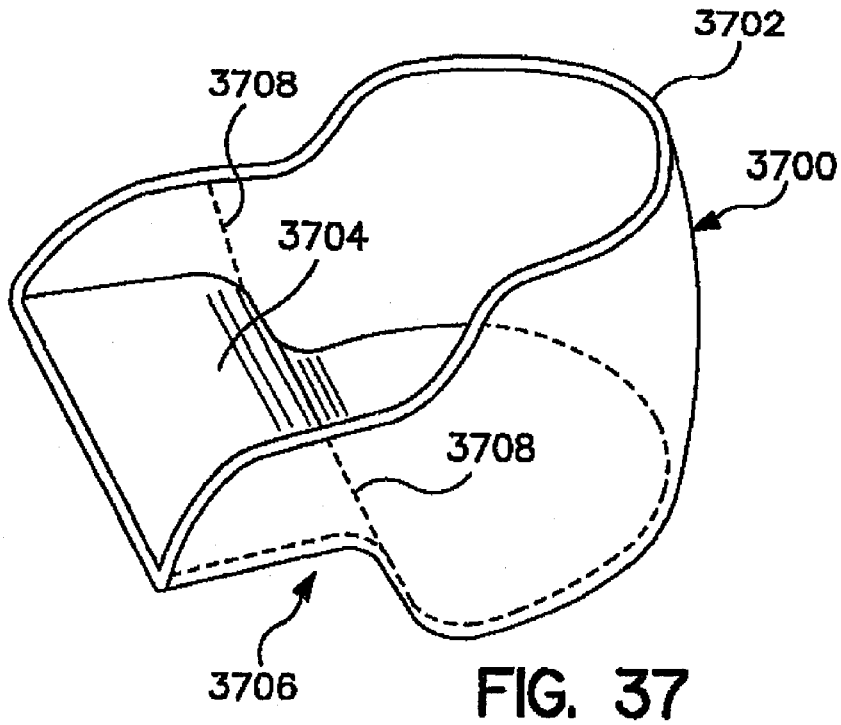
FIG. 37 illustrates an exemplary heel counter consistent with the invention.
Figure 38:
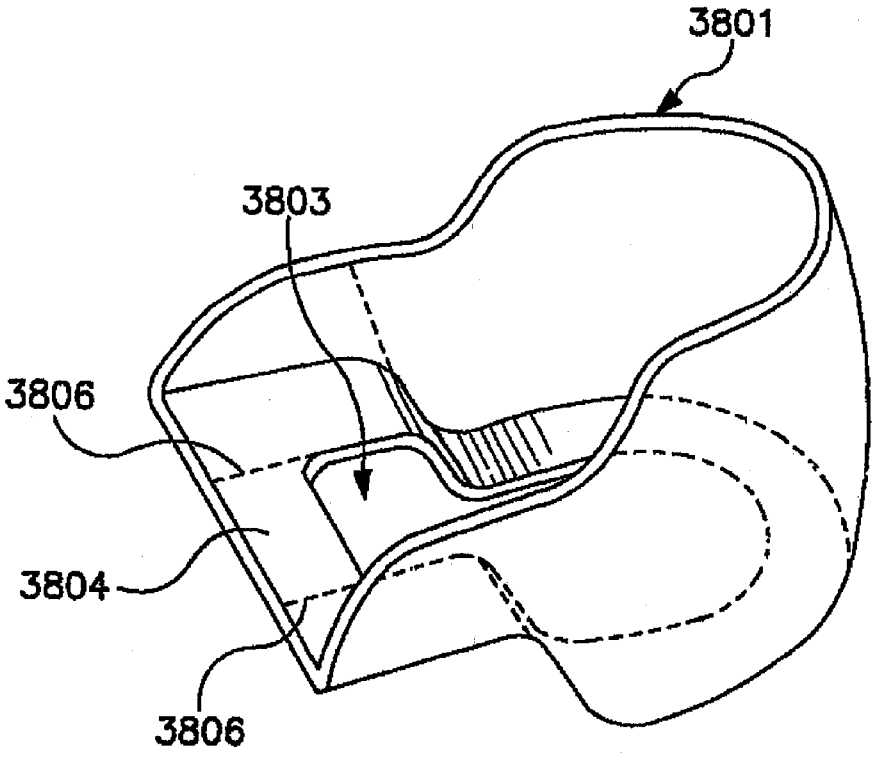
FIG. 38 illustrates another exemplary heel counter consistent with the invention.
Figure 39:
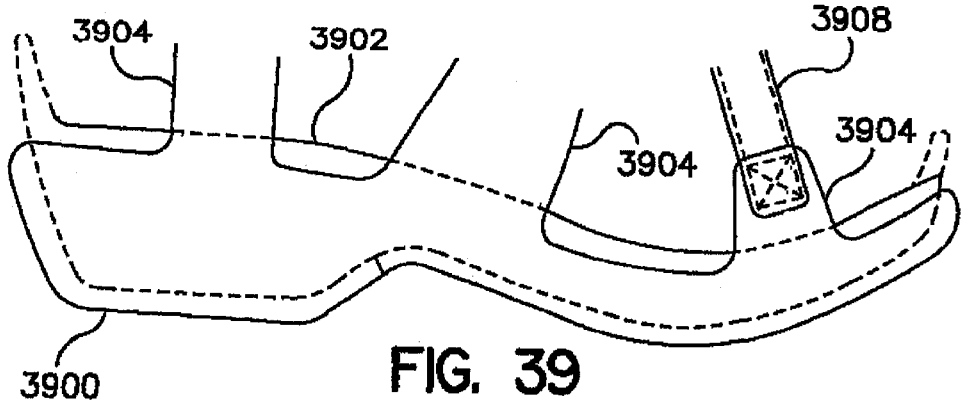
FIG. 39 is a side view of a portion of a sandal construction consistent with the invention.

With reference now to FIGS. 37 and 38, there are shown exemplary embodiments of heel counters consistent with the invention. The counter may be fully disposed between layers of a non-molded upper or partially exposed on the bottom of the upper, but may have perimeter walls disposed between upper layers with a bottom of the counter being exposed at the bottom of the upper. The counter may also be incorporated on the exterior surface of an upper or portion thereof, e.g. as an external counter, a removable liner or bootie, or between a lining and an outer upper portion. The counter may also extend to the ball of the foot and may be angled to facilitate shock absorption during heel strike. The counter may also include an opening in the heel to facilitate shock absorption during heel strike.

As shown in FIG. 37, an exemplary heel counter 3700 may include a perimeter wall portion 3702 and a bottom portion 3704 that is configured to mate with an arched shank interlock portion of a midsole, outsole, and/or upper. In the heel area, the perimeter wall extends upward to provide support and stability to a wearer's heel and/or ankle. The perimeter wall may also extend over the shank area 3706 of the counter to provide additional stability and support. The perimeter wall may also have different lateral or medial wall heights, e.g. the medial or lateral wall height could be higher to provide anti-pronation, arch support, or anti-supination. In alternative embodiments, the solid bottom 3704 may be omitted from the counter, and/or the counter could extend only from rear of the heel to the heel breast, ending at dashed line 3708.

As shown in FIG. 38, an opening 3803 may be provided in the bottom of a counter 3801 for providing reduced weight. The opening may extend to a bridge portion 3804 that extends across the counter for support. Alternatively, the bridge may be removed, e.g., at dashed lines 3806. The counter may include more than one bridge portion that extends across the counter for support.

Figure 40:
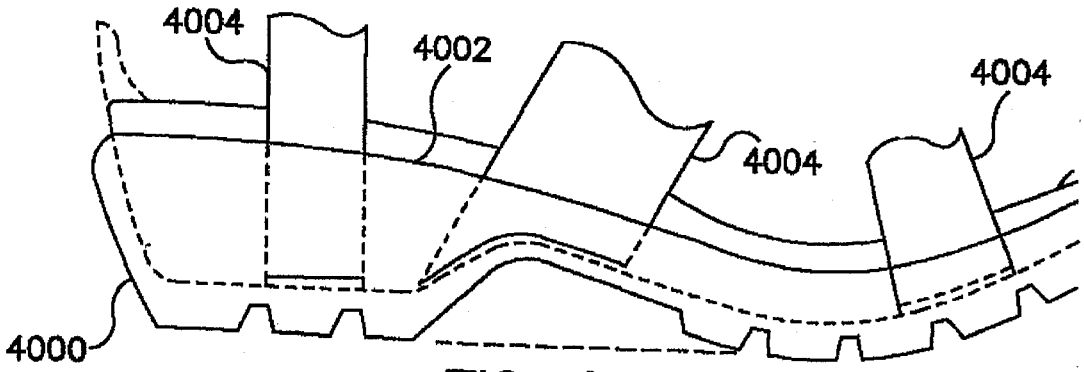
FIG. 40 is a side view of another exemplary sandal configuration consistent with the invention.
Figure 41:
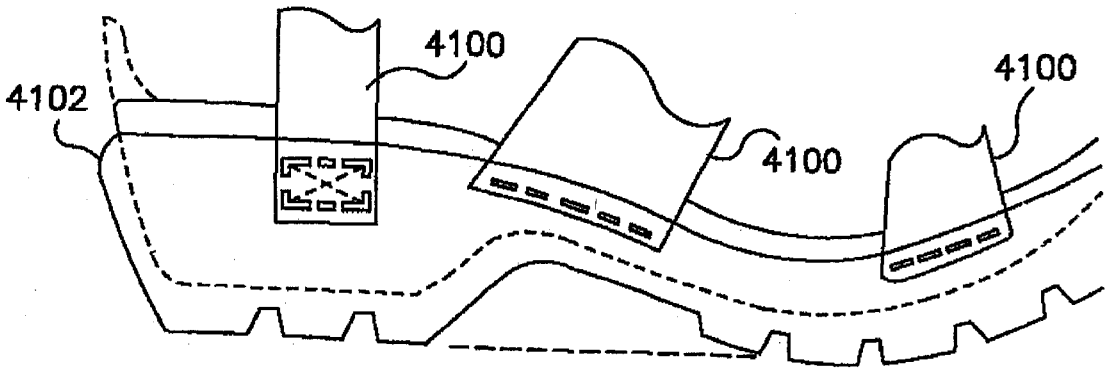
FIG. 41 is a side view of yet another sandal construction consistent with the present invention.
Figure 42:
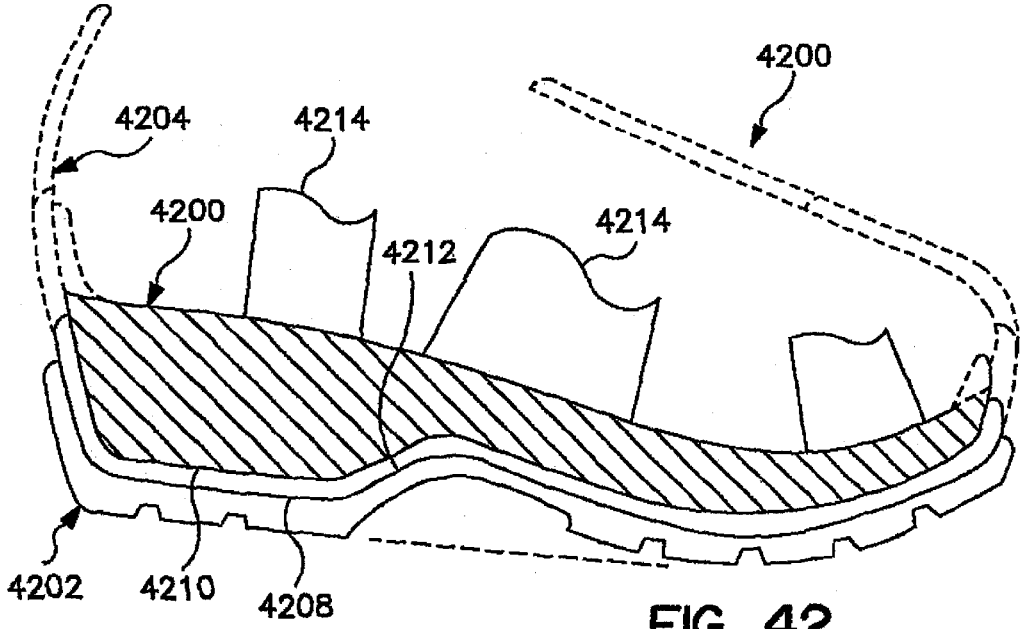
FIG. 42 is a longitudinal sectional view of an exemplary sandal configuration consistent with the invention.

A wide variety of footwear types may be constructed consistent with the invention, e.g. athletic shoes, casual shoes and boots, dress shoes and boots, industrial boots, ski boots, skates, inline skates, sandals, clogs, prescription wear, orthopedic wear, specialty footwear, etc. For example, FIGS. 39–47 illustrate exemplary sandal constructions consistent with the invention. In the embodiment illustrated in FIG. 39, a molded outsole shell 3900 is provided with an arched shank interlock portion that interlocks with a corresponding arched shank interlock portion in a midsole 3902. A molded tread surface may be provided in the bottom of the outsole, as shown in FIGS. 40–42, but is not necessary. The molded outsole may include integral, upwardly-extending sandal anchor straps 3904 for securing non-molded straps 3906 adapted for holding the sandal on a wearer's foot. In this construction, the non-molded straps would comprise the upper of the sandal construction. As with the constructions described above, however, a fully molded embodiment may be constructed. In a fully molded construction the straps 3904 would extend around the wearer's foot to secure the construction thereto, i.e., no separate non-molded straps 3906 would be required.

Alternatively, the sandal straps can be provided as separate molded or non-molded components that are secured to the outsole, as shown, for example in FIGS. 40 and 41. As shown in FIG. 40, the straps 4004 may be secured to the interior of the outsole side wall 4002, or to the interior bottom and/or interior side wall of the outsole, as shown. The separate straps 4100 may also be secured to the exterior of the outsole sidewall 4102, as shown in FIG. 41. In any embodiment, the straps may be recessed into the outsole.

Another exemplary sandal embodiment 4200 is illustrated in FIG. 42. In the illustrated embodiment, interlocking arched shank portions are provided in the molded outsole 4202, the upper 4204, and the midsole 4206, as described above. The upper 4204 has a bottom portion 4208 disposed between the midsole bottom surface 4210 and the top surface 4212 of the outsole. Alternatively, the upper or a portion thereof may be secured to the outsole at a point below the midsole top surface or footbed surface. In either case, the upper 4204 includes integral sandal straps 4214 for securing the construction to the wearer's foot or for providing an anchor point for additional separate straps.

Figure 43:
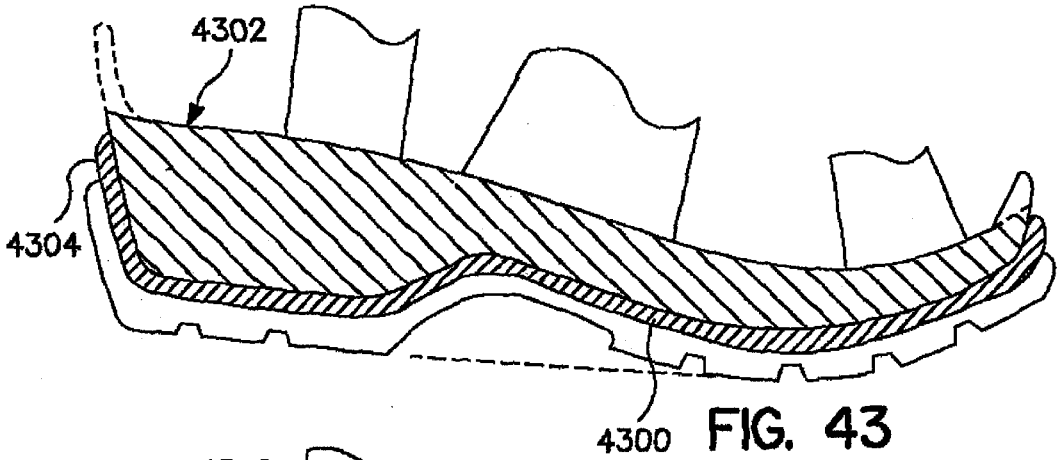
FIG. 43 is a longitudinal sectional view of another sandal construction consistent with the present invention wherein a shank component is disposed beneath the midsole.
Figure 44:
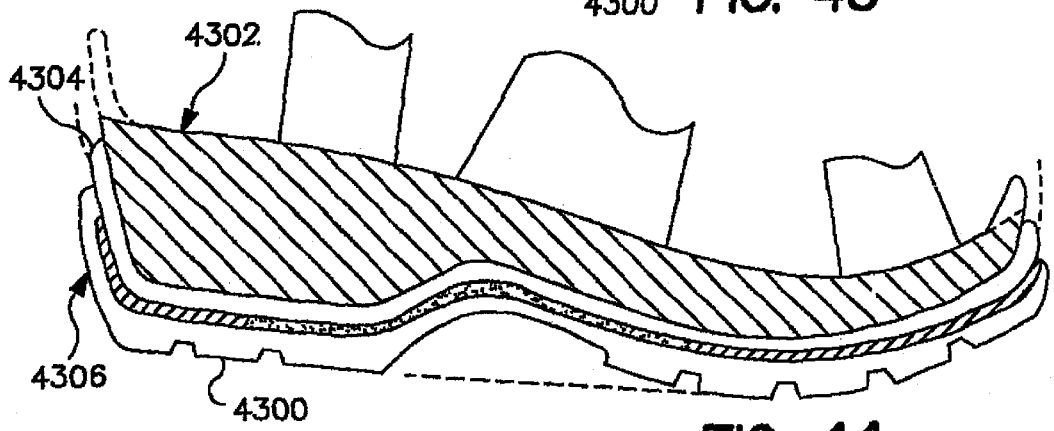
FIG. 44 is a longitudinal sectional view of a portion of a sandal construction consistent with the present invention wherein a shank component is disposed on the outsole.
Figure 45:
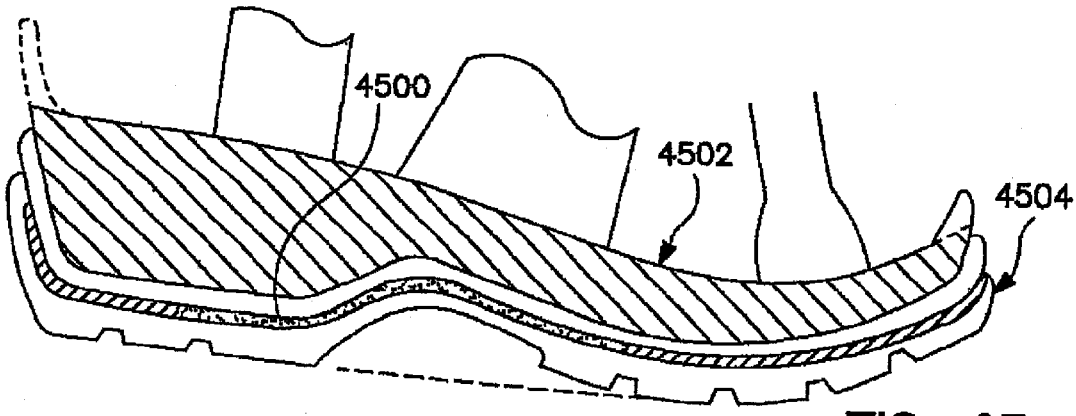
FIG. 45 is a longitudinal sectional view of an exemplary structure consistent with the invention wherein a shank portion is disposed between a midsole and an outsole.
Figure 46:
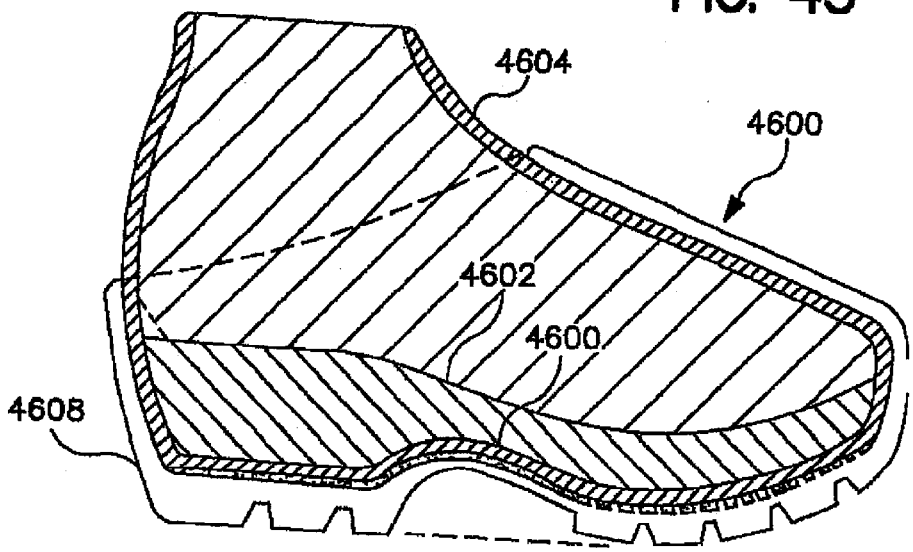
FIG. 46 is a longitudinal sectional view of an exemplary structure consistent with the present invention including a removable bootie portion with a midsole disposed therein.

As with any construction consistent with the invention, a semi-rigid or rigid shank component 4300 and/or a reinforcing layer may be provided in the sandal construction, either between the midsole 4302 and the upper 4304, as illustrated in FIG. 43, for example, or between the upper 4302 and the outsole 4306, as illustrated, for example in FIG. 44. In a construction as illustrated in FIG. 45, a shank portion 4500 may be disposed between the midsole 4502 and the outsole 4504. As described above, the shank component includes perimeter cupping walls and an arched shank interlock portion which mates with the arched shank interlock portions in the upper, midsole, and/or outsole.

As indicated above, the upper in a structure consistent with the invention may include a removable bootie-type structure. The upper may also be entirely removable. The removable upper, bootie, or liner may be disposable and replaceable. The removable upper, bootie, liner, and structure may also be reusable, cleanable and autoclavable for sterilization. For example, in FIG. 46, there is illustrated an exemplary clog-type construction 4600 wherein a midsole 4602 is disposed within a removable upper or bootie 4604, and the midsole 4602, upper 4604, a shank component 4606, and an outsole 4608 have interlocking shank interlock portions. In the illustrated embodiment, the upper with the midsole disposed therein may be entirely removable from the structure, and the midsole may be removable from the upper. Alternatively, as shown in the exemplary sandal-type construction illustrated in FIG. 47, a removable upper or bootie 4700 may be disposed on top of a midsole 4702. In this embodiment, the upper 4700 would not include an arch shank interlock portion, and interlocking would be between the midsole 4702, outsole 4704, and any intervening components such as a shank 4706 and/or reinforcing layer. Also, the outsole may include a flat bottom as illustrated by dashed line 4708.

Figure 47:
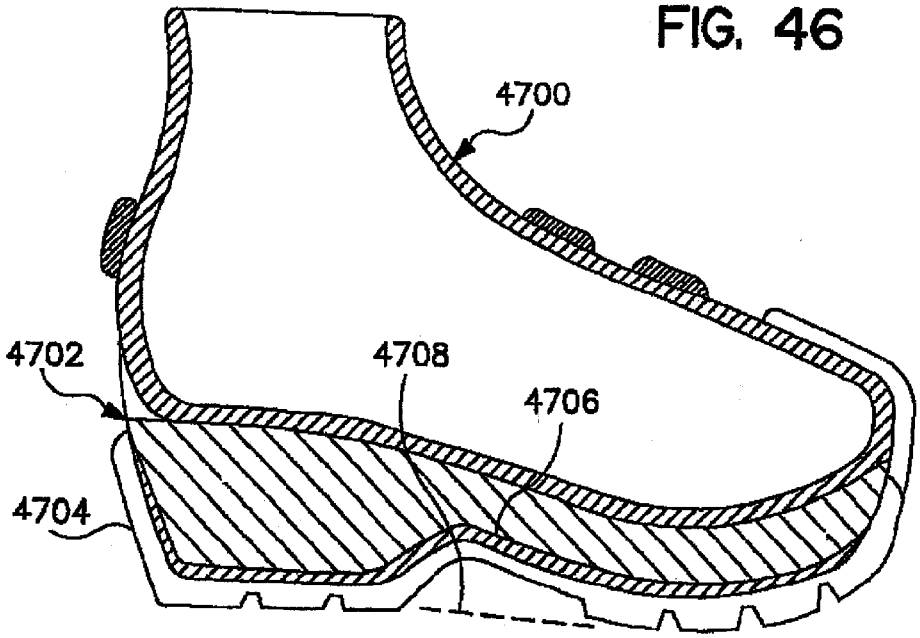
FIG. 47 is a longitudinal sectional view of an exemplary construction consistent with the invention wherein a removable bootie is disposed on top of the midsole.

In an alternative embodiment to the construction shown in FIG. 47, the upper or bootie is not removable and is affixed to the top surface of the midsole 4702. In this embodiment the upper 4700 would not include an arch shank interlock portion, and interlocking would be between the midsole 4702, outsole 4704, and any intervening components such as a shank 4706 and/or reinforcing layer. The combined structure of the upper or bootie affixed to a midsole may be removably disposed above the outsole. A shank component may be included within the combined upper or bootie affixed to a midsole structure so that the wearer may walk about with this structure.

Many materials are known in the art that may be used for forming a midsole which is consistent with this invention and the materials are durable enough to be walked on. The midsole advantageously may have a tread portion formed on the bottom surface but it is not necessary depending on the intended function. An outsole with an arched shank interlocking portion may also be secured to the midsole bottom and form an interlock with the outsole 4704 and any intervening components such as a shank and/or reinforcing layer (forming an outsole-to-outsole interlock). It is understood however, that a shoe or boot (e.g. an "inner" shoe or boot) with an outsole having a shank interlock portion may be removably disposed above an upper, outsole, shank and/or reinforcing layer of a shoe or boot (e.g., an "outer" shoe or boot) having a corresponding arched shank interlock portion. A wide variety of inner shoe and inner boot designs may be combined with a wide variety of outer shoe and outer boot designs.

A variety of other interlocking structures are possible: for example the top portion of an interlocking structure may be an upper, midsole, outsole, (shoe or boot) consistent with this invention having a shank interlock portion. The top interlocking structures may be removably disposed above any lower interlocking structures such as an outsole, strap-on safety/non-slip structures (such as non-slip grips for ice with metal cleats/spikes, non-slip soles for wet slippery applications such as the floors of dairy and meat packing plants), swim fin structures, water-ski or water-ski binding structures, snowboard or snowboard binding structures, ski or ski boot structures, or any structure having a corresponding shank interlock portion. Interlocking of the shank interlock portions of an upper, midsole, or outsole resists motion of the upper, midsole, or outsole relative to the corresponding shank interlock structure. The shank interlock portions may include a continuous arc or an abruptly changing arc. The lower interlocking structures described above may have full or partial perimeter cupping walls which help to support, position, and stabilize the top interlocking structures. The perimeter cupping walls may be positioned against the top interlocking structure. The cupping walls of the lower structure may have surfaces with a corresponding mating relationship to the top interlocking structures. The lower interlocking structures may have a plurality of closure straps or other fastening means to removably secure the lower structure to the top portion interlocking structures.

Figure 47A:
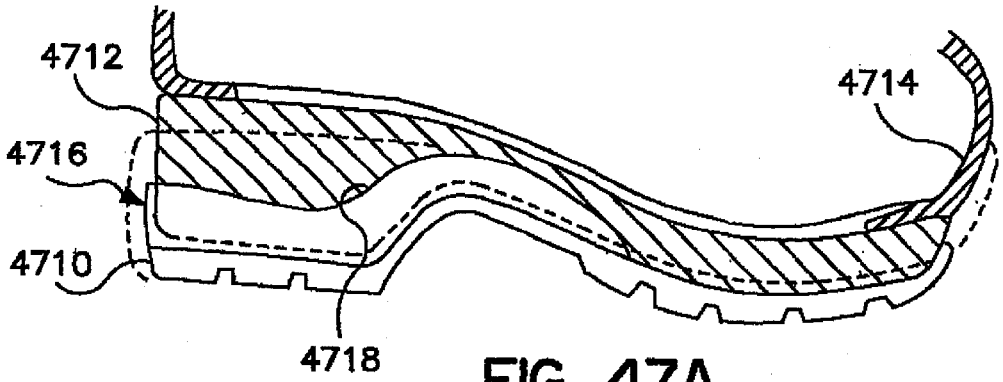
FIG. 47A is a longitudinal sectional view of an exemplary construction consistent with the invention wherein an upper is disposed on top of a midsole with a portion of the midsole being exposed to the exterior of the construction.

With reference to FIG. 47A, the perimeter walls on the outsole 4710 may be omitted or minimized to expose portions of the midsole 4712 on the exterior of the construction as illustrated in FIG. 47A. An upper 4714 may be removably or non-removably disposed on top of the midsole 4712. A full or partial length shank component 4716 with midsole cupping sidewalls 4718 may be disposed between the midsole and outsole to stabilize the midsole relative to the outsole.

Figure 48:
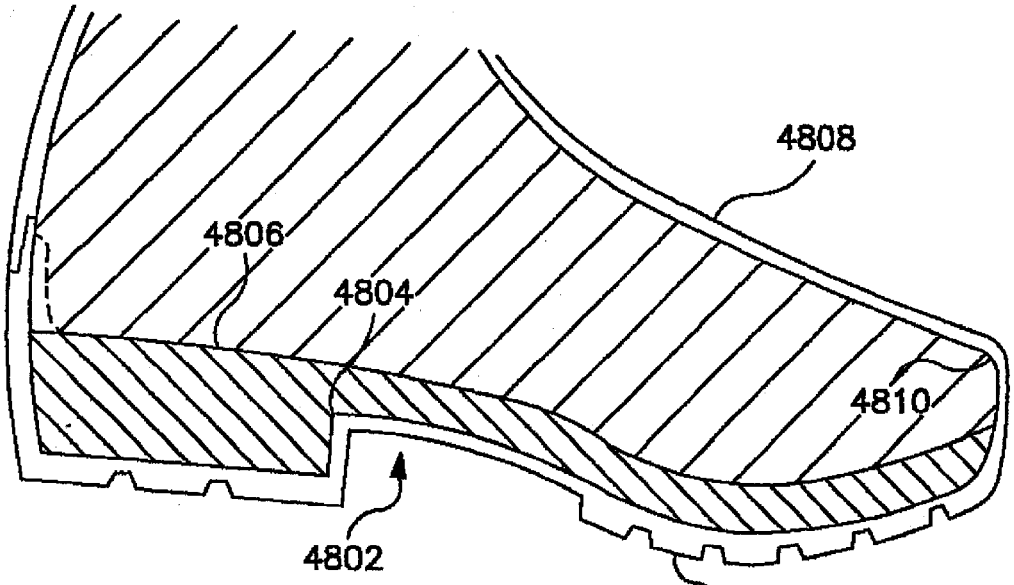
FIG. 48 is a longitudinal sectional view of an exemplary construction consistent with the invention wherein the shank interlock portion of the midsole and outsole include abrupt changes.
Figure 49:
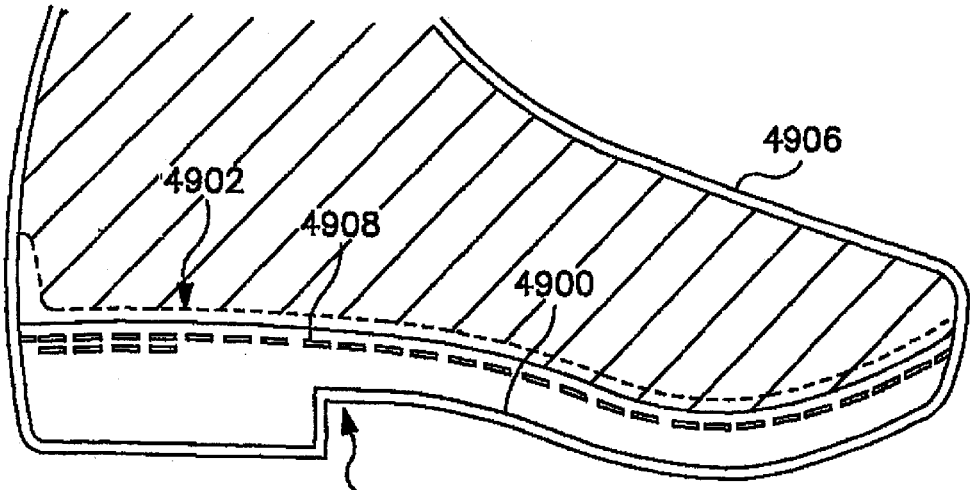
FIG. 49 is a side view of an exemplary construction consistent with the invention including a molded receptacle for forming an abrupt change in the shank interlock area.

Despite the above-described advantages of constructions including gradually arching arched shank interlocks, advantageous features of the invention may be incorporated into constructions with arched shank interlocks having abrupt changes if some complication of the manufacturing process is tolerable. FIGS. 48–59, for example, illustrate exemplary constructions consistent with the invention wherein the arched shank interlocks include abrupt changes. In FIG. 48, for example, a molded outsole 4800 is provided with an abruptly changing arched shank interlock area 4802 including an abrupt change at point 4804, i.e., at the heel/shank transition. Any midsole consistent with the invention, e.g. midsole 4806, may be disposed above the outsole 4800, as shown. An upper 4808 may be secured to any position on the outsole, e.g. to the sidewalls 4810 of the outsole, by a variety of known methods, e.g. stitching, cement, etc. Of course, in the case of a fully molded construction, a separate upper may not be used, and the outsole sidewalls may extend upwardly to form the entire exterior surface of the structure.

Alternatively, an abruptly changing interlock may be provided using a molded receptacle. As shown, for example in FIG. 49, a molded receptacle 4900 may define a volume for receiving at least a portion of the midsole 4902. The molded receptacle includes an abruptly changing shank interlock area 4904 which mates with a corresponding abruptly changing shank interlock in the midsole 4902. Where a non-molded upper is desired, the non-molded upper 4906 may be secured, e.g., stitched, to the receptacle at a seam 4908.

Figure 50:
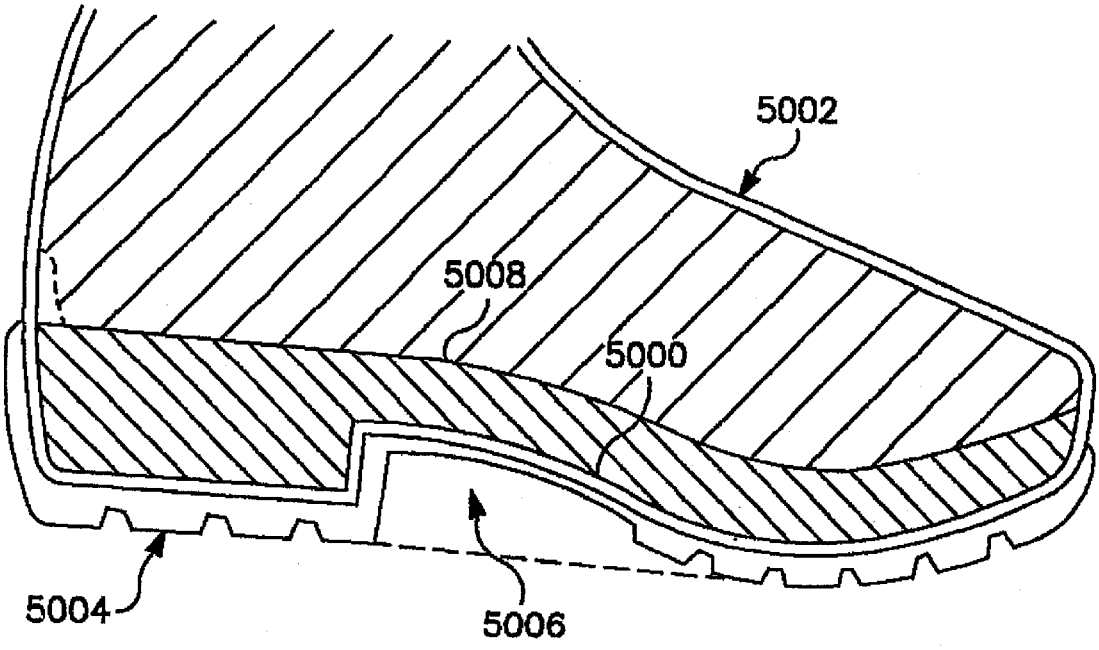
FIG. 50 is a longitudinal sectional view of an exemplary construction consistent with the invention wherein a molded shell for forming a shank interlock is combined with an outsole portion.

As shown in FIG. 50, a molded receptacle 5000 with the non-molded upper 5002 secured thereto (if desired) may then be combined with an outsole 5004 having a corresponding and mating abruptly changing arched shank interlock area 5006. The midsole 5008 may be disposed in the cavity at least partially defined by the molded receptacle 5000, and can be secured in the construction or left freely removable therefrom with the shank interlock in the midsole mated with the shank interlock in the receptacle. Of course, shank and/or reinforcing layers, as described above, may be provided in connection with any embodiment including abruptly changing shank interlock areas. A construction as shown in FIG. 50 may be used to fabricate a structure having an arched shank interlock portion. It would be more expensive and complex to construct the arched shank interlock structure with a molded receptacle than the method previously described by stitching an arched shank interlock structure with leathers, textiles, etc., however, there may be desirable functional advantages to the performance characteristics of a molded receptacle with an arched shank interlock portion which may not be achievable with the stitched materials if the increased costs will allow the use of the molded component. Any of the versions that have a molded component substantially in the arch area could be molded with either an arched or abrupt shank interlock.

Figure 51:
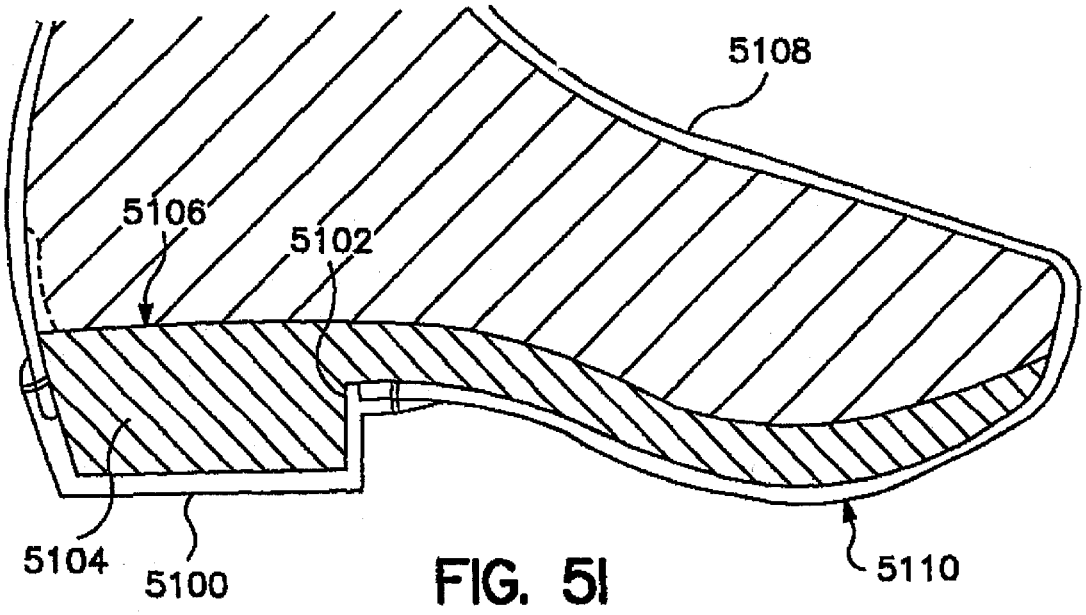
FIG. 51 is a longitudinal sectional view of a construction consistent with the invention wherein the molded shell portion is provided only in the heel area.
Figure 52:
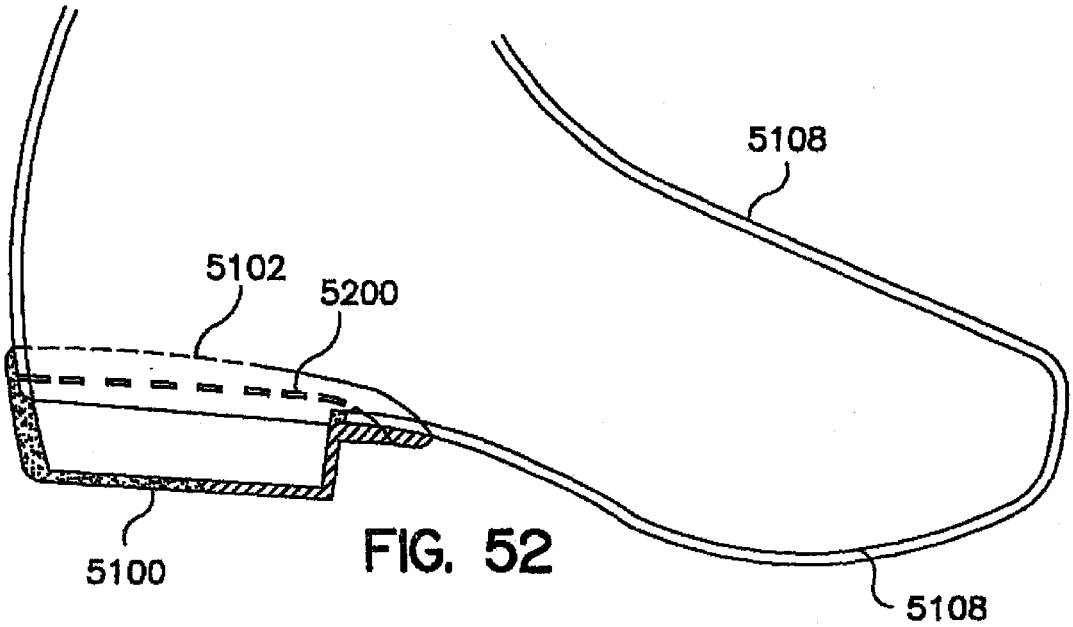
FIG. 52 is a partial sectional view illustrating the stitching of a non-molded upper to the molded shell portion illustrated in 51.

Consistent with the present invention, the molded receptacle may be provided in a variety of dimensions. For example, the molded receptacle may be used without a non-molded upper, but with upwardly extending sidewalls for defining the entire foot-receiving cavity. Also, as illustrated in FIGS. 51 and 52, a molded receptacle 5100 may have cupping sidewalls 5102 for receiving only the heel portion 5104 of the midsole 5106 or, alternatively, for receiving the heel and shank portions. In this embodiment, a non-molded upper 5108, which may include a partial lasting insole 5110 at the bottom thereof, may be stitched to molded receptacle 5100, e.g., at seam 5200.

Figure 53:
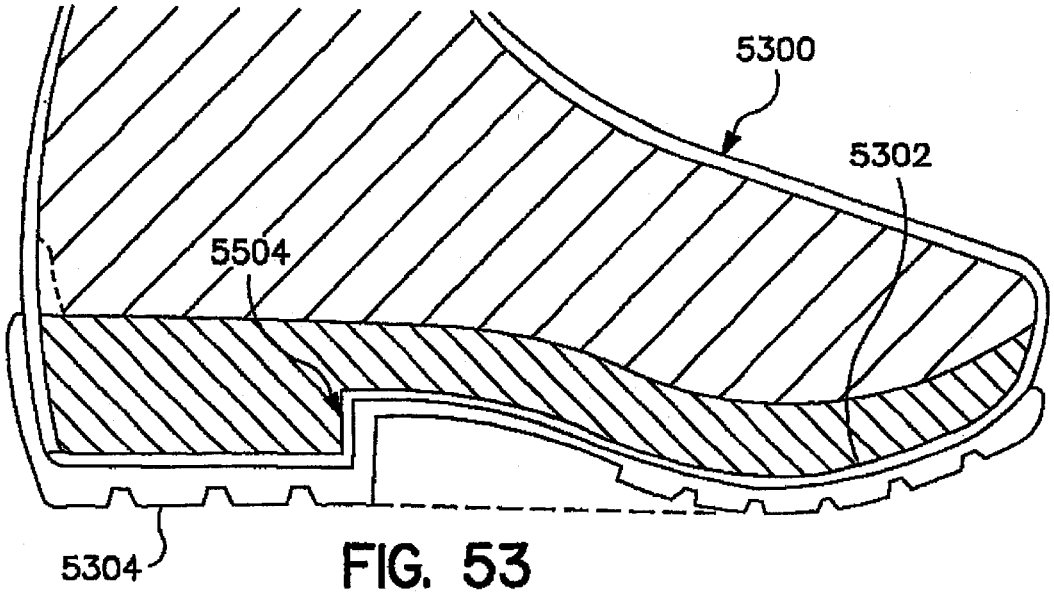
FIG. 53 is a longitudinal sectional view illustrating an exemplary embodiment wherein an upper is formed with a lasting insole having an abrupt shank interlock area.
Figure 55:
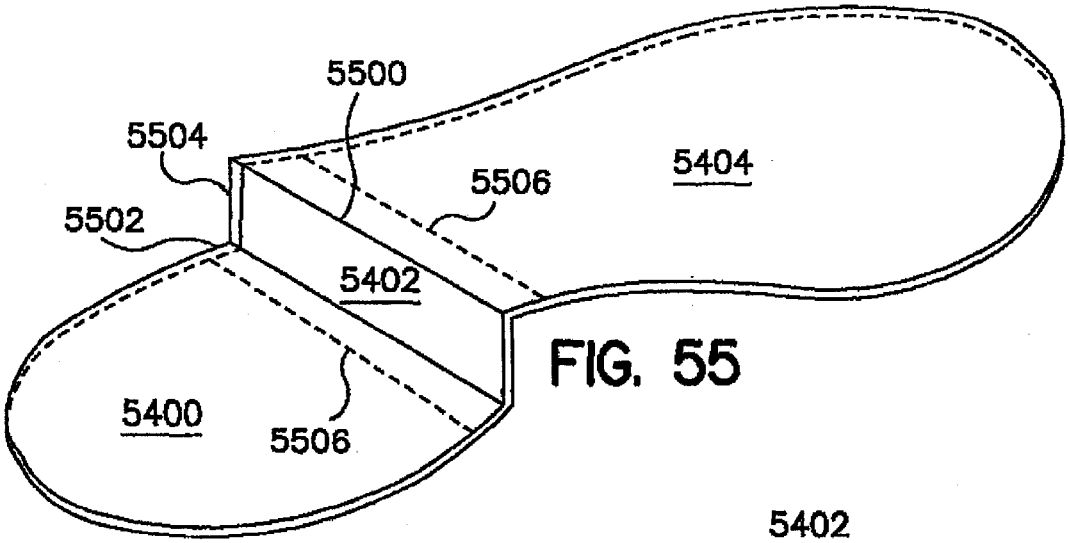
FIG. 55 is a perspective view of an exemplary lasting insole including an abrupt change consistent with the invention.
Figure 54:
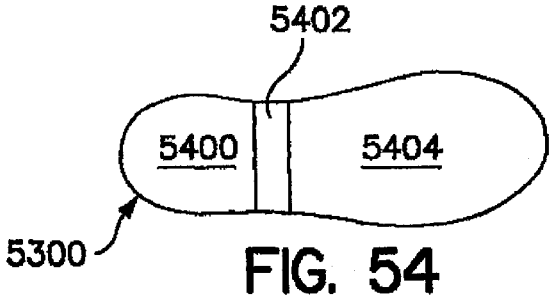
FIG. 54 is a bottom plan view of a sheet from which a lasting insole as illustrated in FIG. 53 may be constructed.

An abruptly changing interlock embodiment may also be constructed using a slip lasted upper, as illustrated, for example, in FIG. 53. In a slip lasted upper construction 5300, a lasting insole 5302 may be constructed by forming a stitchable fibrous paperboard or other suitable stitchable material into a shape having a heel zone 5400, a heel breast zone 5402, and a forefoot zone 5404, as shown in FIG. 54. The material is creased/folded along lines 5500 and 5502, as shown in FIG. 55, to form a distinct vertical heel breast 5504 for interlocking with the shank interlock portion in the outsole 5304. Sheet reinforcing materials 5506 may be applied to the textile over the folded areas to hold the shape of the heel breast.

Figure 56:
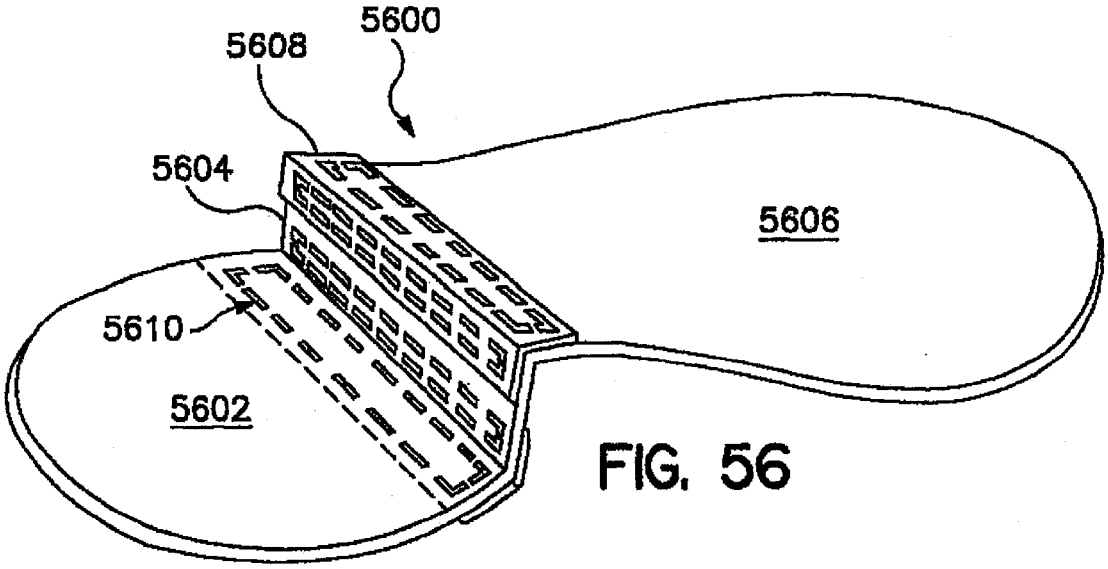
FIG. 56 is a perspective view of another exemplary embodiment of a lasting insole having an abrupt change consistent with the present invention.
Figure 57:
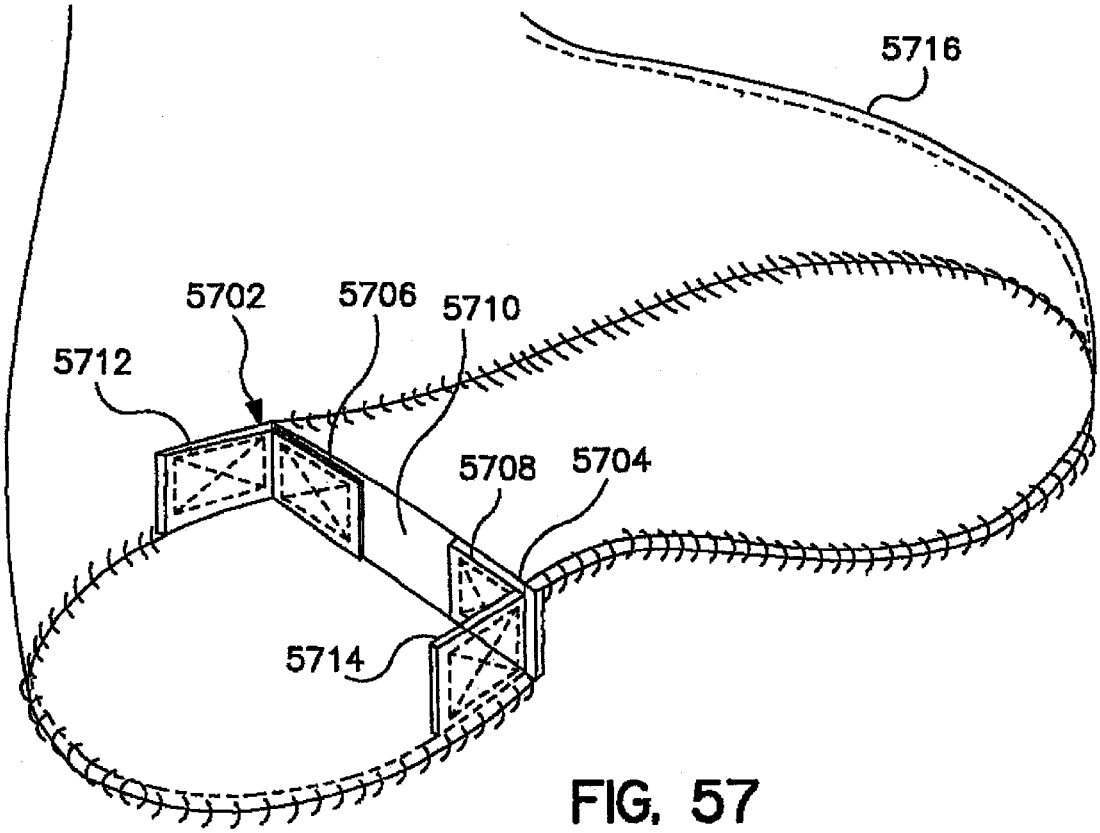
FIG. 57 is a perspective plan view of an upper including an exemplary lasting insole having an abrupt change consistent with the invention.

Alternatively, as shown in FIG. 56, a lasting insole 5600 may be formed using separate heel zone 5602, heel breast zone 5604, and forefoot zone 5606 pieces, which are joined by top 5608 and bottom 5610 corner reinforcement members. Any lasting insole embodiment may, however, have first 5702 and second 5704 reinforcing tabs on the heel breast, as shown in FIG. 57. A first leg 5706, 5708 of the reinforcing tabs may be secured directly to the heel breast 5710, while a second leg 5712, 5714 is stitched directly to the upper 5716.

Figure 58:
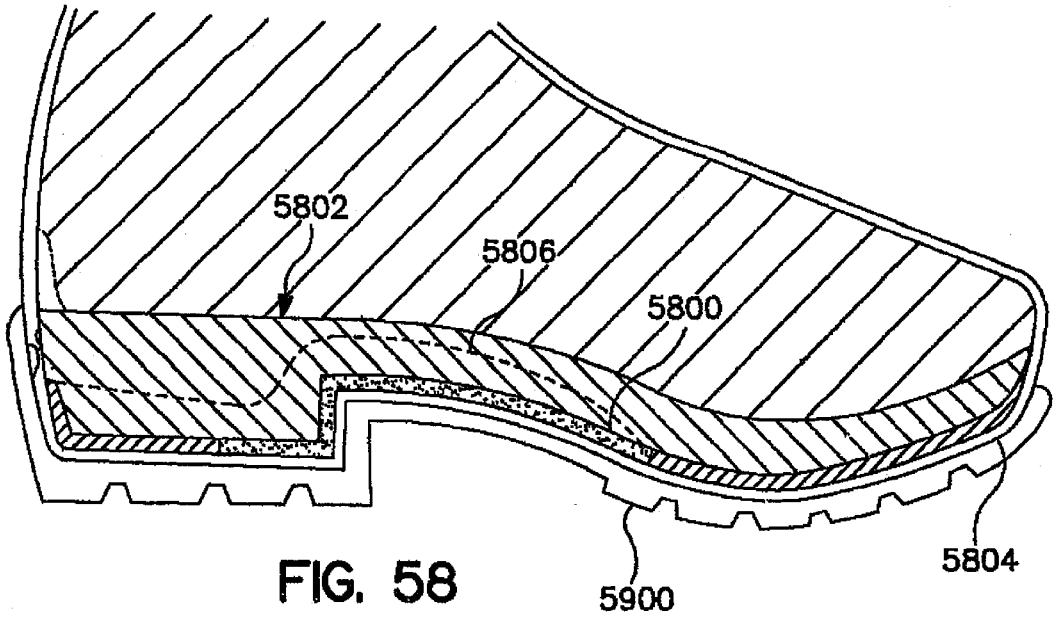
FIG. 58 is a longitudinal sectional view of a portion of an exemplary construction consistent with the invention including abrupt shank interlock portions and including a shank component disposed between a midsole and an upper.
Figure 59:
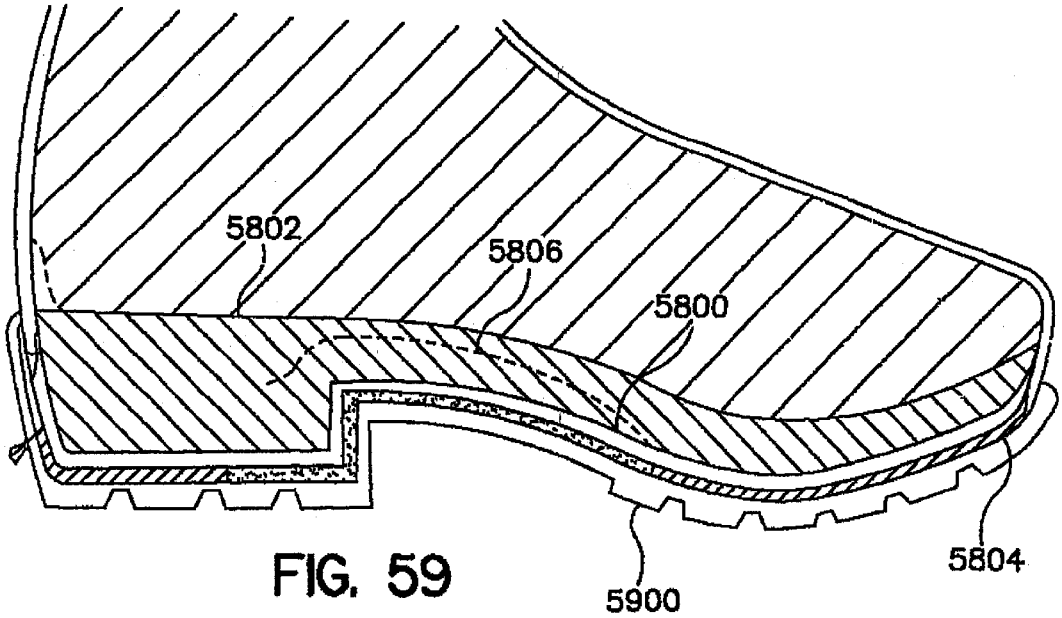
FIG. 59 is a longitudinal sectional view of a portion of a structure consistent with the invention including abruptly changing shank interlock portions and a shank component disposed between an outsole and an upper.

Consistent with the other constructions disclosed herein, the interlock portion of the midsole, molded receptacle, outsole and upper may be considered to be interlocking or mating although other elements are disposed therebetween. For example, a semi-rigid or rigid shank 5800 may be inserted between the midsole 5802 and the molded receptacle 5804, as shown in FIG. 58, or between the molded receptacle 5804 and the outsole 5900, as shown in FIG. 59. As discussed above, the rigid shank 5800 and/or a reinforcing layer may extend latitudinally and longitudinally across the entire midsole or any portion thereof, and may include upwardly extending walls 5806 to provide lateral support. The shank component shown in FIG. 59 may also include a heel counter and/or an external supportive back piece.

Figure 60:
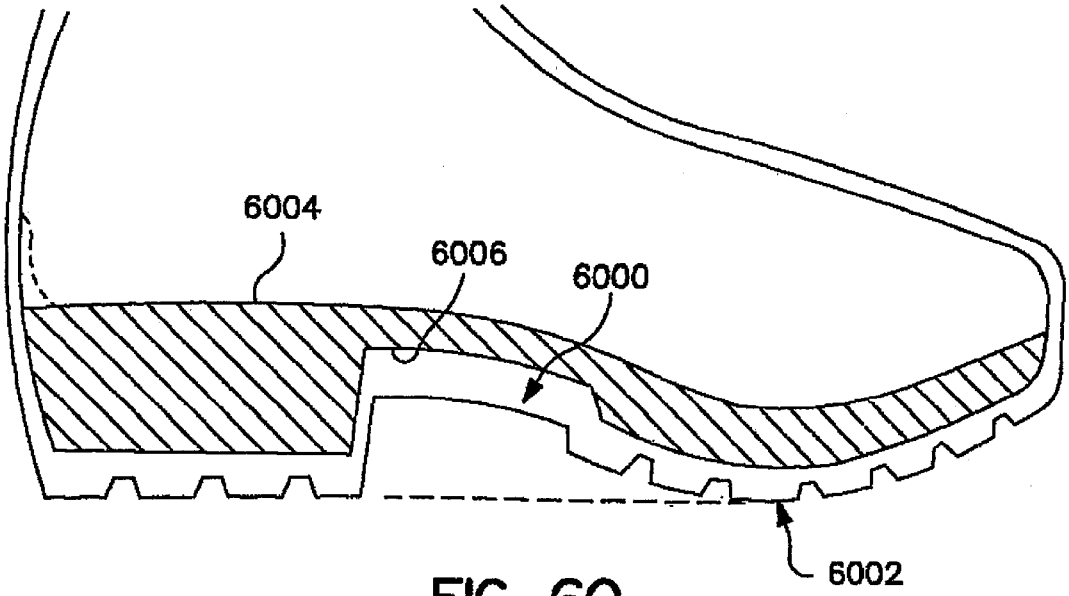
FIG. 60 is a longitudinal sectional view of an exemplary embodiment consistent with the invention wherein the interlock portions include an interlock step.
Figure 61:
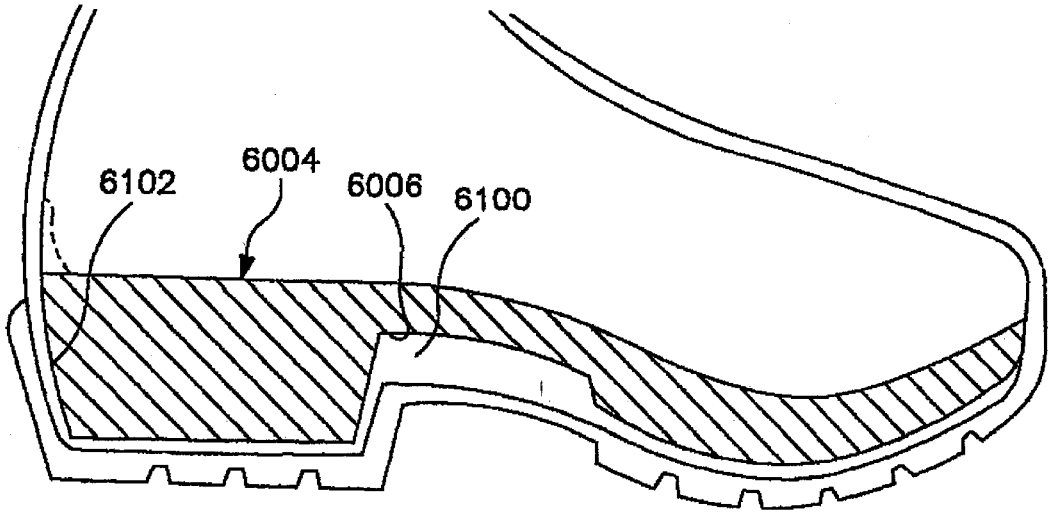
FIG. 61 is a longitudinal sectional view of a portion of a structure consistent with the invention wherein an interlock step is provided between an upper and a midsole.

FIGS. 60 and 61 illustrate exemplary embodiments wherein the abruptly changing interlock is provided in the form of an interlock step. In the embodiment illustrated in FIG. 60 the interlock step 6000 is formed in the outsole 6002, and in the embodiment illustrated in FIG. 61 the interlock step 6100 is formed in a molded receptacle 6102. In these configurations, the bottom surface 6006 of the midsole 6004 includes a correspondingly stepped shape for interlocking with the interlock step 6000 or 6100 in the outsole or receptacle. These configurations may also be provided with non-molded uppers. Also, a semi-rigid or rigid shank insert and/or a reinforcing layer may be provided between the midsole and the outsole in the exemplary embodiment illustrated in FIG. 60, or between the midsole and receptacle or receptacle and outsole in the exemplary embodiment illustrated in FIG. 61.

The interlocking of structural components of a footwear structure consistent with the invention provides many significant advantages. For example, the interlocking allows components such as the midsole to be removable and replaceable since relative motion between the components is limited by the interlocking. The interlocking constructions also facilitate customization of the structure depending on user preference.

Another significant advantage of interlocking components consistent with the invention is that they facilitate construction of a single expandable footwear structure that accommodates multiple foot sizes. In particular, the shank interlock area of an upper may be provided with fixed dimensions while other portions of the upper may stretch for receiving midsoles of varying lengths and widths but including uniform shank interlock area dimensions. The shank interlock areas of the upper and midsole would consistently interlock regardless of the length and width of the midsole. Also, expandable uppers can be used in prescription and orthopedic footwear to accommodate foot disorders or disorders that effect the foot. Expandable uppers also provide excellent fit to a normal foot since they may expand to contract to an exact foot dimension.

Figure 63:
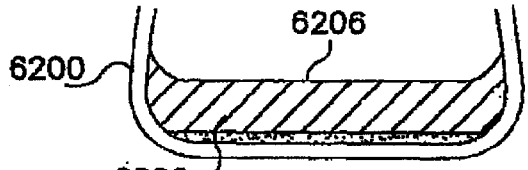
FIG. 63 is a transverse sectional view of the embodiment illustrated in FIG. 62 taken at the heel area.
Figure 62:
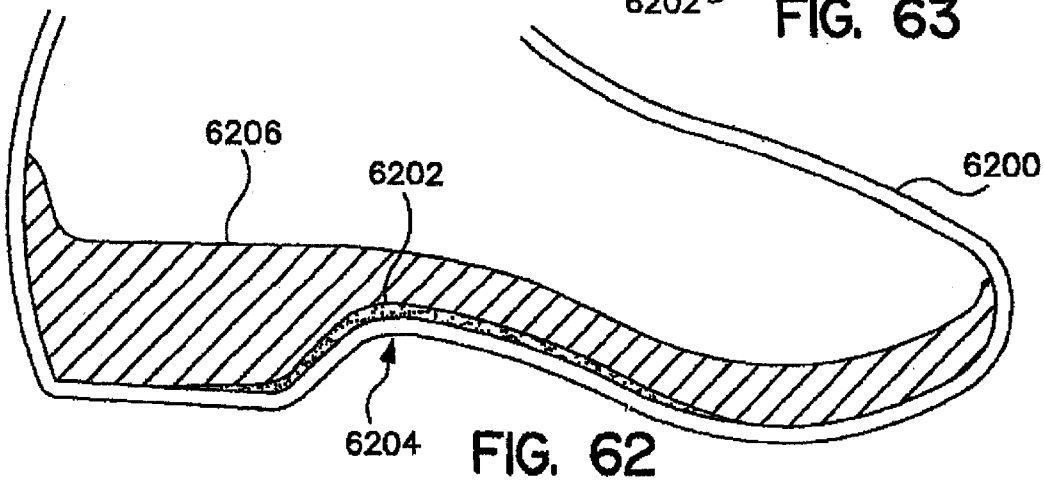
FIG. 62 is a longitudinal sectional view of a portion of a structure consistent with the invention including a stretch upper, a shank component, and midsole consistent with the invention.

Turning to FIGS. 62 and 63, for example, there is illustrated an exemplary embodiment including a stretch upper 6200. The stretch upper may be constructed from a variety of highly elastic materials known to those skilled in the art, e.g. using LYCRA or SPANDEX brand stretch fabrics, or from a stretch mesh or net-like material. A shank component 6202 may be secured to the upper over the shank interlock area of the upper. By affixing the shank component over the shank interlock area, the dimensions of the shank interlock area are held constant, as determined by the dimensions of the shank component 6202. The shank component thus establishes a non-stretch anchor zone 6204 in the shank interlock area of the stretch upper. Any portion of the shank that extends over the heel or forefoot areas may be left unattached to the upper to allow the upper to stretch.

A midsole 6206 having a shank interlock area of dimensions corresponding to the dimensions of the shank interlock area in the upper surface and sidewalls of the shank component 6202 may be inserted into the upper. To the extent that the width or length of the midsole 6206 exceeds the width or length of the upper, the upper will stretch lengthwise and widthwise, and the midsole 6206 will be received within the upper with the interlock areas of the upper, shank component, and midsole in an interlocking relationship consistent with the invention. Midsoles of varying lengths or widths may, therefore, be combined with a single upper construction. The midsoles used within the stretch construction may have an integrally formed or removably secured heel counter. It may also have an integrally formed or removably secured toe cap or the midsole may have a heel counter and a toe cap.

A number of variations including a stretch-type upper are possible. For example, the midsole may have a recessed notch in the bottom thereof for receiving the shank component. Also, each midsole size may include its own shank component that has a shank interlock area that interlocks with the shank interlock area of an upper. The shank component prevents lateral movement of the midsole. In this embodiment, the shank may be affixed over the shank interlock area of the upper, as described above, and may be provided with cupping walls for cupping the midsole and resisting side-to-side movement. In an embodiment wherein the shank includes a heel counter portion, the upper may be affixed to the shank in the heel counter area to define an anchor zone.

Figure 64:
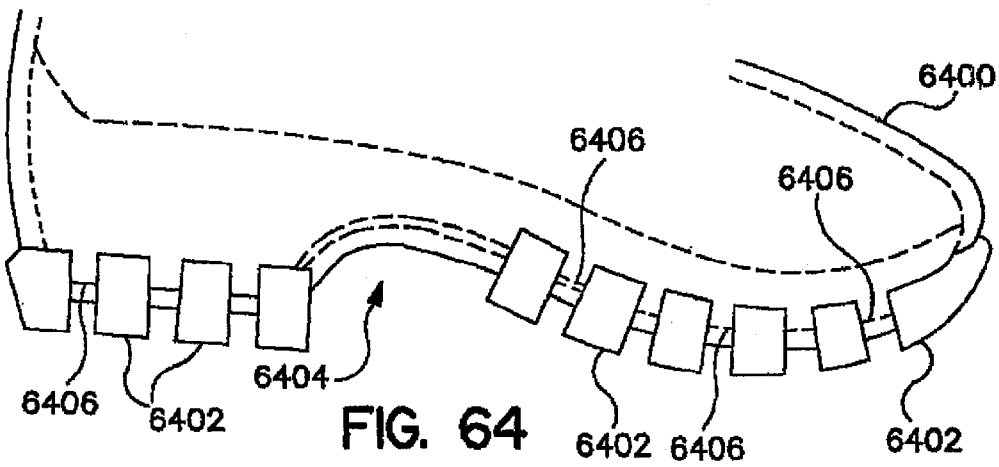
FIG. 64 is a side view of a stretch upper consistent with the invention including outsole treads defining anchor zones and stretch zones.
Figure 65:
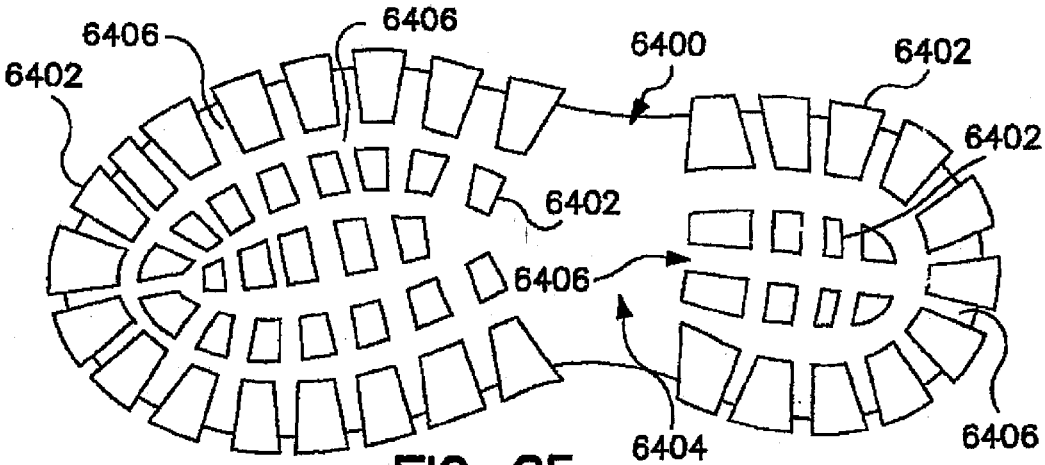
FIG. 65 is a bottom view of the exemplary embodiment illustrated in FIG. 64.

Turning now to FIGS. 64 and 65, there is shown another exemplary embodiment wherein the stretch upper 6400 includes outsole tread elements 6402 fixed to a bottom thereof in the heel and forefoot areas. Tread elements may be omitted from the shank interlock area 6404 of the upper, as shown. Advantageously, the locations where outsole tread elements 6402 are affixed to the upper define anchor zones where stretching or expansion of the stretch upper 6400 is prevented due to the affixation of the elements. The interstices 6406 between the tread elements, however, define stretch zones where the stretch upper may expand or contract to accommodate varying midsole dimensions. A shank component 6202 may be provided over the shank interlock area of the upper, as described above, to provide an anchor zone in the shank area. The shank may, however, be omitted to allow the shank area to function as stretch zone between the lugs at the beginning heel and forefoot areas.

Figure 66:
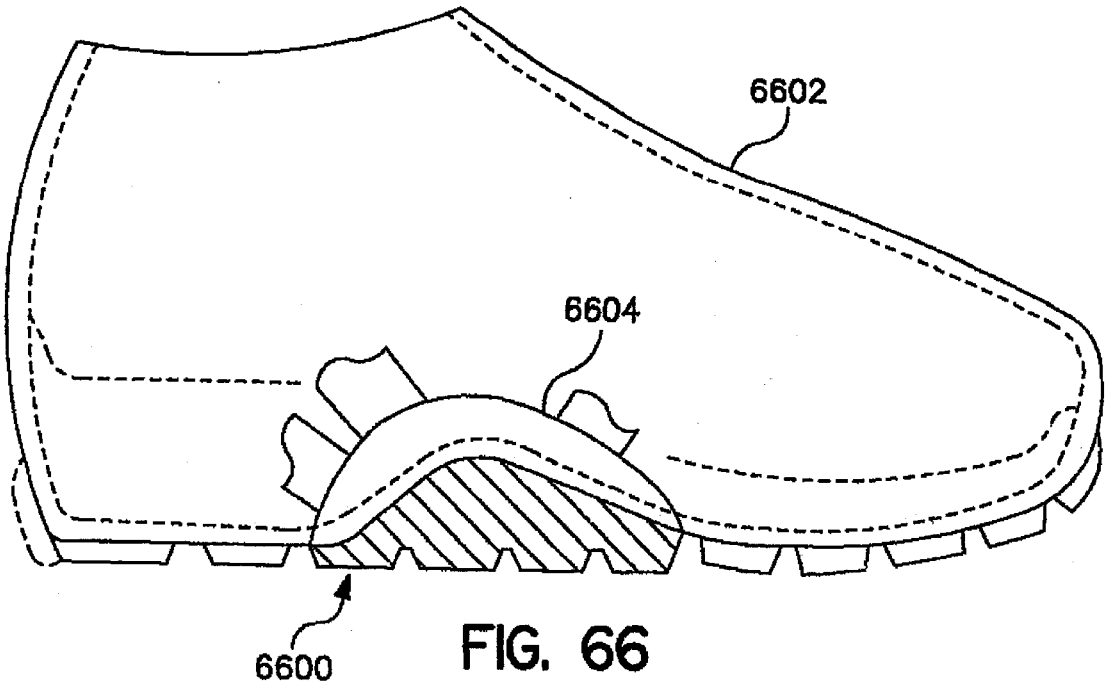
FIG. 66 is a side view of another exemplary embodiment consistent with the invention wherein a stretch upper is combined with a midfoot support.
Figure 67:
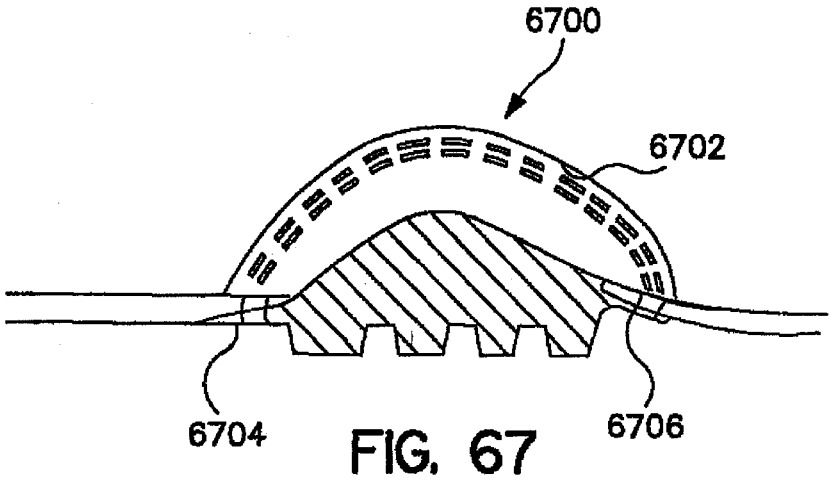
FIG. 67 is a side view of the midfoot support illustrated in FIG. 66.

An outsole component configured as a midfoot support 6600 may also be provided, as illustrated in FIG. 66. As shown, the midfoot support 6600 may have a contour which mates with and interlocks with the shank interlock area of the upper 6602. Cupping sidewalls 6604 may extend upwardly from the midfoot support and may be cemented to the shank interlock area to establish an anchor zone in the shank interlock area. Alternatively, the midfoot support 6700 may be constructed to provide continuous (not shown) or separate stitching flanges 6702, 6704, 6706, as shown for example in FIG. 67, to which the upper is stitched. In the illustrated embodiment, therefore, the midfoot support 6700 forms the arch shank interlock for the upper. The midfoot support may be constructed, for example, from a rubber or foam material as one-piece, or may be provided in multiple pieces, e.g. a top layer of foam and a bottom rubber layer. A molded midfoot support component may include integral cupping sidewalls that provide support and a continuous flange for attachment to the upper.

Figure 68:
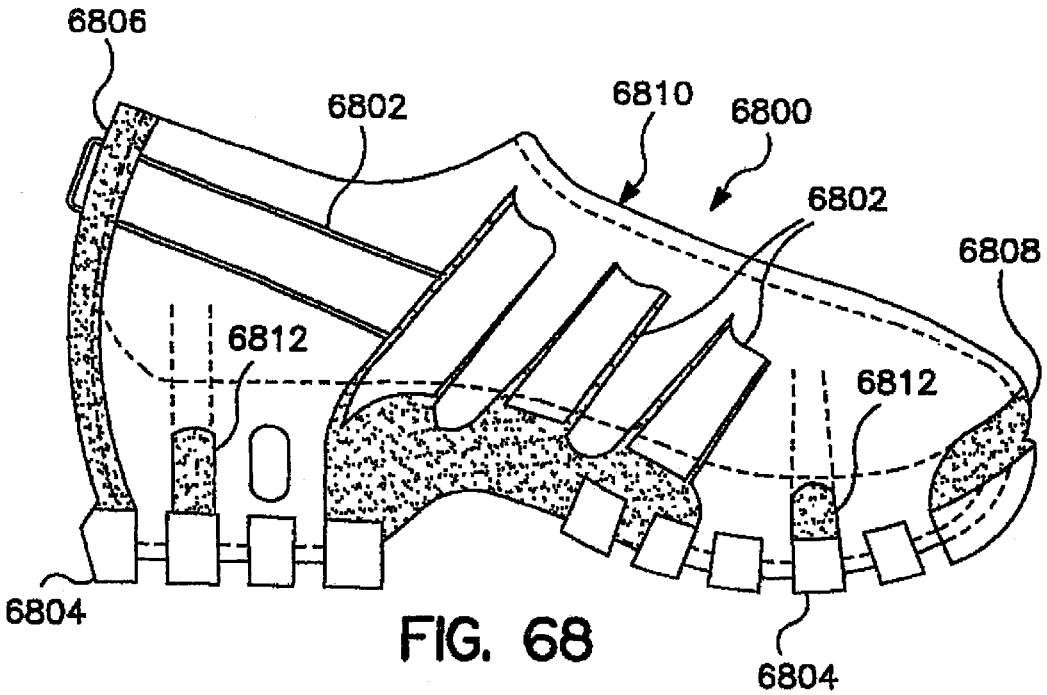
FIG. 68 is a side view of a portion of an exemplary construction consistent with the invention including anchor zones, stretch zones and straps for facilitating closure of the upper.

FIG. 68 illustrates another exemplary embodiment 6800 wherein closure straps 6802 are anchored to non-stretch anchor zones for facilitating closure of the upper. The straps may be connected in a variety of configurations to anchor zones established by outsole tread elements 6804 or other molded or non-molded elements affixed to the upper. For example, anchor zones may be established by a heel back strap 6806 secured, e.g. by stitching or adhesive, to an anchor zone along the rear of the upper, or wrapped fully around the upper, by a toe cap 6808 secured to the toe area of the upper, or by individual components 6812 secured along the side of the upper above the tread elements. Areas of the stretch upper 6810 between the anchor zones are stretch zones where the upper may expand or contract. The closure straps 6802 may be secured to the anchor zones and are free to overlap the stretch zones so that positioning of the straps is not affected by expansion or contraction of the upper. The straps may also wrap around the upper and be anchored to the bottom of the upper to define anchor zones.

Figure 69:
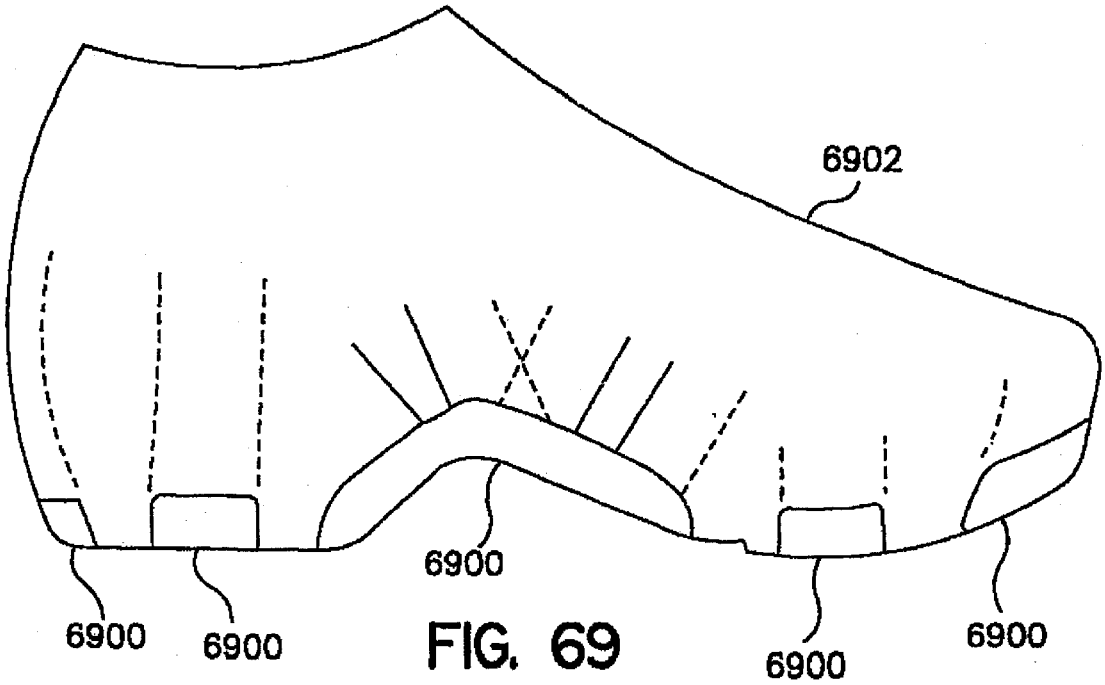
FIG. 69 is a side view of an exemplary construction consistent with the invention wherein anchor zones are provided by securing non-stretch material to portions of the upper.
Figure 71:
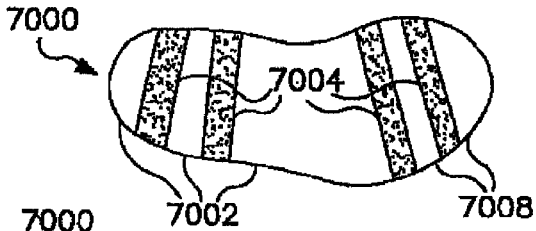
FIG. 71 is a bottom view of the exemplary embodiment illustrated in FIG. 70.
Figure 70:
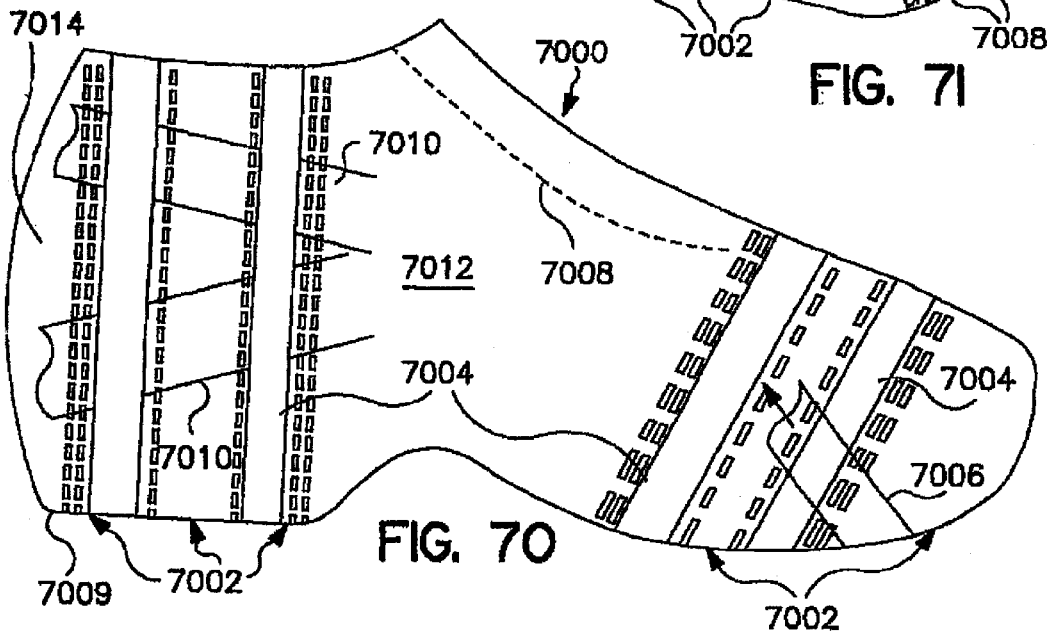
FIG. 70 is a side view of a portion of a structure consistent with the invention wherein anchor zones are defined in thin strips in areas of the upper.

Anchor zones on a stretch upper may be configured in a variety of ways. As illustrated in FIG. 69, for example, anchor zones may be provided using non-stretch material 6900 which is secured on the bottom of the upper 6902 to the shank interlock area, the heel and forefoot areas, and locations between the ends of the shank interlock areas and the toe and heel. The non-stretch material may be secured only to the side of the upper, or may extend partially across the bottom or fully across the bottom and up the opposite side of the upper. Also, the non-stretch material may be a molded or non-molded material. For example, the non-stretch material in the shank interlock area may include a molded shank component having cupping sidewalls. The stretch zones, which wrap partially or fully around the upper as illustrated in FIG. 70 and FIG. 71, can also be at an angle on the upper or formed with an arc. For example, two or more stretch zones in the forefoot area may be radially spaced or could also be parallel. The shapes of the stretch zones and positioning of the stretch zones can vary greatly depending on the intended style and function.

Again locations between the anchor zones act as stretch zones where the upper may stretch to accommodate varying sized midsoles. The configuration and orientation of the anchor zones therefore depends on the desired level of expansion for the upper in view of the midsoles to be used with the upper. Also, items such as outsole tread elements may be secured to the anchor zones as desired. An outsole or component thereof having a perimeter wall extending onto the side of the upper may also be provided to establish an anchor zone, or may be secured to an existing anchor zone.

In FIGS. 70 and 71, there is illustrated another exemplary embodiment 7000, wherein the anchor zones 7002 wrap around the stretch upper allowing relatively thin stretch zones 7004. Closure straps 7006 may be secured to the anchor zones for closing the upper, which may include a tongue 7008 and a conventional lace closure. Straps 7010 may be provided in a midfoot anchor zone 7012 for wrapping around the rear portion and connecting to the midfoot anchor zone on the other side of the upper. Each strap may include one or more conventional fastening components and means of adjustment within its length to facilitate closure of the upper thereby. Alternatively, straps on a rear anchor zone 7014 could connect to the midfoot anchor zone 7012 on both sides of the upper. Those skilled in the art will recognize that as the quantity of non-stretch material used in a particular embodiment increases, it may be preferable to construct the embodiment by securing, e.g., stitching, strips of stretch material to the non-stretch anchor zone material. The exemplary embodiment illustrated in FIG. 70 may be constructed in this manner.

Figure 72A:
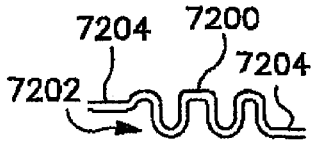
FIG. 72A illustrates an exemplary construction of an expansion joint consistent with the invention.
Figure 72:
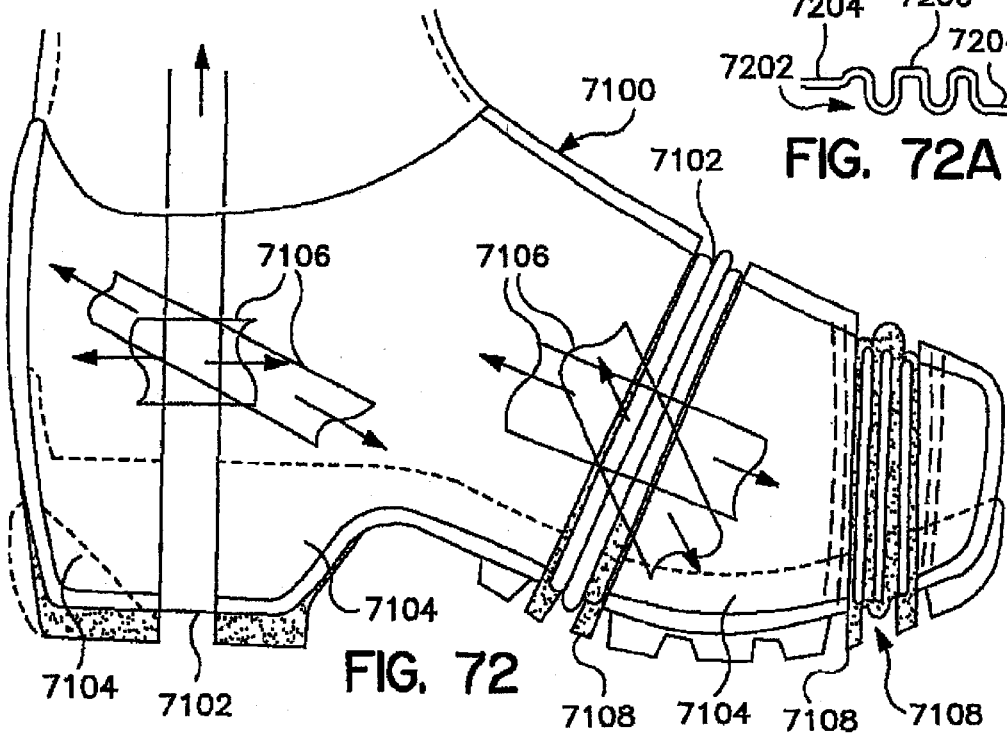
FIG. 72 is a side view of a portion of an exemplary construction consistent with the invention including expansion joints disposed between areas of non-stretch material and expansion treads on the outsole.

FIG. 72 illustrates an exemplary embodiment, wherein the stretch upper 7100 includes stretch zones defined by expansion joints 7102 disposed between areas of non-stretch material. As illustrated for example in FIG. 72A, the expansion joints may include a molded (e.g., rubber, elastomer, plastic, tpu urethane) stretch portion 7200 extending in a serpentine or bellows-shaped path between stitching margins 7204. The margins may be secured to non-stretch zones of the upper, and the stretch portion 7200 allows expansion/contraction through expansion or contraction of the serpentine configuration thereof. Alternatively, the stretch portion of the expansion joint may be constructed of an elasticized material such as LYCRA or SPANDEX brand stretch fabric. Closure straps 7106 may be anchored to the margins 7204 of the expansion joints 7102 or to the non-stretch anchor zones.

Figure 73:
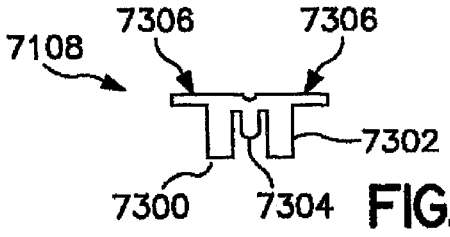
FIG. 73 illustrates an exemplary construction of an expansion tread consistent with the invention.

With continued reference to FIG. 72, expandable outsole treads 7108 may also be provided at locations on the bottom of the upper 7100 and wrapping up onto the sidewalls of the upper/expansion joints in areas corresponding to the locations of the stretch zones. An exemplary expandable outsole tread configuration is illustrated in FIG. 73. As shown, an expandable outsole tread 7108 may include first 7300 and second 7302 lugs separated by an expansion web 7304 and having flanges 7306 for securing the tread to the bottom of the upper 7100. The expansion web 7304 expands/contracts to allow relative motion between the lugs 7300, 7302. A wide variety of variations including expansion joints and/or expandable outsole treads are possible. For example the entire structure could be constructed using expansion joints and expandable outsole treads.

Figure 74:
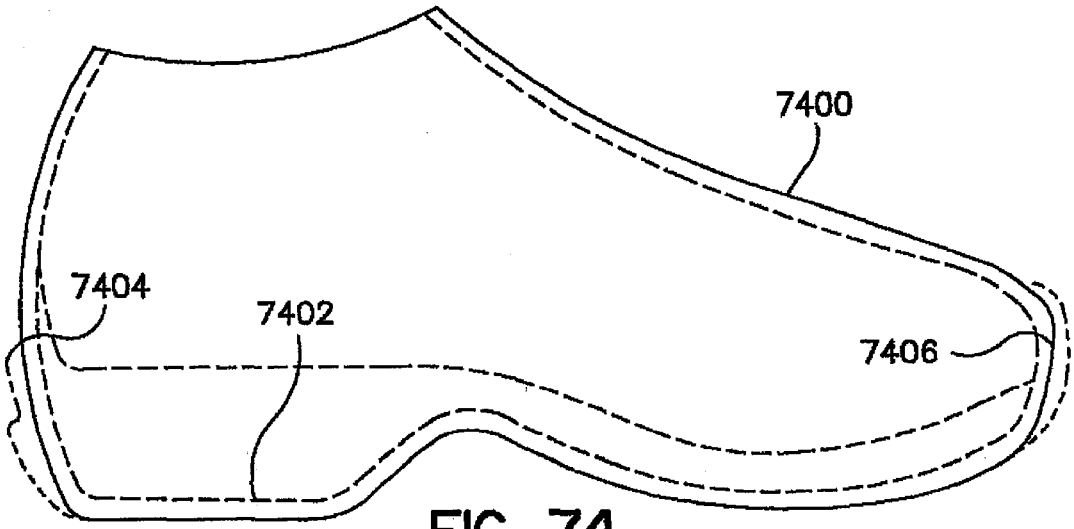
FIG. 74 is a side view of a stretch upper consistent with the invention including an anchor zone formed on the entire bottom surface of the upper.
Figure 75:
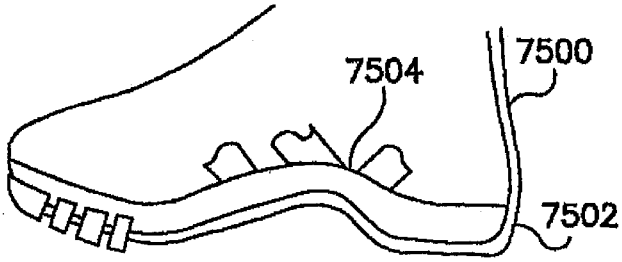
FIG. 75 is a side view of a portion of a structure consistent with the invention including a stretch outsole.
Figure 76:
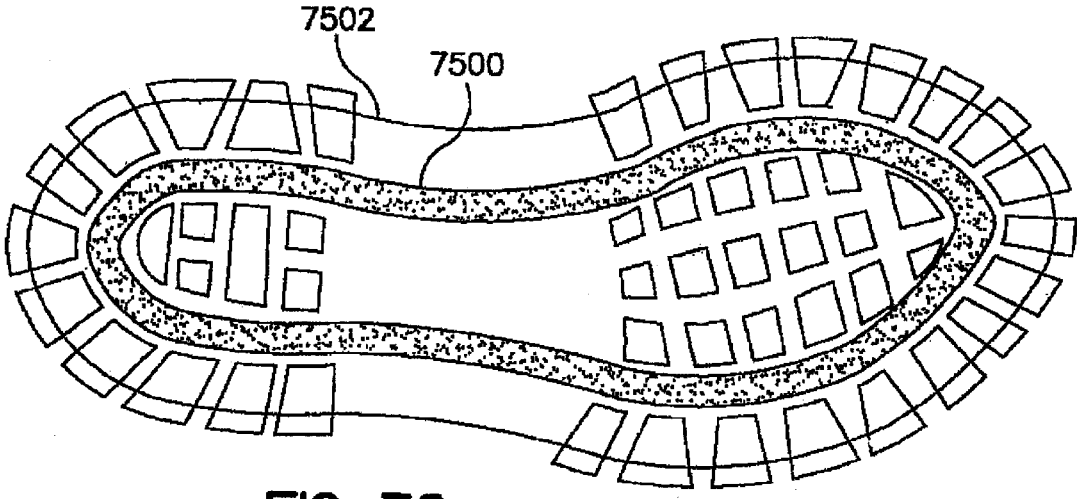
FIG. 76 is a bottom view of the exemplary outsole illustrated in FIG. 75.
Figure 77:
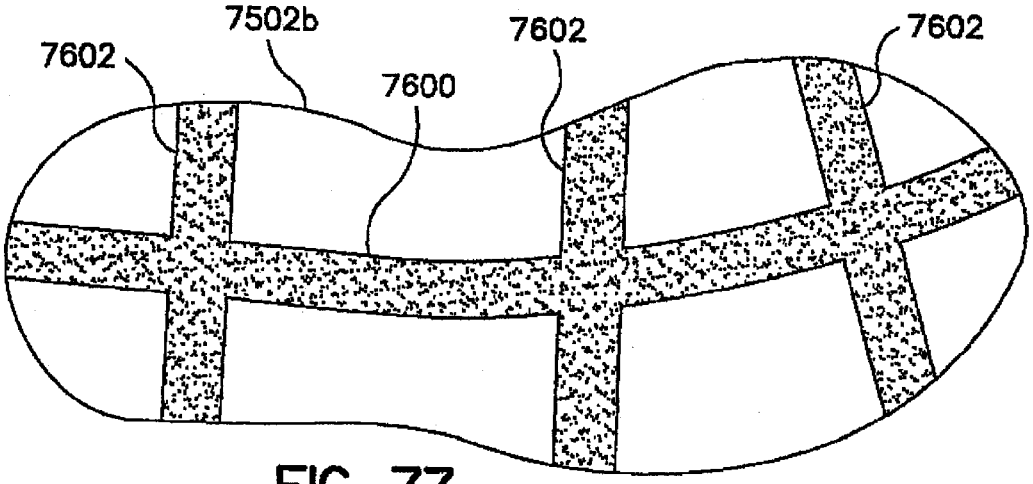
FIG. 77 is a bottom view of an alternative stretch outsole consistent with the present invention.

Turning now to FIG. 74, a stretch upper 7400 consistent with the invention may also be constructed with a full non-stretch bottom 7402 constructed from non-stretch material. In this embodiment, the entire bottom of the upper would be an anchor zone and the upper could stretch in areas other than at the bottom as indicated, for example, by dashed lines 7404, 7406. A full non-stretch bottom may also be constructed by securing an outsole, shank, or other member along the entire bottom of the upper 7400. Closure straps may extend from or be anchored to the non-stretch bottom and wrap around the upper. A stretch upper 7500 may also be combined with a stretch outsole 7502 secured to the stretch upper, e.g. by stitching, cementing, or direct injection molding of perimeter walls 7504, as shown in FIG. 75. The stretch outsole may include stretch zones and anchor zones, as shown for example in FIGS. 76 and 77. The stretch zones can be constructed in any of the manners described above in connection with the stretch upper. The anchor zones may be constructed of rubber, for example, and may be connected to the stretch zones by stitching or cement. The stretch zones may also include a rubber material, and may include co-molded rubber materials, e.g., one with high stretch and one with durability. In the embodiment of FIG. 76, a circumferential stretch zone 7500 in a stretch outsole 7502 allows expansion in all directions. The stretch outsole 7502 may include partial outsole segments with portions of the stretch upper 7500 in between. The partial segments may be spaced all around the sole. In the embodiment illustrated in FIG. 77, a lengthwise stretch zone 7600 allows widthwise expansion, while transverse stretch zones 7602 allow lengthwise expansion. The stretch zones of the sole area may also be formed by molding expansion zones into the sole. The molded sole stretch zones may include bellows-shaped/serpentine expandable walls and may also include molded-in expandable outsole treads.

Figure 78:
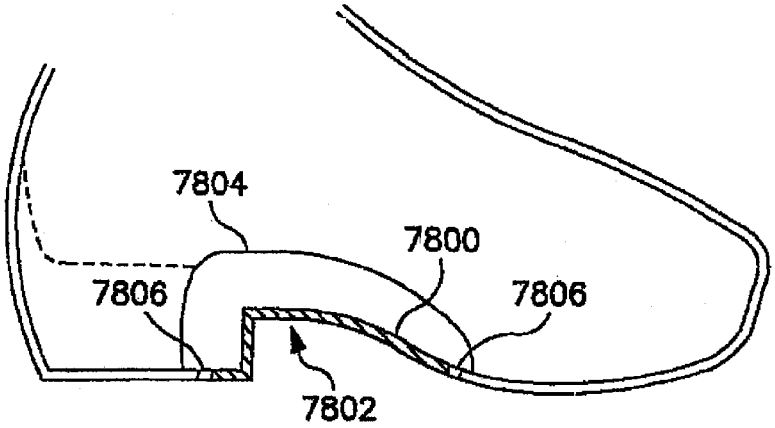
FIG. 78 is a longitudinal sectional view of an exemplary construction consistent with the invention wherein an anchor zone is defined by a non-stretch shank component in the interlock area of an upper including an abruptly changing shank.

Of course, a stretch upper as described above may also be provided in a configuration having an abrupt shank interlock area. As shown in FIG. 78, for example, an anchor zone in an abrupt shank interlock area may be established using a non-stretch shank component 7800 in the shank interlock area 7802. The shank component 7800 may have upwardly extending cupping walls 7804 that serve also as stitching flanges, and may also have stitching flanges 7806 at the forefoot and heel portions thereof. The construction shown in FIG. 78 may also be used to fabricate a non-stretch upper version having a shank interlock portion. The shank interlock component may be formed having an arched or abrupt shank interlock portion. The length of shank component 7800 and the upwardly extending sidewalls could be very minimal in an abrupt shank interlock version.

The embodiments that have been described herein, however, are but some of the several which utilize this invention and are set forth here by way of illustration but not of limitation. For example, the structure described herein can be incorporated into a wide variety of footwear types and sizes. Any particular feature described herein may be combined with other features described herein to construct a structure consistent with the invention. Also, midsole consistent with this invention may include a molded internal skeleton-like structure that mimics the structure and function of the bones of the human foot, particularly the bones located in the metatarsus area of the foot that forms the instep. The molded internal skeleton-like structure may be formed as an injection molded plastic component or by other means. The skeleton-like structure provides, stability, support, shock absorption, and energy return to the midsole structure. Other elements of the midsole may include components that mimic muscles, tendons, and ligaments of the human foot. A midsole consistent with this invention may also include a resilient insert including a plurality of first chambers fluidly interconnected to each other, a plurality of second chambers fluidly connected to each other, and a connecting passage connecting the first chambers and the second chambers. A flexible bladder may be disposed above the resilient insert. The chambers, may contain ambient air, pressurized air or gas, gels, or fluids that flow through the connecting passage. A midsole consistent with this invention may also include an energy return component on the top surface and sidewalls. It is obvious that many other embodiments, which will be readily apparent to those skilled in the art, may be made without departing materially from the spirit and scope of this invention.

What is claimed is:

1. A footwear structure comprising:

an outsole comprising at least one stretch zone and at least first and second zones, said stretch zone being disposed between said first and second anchor zones for allowing widthwise expansion and contraction of said outsole corresponding to expansion and contraction of a user's foot during wear;

an upper secured to a top surface of said outsole and at least partially defining a cavity, said upper comprising at least one upper stretch zone and at least first and second upper anchor zones, said upper stretch zone being disposed between said first and second upper anchor zones for allowing expansion of said upper during wear by a user; and a midsole at least partially disposed within said cavity, said midsole comprising a first region extending across the entire width of said midsole and having first level of rigidity and a second region extending across the entire width of said midsole and having a second level of rigidity, said first level of rigidity being different from said second level of rigidity.

2. A footwear structure according to claim 1, wherein said stretch zone in said outsole comprises a molded stretch portion extending between first and second margins, said first margin being secured to said first anchor zone in said outsole and said second margin being secured to said second anchor zone in said outsole.

3. A footwear structure according to claim 1, wherein at least a portion of said stretch zone in said outsole is disposed in a forefoot region of said outsole for allowing widthwise expansion of said forefoot region of said outsole during wear by a user.

4. A footwear structure according to claim 1, wherein said stretch zone in said outsole extends circumferentially around said outsole.

5. A footwear structure according to claim 1, wherein said first region comprises a heel region of said midsole and said second region comprises a forefoot region of said midsole.

6. A footwear structure according to claim 1, wherein said midsole comprises a plurality of layers.

7. A footwear structure according to claim 1, wherein said midsole is readily removable from said cavity.

8. A footwear structure comprising:

an outsole comprising at least one stretch zone and at least first and second anchor zones, said stretch zone being disposed between said first and second anchor zones for allowing widthwise expansion and contraction of said outsole corresponding to expansion and contraction of a user's foot during wear;

an upper secured to a top surface of said outsole and at least partially defining a cavity; and a midsole at least partially disposed within said cavity.

9. A footwear structure according to claim 8, wherein said outsole further comprises at least one lengthwise stretch zone being configured for allowing lengthwise expansion of said outsole.

10. A footwear structure according to claim 8, wherein said stretch zone comprises a molded stretch portion extending between first and second margins, said first margin being secured to said first anchor zone and said second margin being secured to said second anchor zone.

11. A footwear structure according to claim 8, wherein at least a portion of said stretch zone is disposed in a forefoot region of said outsole for allowing widthwise expansion of said forefoot region of said outsole during wear by a user.

12. A footwear structure according to claim 8, wherein said stretch zone extends circumferentially around said outsole.

13. A footwear structure according to claim 8, wherein said midsole comprises a first region having first level of rigidity and a second region having a second level of rigidity, said first level of rigidity being different from said second level of rigidity.

14. A footwear structure according to claim 13, wherein said a first and second regions extend across the entire width of said midsole.

15. A footwear structure according to claim 13, wherein said first region comprises a heel region of said midsole and said second region comprises a forefoot region of said midsole.

16. A footwear structure according to claim 8, wherein said midsole comprises a plurality of layers.

17. A footwear structure according to claim 8, wherein said midsole is readily removable from said cavity.

18. A footwear structure according to claim 8, wherein said midsole comprises a heel counter portion extending upwardly relative to a footbed surface of said midsole at a heel end of said midsole.

19. A footwear structure according to claim 8, wherein said upper comprises at least one upper stretch zone and at least first and second upper anchor zones, said upper stretch zone being disposed between said first and second upper anchor zones for allowing expansion of said upper during wear by a user.

20. A footwear structure according to claim 8, wherein said upper comprises a waterproof material.

* * * * *